US011486619B2

(12) United States Patent
Yamada et al.

(10) Patent No.: US 11,486,619 B2
(45) Date of Patent: Nov. 1, 2022

(54) AIR-CONDITIONING SYSTEM OR REFRIGERANT BRANCH UNIT

(71) Applicant: Daikin Industries, LTD., Osaka (JP)

(72) Inventors: Takuro Yamada, Osaka (JP); Masahiro Honda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 163 days.

(21) Appl. No.: 16/644,204

(22) PCT Filed: Aug. 29, 2018

(86) PCT No.: PCT/JP2018/031929

§ 371 (c)(1),
(2) Date: Mar. 4, 2020

(87) PCT Pub. No.: WO2019/049746

PCT Pub. Date: Mar. 14, 2019

(65) Prior Publication Data

US 2021/0071920 A1 Mar. 11, 2021

(30) Foreign Application Priority Data

Sep. 5, 2017 (JP) ..... JP2017-170529
Sep. 5, 2017 (JP) ..... JP2017-170530
Jul. 12, 2018 (JP) ..... JP2018-132596

(51) Int. Cl.
*F25B 49/00* (2006.01)
*F25B 41/20* (2021.01)
(Continued)

(52) U.S. Cl.
CPC ..... *F25B 49/005* (2013.01); *F25B 13/00* (2013.01); *F25B 41/20* (2021.01); *F25B 41/24* (2021.01)

(58) Field of Classification Search
CPC ..... F25B 41/00; F25B 41/20; F25B 41/24; F25B 41/28; F25B 41/30; F25B 41/31;
(Continued)

(56) References Cited

U.S. PATENT DOCUMENTS 4,766,735 A * 8/1988 Gotou ..... F25B 5/00 62/175
4,771,610 A * 9/1988 Nakashima ..... F25B 41/20 62/160
(Continued)

FOREIGN PATENT DOCUMENTS

CN 101363671 A 2/2009
GB 2451722 A 2/2009
(Continued)

OTHER PUBLICATIONS

International Search Report issued in corresponding International Application No. PCT/JP2018/031929 dated Oct. 16, 2018, with translation (9 pages).
(Continued)

*Primary Examiner* — Miguel A Diaz
(74) *Attorney, Agent, or Firm* — Osha Bergman Watanabe & Burton LLP

(57) ABSTRACT

An air-conditioning system that performs a refrigeration cycle in a refrigerant circuit includes: an outdoor unit; a plurality of indoor units; a refrigerant connection pipe that connects the outdoor unit and the indoor units; and a first control valve disposed in the refrigerant connection pipe and that blocks a flow of refrigerant. The refrigerant connection pipe includes: a plurality of indoor-side pipes that each communicate with one of the indoor units; an outdoor-side pipe that communicates with two or more of the indoor-side
(Continued)

pipes from an outdoor unit side; and a branch that connects the outdoor-side pipe and a group of two or more of the indoor-side pipes.

20 Claims, 18 Drawing Sheets

(51) Int. Cl.
*F25B 13/00* (2006.01)
*F25B 41/24* (2021.01)

(58) Field of Classification Search
CPC ..... F25B 41/38; F25B 41/385; F25B 41/39; F25B 41/40; F25B 41/42; F25B 41/45; F25B 41/48
See application file for complete search history.

(56) References Cited

U.S. PATENT DOCUMENTS 4,926,652 A * 5/1990 Kitamoto ..... F25B 13/00 62/175
4,932,220 A * 6/1990 Inoue ..... F25B 13/00 62/175
5,040,376 A * 8/1991 Ueno ..... F25B 13/00 62/160
5,046,323 A * 9/1991 Kuwahara ..... F24F 11/00 62/140
5,150,582 A * 9/1992 Gotou ..... F25B 47/022 62/155
6,701,722 B1 * 3/2004 Seo ..... F25B 13/00 62/129
7,308,800 B2 * 12/2007 Park ..... F25B 13/00 62/159
9,605,862 B2 * 3/2017 Eguchi ..... F25B 13/00
9,933,205 B2 * 4/2018 Hatomura ..... F25B 49/005
10,451,306 B2 * 10/2019 Takenaka ..... F25B 49/005
10,451,324 B2 * 10/2019 Kawagoe ..... F25B 45/00
11,131,471 B1 * 9/2021 Butler ..... F24F 11/52
2003/0230096 A1 * 12/2003 Hwang ..... F25B 13/00 62/160
2004/0035132 A1 * 2/2004 Park ..... F25B 13/00 62/324.1
2004/0139755 A1 * 7/2004 Han Park ..... F25B 41/24 62/199
2004/0182095 A1 * 9/2004 Alles ..... F24F 13/10 62/178
2007/0157650 A1 * 7/2007 Takegami ..... F25B 13/00 62/230
2009/0145151 A1 * 6/2009 Wakamoto ..... F25B 9/008 62/259.1
2011/0160918 A1 * 6/2011 McMasters ..... F25B 45/00 700/282
2013/0014525 A1 1/2013 Koge et al.
2013/0192283 A1 * 8/2013 Yamashita ..... F25B 49/005 62/126
2013/0205818 A1 * 8/2013 Morimoto ..... F24F 1/00077 62/186
2014/0033754 A1 2/2014 Hatomura et al.
2015/0233622 A1 * 8/2015 Yajima ..... F25B 49/005 62/129
2016/0305680 A1 * 10/2016 Eguchi ..... F24F 3/065
2016/0356516 A1 12/2016 Eguchi et al.
2019/0137154 A1 * 5/2019 Fukuda ..... F25B 5/02
2019/0242602 A1 8/2019 Yamada et al.

FOREIGN PATENT DOCUMENTS

JP H05-118720 A 5/1993
JP 05149638 A * 6/1993
JP H05-149638 A 6/1993
JP 06011203 A * 1/1994
JP H06-11203 A 1/1994
JP H09-264592 A 10/1997
JP H1172189 A 3/1999
JP 2007-232286 A 9/2007
JP 2015-114048 A 6/2015
JP 2016-11782 A 1/2016
JP 2016-11783 A 1/2016
JP 2016191502 A * 11/2016
JP 2018-71878 A 5/2018
WO 2011/141959 A1 11/2011
WO WO-2011141959 A1 * 11/2011 ..... F25B 41/40
WO 2012/160598 A1 11/2012
WO 2017/104127 A1 6/2017

OTHER PUBLICATIONS

International Preliminary Report on Patentability issued in corresponding International Application No. PCT/JP2018/031929 dated Mar. 10, 2020, with translation (23 pages).
Extended European Search Report issued in corresponding European Patent Application No. 18853114.9 dated May 11, 2021 (9 pages).

* cited by examiner

AIR-CONDITIONING SYSTEM OR REFRIGERANT BRANCH UNIT

TECHNICAL FIELD

The present disclosure relates to an air-conditioning system or a refrigerant branch unit.

BACKGROUND

In an air-conditioning system, there is a possibility that refrigerant leaks from a refrigerant circuit because of damage, installation failure, or the like, of devices that make up the refrigerant circuit, so measures for ensuring safety in the event of refrigerant leakage need to be taken. Particularly, in these days, from the viewpoint of energy conservation improvement and environmental load reduction, a slightly flammable refrigerant (refrigerant that is not so flammable but has such properties that the refrigerant burns when the concentration becomes higher than or equal to a predetermined value (lower flammability limit concentration)), such as R32, is used, and requests for such measures have been increasing.

Hitherto, as measures to be taken for refrigerant leakage, as disclosed in, for example, Patent Literature 1 (Japanese Unexamined Patent Application Publication No. H5-118720), a method of, when refrigerant leakage has been detected, reducing further refrigerant leakage into a space in which an indoor unit is installed (a living space, a warehouse space, or the like, which people enter or exit) by controlling a predetermined control valve (a valve of which the opening degree is controllable, such as an electromagnetic valve and an electrically-operated valve) to a closed state (minimum opening degree) in a refrigerant circuit to block the flow of refrigerant to the indoor unit has been suggested. In Patent Literature 1, in an air-conditioning system including a plurality of indoor units in the same refrigerant system, a pair of control valves is disposed for each indoor unit in connection pipes between an outdoor unit and each indoor unit, and, when there is refrigerant leakage, the associated control valves are controlled into a closed state.

In an air-conditioning system that is applied to a large-scale facility, such as a building and a factory, the number of indoor units to be installed increases according to the size of the facility. Therefore, when a pair of control valves is disposed for each indoor unit as in the case of Patent Literature 1, cost considerably increases according to the number of indoor units.

In addition, connection pipes between an outdoor unit and each indoor unit are usually installed in a narrow ceiling space. In this respect, when control valves are disposed for each indoor unit as in the case of Patent Literature 1, installation of a large number of control valves in connection pipes is required with an increase in the number of indoor units, which leads to considerably increasing working time and effort required for installation, so workability is not good.

In relation to improvement in safety against refrigerant leakage, cost is reduced, and a decrease in workability is reduced.

SUMMARY

An air-conditioning system according to one or more embodiments of the present invention is an air-conditioning system configured to perform a refrigeration cycle in a refrigerant circuit, and includes an outdoor unit, a plurality of indoor units, a refrigerant connection pipe, and a control valve. The refrigerant connection pipe connects the outdoor unit and the indoor units. The control valve is disposed in the refrigerant connection pipe. The control valve is configured to block a flow of refrigerant. The refrigerant connection pipe includes a plurality of indoor-side pipes, an outdoor-side pipe, and a branch portion (i.e. "branch"). The indoor-side pipes each communicate with the associated indoor unit(s). The outdoor-side pipe communicates with an associated plurality of the indoor-side pipes from the outdoor unit side. The branch portion connects an indoor-side pipe group and the outdoor-side pipe. The indoor-side pipe group is a pipe group that includes two or more of the indoor-side pipes. The outdoor-side pipe forms a refrigerant passage common to both refrigerant flowing from the outdoor unit side to the indoor units side via the associated indoor-side pipes and refrigerant flowing from the indoor units to the outdoor unit via the associated indoor-side pipes. The control valve is disposed in the outdoor-side pipe.

With the air-conditioning system according to one or more embodiments, the control valve configured to block a flow of refrigerant to the plurality of indoor units is disposed in the outdoor-side pipe, so an increase in the number of the control valves with increase in the number of the indoor units can be reduced. In other words, the control valve is disposed on the outdoor unit side of the indoor-side pipe group, so it is possible to block a flow of refrigerant from the outdoor-side pipe (outdoor unit side) to the associated indoor-side pipe group (the plurality of indoor units) in the event of refrigerant leakage. Therefore, the control valve need not be disposed for each indoor unit in ensuring safety against refrigerant leakage, so an increase in the number of control valves with an increase in the number of indoor units can be reduced.

Although the refrigerant connection pipe between the outdoor unit and the indoor units is usually installed in a narrow ceiling space, an increase in the number of control valves to be installed in the refrigerant connection pipe is reduced, so an increase in working time and effort required for installation can also be reduced.

Thus, in relation to improvement in safety against refrigerant leakage, cost reduction and workability improvement are facilitated.

An air-conditioning system according to one or more embodiments is an air-conditioning system configured to perform a refrigeration cycle in a refrigerant circuit, and includes an outdoor unit, a plurality of indoor units, a refrigerant connection pipe, and a control valve. The refrigerant connection pipe connects the outdoor unit and the indoor units. The control valves are disposed in the refrigerant connection pipe. The control valves are configured to block a flow of refrigerant. The refrigerant connection pipe includes a plurality of indoor-side pipes, an outdoor-side pipe, and a branch portion. The indoor-side pipes each communicate with the associated indoor unit(s). The outdoor-side pipe communicates with the associated plurality of indoor-side pipes from the outdoor unit side. The branch portion connects an indoor-side pipe group and the outdoor-side pipe. The indoor-side pipe group is a pipe group that includes two or more of the indoor-side pipes. The outdoor-side pipe forms a refrigerant passage common to both refrigerant flowing from the outdoor unit side to the indoor units side via the associated indoor-side pipes and refrigerant flowing from the indoor units to the outdoor unit via the associated indoor-side pipes. The control valve is disposed in an associated one of the indoor-side pipes.

With the air-conditioning system according to one or more embodiments, an increase in the number of the control valves with increase in the number of the indoor units can be reduced. In other words, the control valve configured to interrupt a flow of refrigerant into the plurality of indoor units is disposed in the indoor-side pipe disposed on the outdoor unit side of these indoor units, so a flow of refrigerant from the outdoor-side pipe (outdoor unit side) to these indoor units can be blocked in the event of refrigerant leakage. Therefore, the control valve need not be disposed for each indoor unit in ensuring safety against refrigerant leakage, so an increase in the number of control valves with an increase in the number of indoor units can be reduced.

Although the refrigerant connection pipe between the outdoor unit and the indoor units is usually installed in a narrow ceiling space, an increase in the number of control valves to be installed in the refrigerant connection pipe is reduced, so an increase in working time and effort required for installation can also be reduced. The control valve is disposed in the indoor-side pipe, so a control valve having smaller dimensions can be used as compared to when a control valve is disposed in the outdoor-side pipe. In relation to this, downsizing is facilitated, and a decrease in workability is reduced even in a narrow space.

Thus, in relation to improvement in safety against refrigerant leakage, cost reduction and workability improvement are facilitated.

In an air-conditioning system according to one or more embodiments, the refrigerant connection pipe includes a plurality of first parts. Each first part includes the outdoor-side pipe, the branch portion, and the indoor-side pipe group. When the control valve is disposed in the outdoor-side pipe, the control valve is disposed in the outdoor-side pipe in one or some of the first parts. When the control valve is disposed in the indoor-side pipe, the control valve is disposed in the indoor-side pipe in one or some of the first parts.

In the case where the refrigerant connection pipe includes a plurality of the first parts, even when the control valve is disposed only in the specific first part (for example, the first part closest to the outdoor unit) and the control valve is omitted from the other first part(s), a flow of refrigerant from the outdoor unit side to the indoor units side can be blocked. Therefore, in the case where the refrigerant connection pipe includes a plurality of the first parts, when the control valve is disposed only in one or some of the first parts, safety against refrigerant leakage is ensured, and an increase in the number of control valves can be reduced. The air-conditioning system according to one or more embodiments is based on such an idea. Thus, in relation to improvement in safety against refrigerant leakage, cost reduction and workability improvement are further facilitated.

In an air-conditioning system according to one or more embodiments, the refrigerant connection pipe includes a gas-side connection pipe and a liquid-side connection pipe. The gas-side connection pipe is a pipe through which low-pressure refrigerant flows. The liquid-side connection pipe is a pipe through which high-pressure or intermediate-pressure refrigerant flows. When the control valve is disposed in the outdoor-side pipe, the control valve is disposed in the outdoor-side pipe included in the gas-side connection pipe. When the control valve is disposed in the indoor-side pipe, the control valve is disposed in the indoor-side pipe included in the gas-side connection pipe.

In the outdoor unit or each indoor unit, an electronic expansion valve configured to decompress refrigerant is usually disposed in a refrigerant passage communicating with the liquid-side connection pipe. In the event of refrigerant leakage, the electronic expansion valve is controlled to a minimum opening degree. Thus, a flow of refrigerant from the outdoor unit into the indoor units via the liquid-side connection pipe can be blocked. On the other hand, a control valve such as the electronic expansion valve is not disposed in the refrigerant passage communicating with the gas-side connection pipe in many cases, so, in ensuring safety against refrigerant leakage, it is important to block a flow of refrigerant toward the indoor units via the gas-side connection pipe.

With the air-conditioning system according to one or more embodiments, the control valve is disposed in the outdoor-side pipe or the indoor-side pipe, included in the gas-side connection pipe, so an increase in the number of control valves is reduced, and ensuring safety against refrigerant leakage is facilitated.

In an air-conditioning system according to one or more embodiments, when the control valve is disposed in the outdoor-side pipe, the control valve is also disposed in the outdoor-side pipe included in the liquid-side connection pipe. When the control valve is disposed in the indoor-side pipe, the control valve is also disposed in the indoor-side pipe included in the liquid-side connection pipe.

With the air-conditioning system according to one or more embodiments, the control valve is also disposed in the outdoor-side pipe or the indoor-side pipe, included in the liquid-side connection pipe, so ensuring safety against refrigerant leakage is further facilitated.

In an air-conditioning system according to one or more embodiments, each indoor unit includes an electrically-operated valve. The electrically-operated valve is configured to decompress refrigerant according to an opening degree during operation. The electrically-operated valve is configured to, when refrigerant leakage has occurred, block a flow of refrigerant into the indoor unit by being placed in a closed state.

With the air-conditioning system according to one or more embodiments, the electrically-operated valve configured to block a flow of refrigerant by being controlled into a closed state when refrigerant leakage has occurred is disposed in the indoor unit, so it is possible to further reliably interrupt a flow of refrigerant from the outdoor unit to the indoor unit in the event of refrigerant leakage. Thus, ensuring safety against refrigerant leakage is further facilitated.

In an air-conditioning system according to one or more embodiments, when the control valve is disposed in the outdoor-side pipe, the control valve is disposed in each of any one or two or all of the following A, B, and C. When the control valve is disposed in the indoor-side pipe, the control valve is disposed in each of any one or two or all of the following D, E, and F.

A: the outdoor-side pipe disposed between the outdoor unit and a plurality of the indoor units of which a total capacity is less than or equal to a first threshold B: the outdoor-side pipe disposed between the outdoor unit and a plurality of the indoor units of which a total number is less than or equal to a second threshold C: the outdoor-side pipe of which the refrigerant connection pipe having a total capacity being less than or equal to a third threshold is located on the indoor unit side D: the indoor-side pipe disposed between the outdoor unit and a plurality of the indoor units of which a total capacity is less than or equal to a fourth threshold E: the indoor-side pipe disposed between the outdoor unit and a plurality of the indoor units of which a total number is less than or equal to a fifth threshold F: the indoor-side pipe of which the refrigerant connection pipe having a total capacity being less than or equal to a sixth threshold is located on the indoor unit side.

With this configuration, depending on the scale or environment of a facility in which an air-conditioning system is installed, a control valve can be appropriately disposed at a portion (outdoor-side pipe) required to interrupt refrigerant from the viewpoint of safety (for example, lower flammability limit concentration, or the like) at the time when refrigerant leakage has occurred. Thus, an increase in the number of control valves can be reduced, and ensuring safety against refrigerant leakage is further facilitated.

In an air-conditioning system according to one or more embodiments, the first threshold, the second threshold, the third threshold, the fourth threshold, the fifth threshold, and the sixth threshold are set based on a size of any one of object spaces in each of which the indoor unit is installed and air is conditioned.

With this configuration, depending on the scale or environment of a facility in which an air-conditioning system is installed, appropriate disposition of a control valve at a portion (outdoor-side pipe) required to interrupt refrigerant from the viewpoint of safety at the time when refrigerant leakage has occurred is further facilitated. In other words, the first threshold, the second threshold, the third threshold, the fourth threshold, the fifth threshold, and/or the sixth threshold, which is a reference at the time when the disposition of a control valve is determined, can be set based on a critical value (such as lower flammability limit concentration and oxygen-deficient concentration) that is determined according to how wide an object space in which an indoor unit is installed (for example, narrowest object space). Thus, an increase in the number of control valves can be reduced, and ensuring safety against refrigerant leakage is further facilitated.

In an air-conditioning system according to one or more embodiments, the outdoor-side pipe and/or the indoor-side pipe are integrally combined with the branch portion and the control valve. With this configuration, installation of the control valve(s) becomes easy, so an increase in working time and effort required for installation is further reduced. Thus, in relation to improvement in safety against refrigerant leakage, workability improvement is further facilitated.

In an air-conditioning system according to one or more embodiments, the refrigerant connection pipe includes a branch pipe unit. The branch pipe unit is preassembled and connected to another pipe on an installation site. The branch pipe unit includes the integrally combined outdoor-side pipe and/or indoor-side pipe, branch portion, and control valve.

With this configuration, installation of the control valve(s) becomes particularly easy, so an increase in working time and effort required for installation is further reduced. Thus, in relation to improvement in safety against refrigerant leakage, workability improvement is further facilitated.

In an air-conditioning system according to one or more embodiments, any one of valves disposed in the refrigerant circuit has a liquid seal control structure. Instead of this or in addition to this, a liquid seal control mechanism is disposed in the refrigerant circuit. The liquid seal control structure is a structure configured to suppress formation of a liquid seal circuit in the refrigerant circuit when the control valve is placed in a closed state. The liquid seal control mechanism is a mechanism configured to suppress formation of a liquid seal circuit in the refrigerant circuit when the control valve is placed in a closed state. With this configuration, when refrigerant leakage has occurred and the control valve is placed in a closed state, formation of a liquid seal circuit in the refrigerant circuit is suppressed.

The liquid seal control structure is not limited as long as the liquid seal control structure is a structure configured to suppress formation of a liquid seal circuit. For example, as a liquid seal control structure, a small passage that allows passage of refrigerant in small amount in the case of a closed state may be formed in the valve. Alternatively, for example, as a liquid seal control structure, a valve may be configured to allow passage of refrigerant in small amount at the time when pressure higher than or equal to a predetermined value is applied even in the case of a closed state.

The liquid seal control mechanism is not limited as long as the liquid seal control mechanism is a mechanism configured to suppress formation of a liquid seal circuit. For example, a pipe that forms a bypass circuit configured to bypass refrigerant from a passage on one end side of the control valve to a passage on the other end side of the control valve may be disposed in the refrigerant circuit as the liquid seal control mechanism. In this case, the liquid seal control mechanism may include a check valve disposed in the bypass circuit and configured to allow a flow of refrigerant in only one direction, an on-off valve disposed in the bypass circuit and configured to switch between communication and interruption of the bypass circuit, or the like.

A refrigerant branch unit according to one or more embodiments of the present invention connects an outdoor-side connection pipe and a plurality of indoor-side connection pipes in an air-conditioning system including an outdoor unit and a plurality of indoor units, connected via a refrigerant connection pipe, the refrigerant connection pipe including the plurality of indoor-side connection pipes each communicating with the associated indoor unit(s) and the outdoor-side connection pipe communicating with the plurality of indoor-side connection pipes from the outdoor unit side. The refrigerant branch unit includes a first connection pipe, a plurality of second connection pipes, a branch portion, and a control valve. The first connection pipe communicates with the outdoor-side connection pipe. The plurality of second connection pipes each communicates with an associated one of the associated indoor-side connection pipes. The branch portion communicates the first connection pipe with the plurality of second connection pipes. The control valve is configured to block a flow of refrigerant by being placed in a closed state. The control valve is connected to the first connection pipe.

The refrigerant branch unit according to one or more embodiments of the present invention connects the outdoor-side connection pipe and the plurality of indoor-side connection pipes and includes the first connection pipe communicating with the outdoor-side connection pipe, the plurality of second connection pipes each communicating with an associated one of the indoor-side connection pipes, the branch portion communicating the first connection pipe with the plurality of second connection pipes, and the control valve connected to the first connection pipe and configured to block a flow of refrigerant by being placed in a closed state. With this configuration, the first connection pipe, the plurality of second connection pipes, the branch portion, and the control valve can be installed in the refrigerant connection pipe in a preassembled state. In this respect, although manhour increases if a control valve and a branch pipe are joined on site at the time of installation, working time and effort required for installation are reduced with the refrigerant branch unit. Thus, in relation to improvement in safety against refrigerant leakage in the air-conditioning system, a decrease in workability can be reduced.

A refrigerant branch unit according to one or more embodiments of the present invention connects an outdoor-side connection pipe and a plurality of indoor-side connection pipes in an air-conditioning system including an outdoor unit and a plurality of indoor units, connected via a refrigerant connection pipe, the refrigerant connection pipe including the plurality of indoor-side connection pipes each communicating with the associated indoor unit(s) and the outdoor-side connection pipe communicating with the plurality of indoor-side connection pipes from the outdoor unit side. The refrigerant branch unit includes a first connection pipe, a plurality of second connection pipes, a branch portion, and control valve. The first connection pipe communicates with the outdoor-side connection pipe. The plurality of second connection pipes each communicates with an associated one of the indoor-side connection pipes. The branch portion communicates the first connection pipe with the plurality of second connection pipes. The control valve is configured to block a flow of refrigerant by being placed in a closed state. The control valve is connected to an associated one of the second connection pipes.

The refrigerant branch unit according to one or more embodiments of the present invention connects the outdoor-side connection pipe and the plurality of indoor-side connection pipes and includes the first connection pipe communicating with the outdoor-side connection pipe, the plurality of second connection pipes each communicating with an associated one of the indoor-side connection pipes, the branch portion communicating the first connection pipe with the plurality of second connection pipes, and the control valve connected to an associated one of the second connection pipes and configured to block a flow of refrigerant by being placed in a closed state. With this configuration, the first connection pipe, the plurality of second connection pipes, the branch portion, and the control valve can be installed in the refrigerant connection pipe in a preassembled state. In this respect, although manhour increases if a control valve and a branch pipe are joined on site at the time of installation, working time and effort required for installation are reduced with the refrigerant branch unit. Thus, in relation to improvement in safety against refrigerant leakage in the air-conditioning system, a decrease in workability can be reduced.

In a refrigerant branch unit according to one or more embodiments of the present invention, the control valve includes a valve body, a first end portion, and a second end portion. The first end portion is connected to one end of the first connection pipe or the outdoor-side connection pipe. The second end portion is connected to the branch portion or an other end of the first connection pipe (more specifically, when the first end portion is connected to one end of the first connection pipe, the second end portion is connected to the branch portion; when the first end portion is connected to the outdoor-side connection pipe, the second end portion is connected to the other end of the first connection pipe). A longitudinal direction of the second end portion intersects with a longitudinal direction of the first end portion. The second end portion is connected to the branch portion or the other end of the first connection pipe such that, in an installation state, the second connection pipes are arranged along a horizontal direction and a longitudinal direction of each second connection pipe extends along the horizontal direction.

At the time of installation, the refrigerant branch unit is connected to each of the indoor-side connection pipes at the second connection pipes, and the indoor-side connection pipes generally mainly extend along a horizontal direction on an installation site. In this respect, when it is difficult that the second connection pipes are arranged along the horizontal direction and the longitudinal direction of each second connection pipe extends along the horizontal direction due to the shape of the control valve (for example, an L-shape in which the first end portion and the second end portion intersect at right angles), work for bending the indoor-side connection pipe and a joint are required at the time of connecting the second connection pipes and the indoor-side connection pipes, so installation is complicated.

With the refrigerant branch unit according to one or more embodiments of the present invention, the second end portion of the control valve is connected to the branch portion or the other end of the first connection pipe such that, in the installation state, the second connection pipes are arranged along the horizontal direction and the longitudinal direction of each second connection pipe extends along the horizontal direction, so the extending direction of each second connection pipe can be caused to match the extending direction (horizontal direction) of each indoor-side connection pipe regardless of the shape of the control valve. This makes the connection of both pipes easy. Thus, workability further improves.

The "along the horizontal direction" not only includes a state of strictly matching the horizontal direction but also a state slightly inclined relative to the horizontal direction. Specifically, in an installation state, in side view, when the angle made between each second connection pipe and a horizontal line is greater than or equal to 0° and less than or equal to 30°, it can be interpreted as "the second connection pipes are arranged along the horizontal direction" and it can be interpreted as "the longitudinal direction of each second connection pipe extends along the horizontal direction" (this also applies to other descriptions in the specification).

In a refrigerant branch unit according to one or more embodiments of the present invention, the control valve includes a valve body, a third end portion, and a fourth end portion. The third end portion is connected to one end of the second connection pipe or the branch portion. The fourth end portion is connected to the indoor-side connection pipe or the other end of the second connection pipe (more specifically, when the third end portion is connected to one end of the second connection pipe, the fourth end portion is connected to the indoor-side connection pipe; when the third end portion is connected to the branch portion, the fourth end portion is connected to the other end of the second connection pipe). A longitudinal direction of the fourth end portion intersects with a longitudinal direction of the third end portion. The fourth end portion is connected to the indoor-side connection pipe or an other end of the second connection pipe such that, in an installation state, the second connection pipes are arranged along a horizontal direction and a longitudinal direction of each second connection pipe extends along the horizontal direction.

At the time of installation, the refrigerant branch unit is connected to each of the indoor-side connection pipes at the second connection pipes, and the indoor-side connection pipes generally mainly extend along a horizontal direction on an installation site. In this respect, when it is difficult that the second connection pipes are arranged along the horizontal direction and the longitudinal direction of each second connection pipe extends along the horizontal direction due to the shape of the control valve, work for bending the indoor-side connection pipe and a joint are required at the time of connecting the second connection pipes and the indoor-side connection pipes, so installation is complicated.

With the refrigerant branch unit according to one or more embodiments of the present invention, the fourth end portion of the control valve is connected to the indoor-side connection pipe or the other end of the second connection pipe such that, in the installation state, the second connection pipes are arranged along the horizontal direction and the longitudinal direction of each second connection pipe extends along the horizontal direction, so the extending direction of each second connection pipe can be caused to match the extending direction (horizontal direction) of each indoor-side connection pipe regardless of the shape of the control valve. This makes the connection of both pipes easy. Thus, workability further improves.

The "along the horizontal direction" not only includes a state of strictly matching the horizontal direction but also a state slightly inclined relative to the horizontal direction. Specifically, in an installation state, in side view, when the angle made between each second connection pipe and a horizontal line is greater than or equal to 0° and less than or equal to 30°, it can be interpreted as "the second connection pipes are arranged along the horizontal direction" and it can be interpreted as "the longitudinal direction of each second connection pipe extends along the horizontal direction" (this also applies to other descriptions in the specification).

In a refrigerant branch unit according to one or more embodiments of the present invention, the first connection pipe, the plurality of second connection pipes, the branch portion, and the control valve are included in a first component. The refrigerant branch unit further includes a second component and a wire. The second component includes a board. An electric component for controlling a status of each control valve is implemented on or in the board. The wire connects the control valve and the board. The second component is provided independently of the first component so as to be freely moved relative to the first component.

With this configuration, at the time of installation, the second component can be installed so as to be movable relative to the first component. Therefore, the flexibility of installation increases on site, so reduction in working time and effort required for installation is facilitated.

In a refrigerant branch unit according to one or more embodiments of the present invention, the second component has a casing accommodating the board. With this configuration, installation is easy even in a narrow space, so workability further improves.

In a refrigerant branch unit according to one or more embodiments of the present invention, the wire has a longitudinal dimension of 1 m or greater. With this configuration, the first component and the second component can be installed so as to be spaced apart 1 m or longer, so the flexibility of installation on site is further increased. Thus, workability further improves.

In a refrigerant branch unit according to one or more embodiments of the present invention, a liquid seal control mechanism configured to suppress formation of a liquid seal circuit when the control valve is placed in a closed state is disposed. Instead of this or in addition to this, the control valve has a liquid seal control structure configured to suppress formation of a liquid seal circuit when the control valve is placed in a closed state. The liquid seal control structure is a structure configured to suppress formation of a liquid seal circuit in the refrigerant circuit when the control valve is placed in a closed state. The liquid seal control mechanism is a mechanism configured to suppress formation of a liquid seal circuit when the control valve is placed in a closed state. With this configuration, when refrigerant leakage has occurred and the control valve is placed in a closed state, formation of a liquid seal circuit is suppressed.

The liquid seal control structure is not limited as long as the liquid seal control structure is a structure configured to suppress formation of a liquid seal circuit. For example, as a liquid seal control structure, a small passage that allows passage of refrigerant in small amount in the case of a closed state may be formed in the control valve. Alternatively, for example, as a liquid seal control structure, a control valve may be configured to allow passage of refrigerant in small amount at the time when pressure higher than or equal to a predetermined value is applied even in the case of a closed state.

The liquid seal control mechanism is not limited as long as the liquid seal control mechanism is a mechanism configured to suppress formation of a liquid seal circuit. For example, a pipe that forms a bypass circuit configured to bypass refrigerant from a passage on one end side of the control valve to a passage on the other end side of the control valve may be disposed in the refrigerant branch unit as the liquid seal control mechanism. In this case, the liquid seal control mechanism may include a check valve disposed in the bypass circuit and configured to allow a flow of refrigerant in only one direction, an on-off valve disposed in the bypass circuit and configured to switch between communication and interruption of the bypass circuit, or the like.

DETAILED DESCRIPTION

Hereinafter, an air-conditioning system 100 and a branch pipe unit 50 (refrigerant branch unit) according to one or more embodiments of the present disclosure will be described with reference to the drawings. The following embodiments are a specific example and do not limit the technical scope. The following embodiments may be modified as needed without departing from the substance. In the specification, "liquid refrigerant" includes not only liquid refrigerant in a saturated liquid state but also gas-liquid two-phase refrigerant in a gas-liquid two-phase state. A "closed state" is a minimum opening degree that a valve can assume (including a fully closed state), and an "open state" is an opening degree greater than the minimum opening degree.

(1) Air-Conditioning System 100

Figure 1:
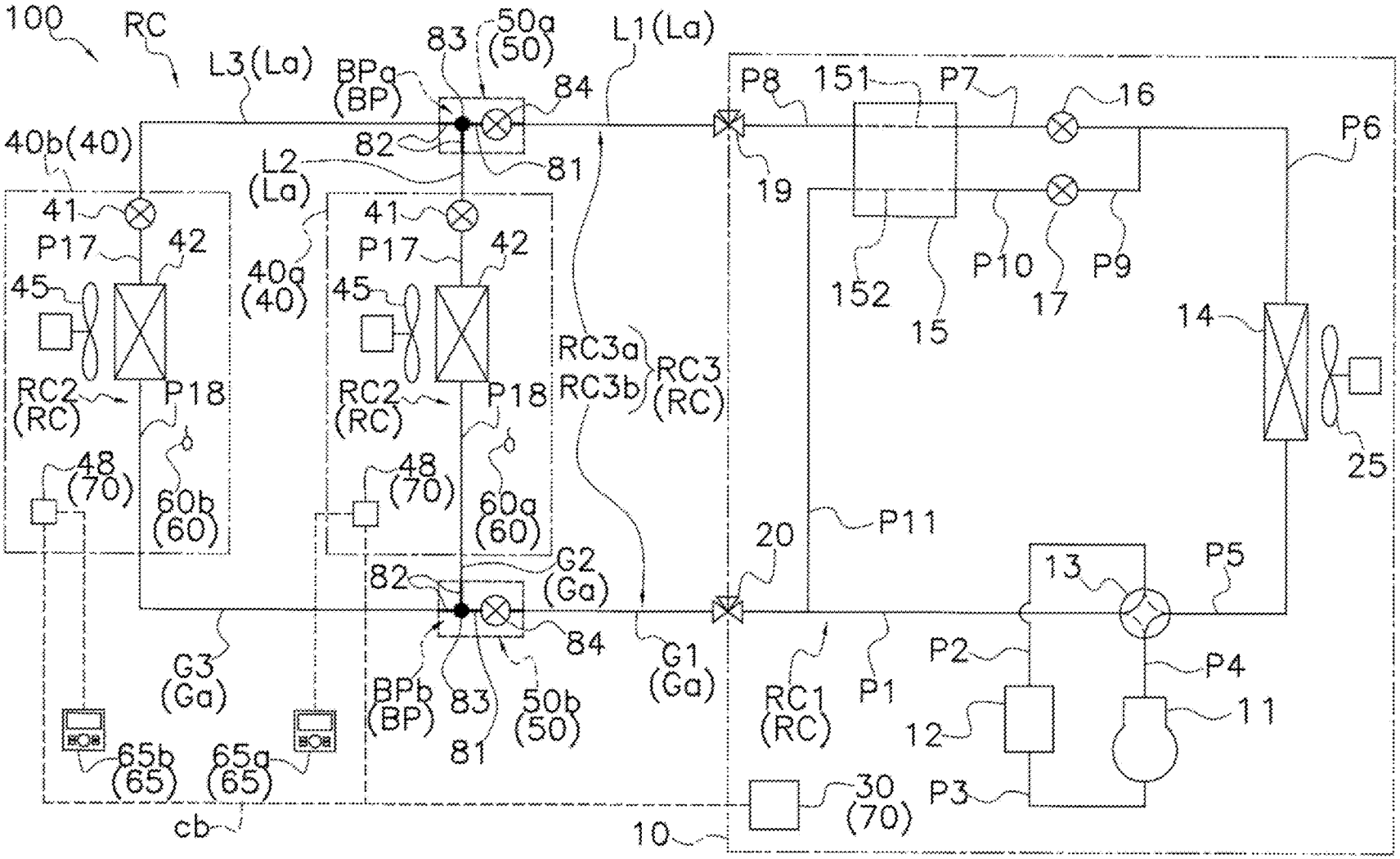
FIG. 1 is a schematic configuration diagram of an air-conditioning system according to one or more embodiments of the present disclosure.

FIG. 1 is a schematic configuration diagram of the air-conditioning system 100. The air-conditioning system 100 is a refrigeration apparatus that performs air conditioning, such as cooling or heating, in an object space (space, such as a living space, a space in a storage warehouse, a space in a low temperature warehouse, and a space in a shipping container) by using a vapor compression refrigeration cycle. The air-conditioning system 100 mainly includes an outdoor unit 10, a plurality of indoor units 40 (40*a*, 40*b*), a liquid-side connection pipe La, a gas-side connection pipe Ga, a plurality of refrigerant leak sensors 60 (60*a*, 60*b*), a plurality of remote control units 65 (65*a*, 65*b*), and a controller 70 configured to control the operation of the air-conditioning system 100. The air-conditioning system 100 includes a plurality of branch pipe units 50 as elements of the liquid-side connection pipe La and gas-side connection pipe Ga. In the following description, the branch pipe units 50 are described as the elements of the liquid-side connection pipe La and gas-side connection pipe Ga; however, each branch pipe unit 50 may be interpreted as an independent element.

In the air-conditioning system 100, a refrigerant circuit RC is formed by connecting the outdoor unit 10 and the indoor units 40 via the liquid-side connection pipe La and the gas-side connection pipe Ga (including the branch pipe units 50). In the air-conditioning system 100, in the refrigerant circuit RC, a refrigeration cycle in which refrigerant is compressed, cooled or condensed, decompressed, heated or evaporated, and then compressed again takes place. In one or more embodiments, the refrigerant circuit RC is filled with slightly flammable R32 as a refrigerant for performing a vapor compression refrigeration cycle.

The refrigerant circuit RC mainly includes an outdoor-side circuit RC1 formed in the outdoor unit 10, an indoor-side circuit RC2 formed in each of the indoor units 40, and a connection circuit RC3 connecting the outdoor-side circuit RC1 and the indoor-side circuits RC2. The connection circuit RC3 includes a liquid-side connection circuit RC3*a* that functions as a passage for liquid refrigerant flowing between the outdoor unit 10 and the indoor units 40 and a gas-side connection circuit RC3*b* that functions as a passage for gas refrigerant flowing between the outdoor unit 10 and the indoor units 40.

b) Outdoor Unit 10

The outdoor unit 10 is placed outdoors. The outdoor unit 10 is connected to the plurality of indoor units 40 via the liquid-side connection pipe La and the gas-side connection pipe Ga (including the branch pipe units 50), and makes up part of the refrigerant circuit RC (outdoor-side circuit RC1).

The outdoor unit 10 mainly includes a plurality of refrigerant pipes (a first pipe P1 to an eleventh pipe P11), a compressor 11, an accumulator 12, a four-way valve 13, an outdoor heat exchanger 14, a supercooler 15, an outdoor first electrically-operated valve 16, an outdoor second electrically-operated valve 17, a liquid-side stop valve 19, and a gas-side stop valve 20 as devices that make up the outdoor-side circuit RC1.

The first pipe P1 connects the gas-side stop valve 20 and a first port of the four-way valve 13. The second pipe P2 connects an inlet port of the accumulator 12 and a second port of the four-way valve 13. The third pipe P3 connects an outlet port of the accumulator 12 and a suction port of the compressor 11. The fourth pipe P4 connects a discharge port of the compressor 11 and a third port of the four-way valve 13. The fifth pipe P5 connects a fourth port of the four-way valve 13 and a gas-side outlet/inlet port of the outdoor heat exchanger 14. The sixth pipe P6 connects a liquid-side outlet/inlet port of the outdoor heat exchanger 14 and one end of the outdoor first electrically-operated valve 16. The seventh pipe P7 connects the other end of the outdoor first electrically-operated valve 16 and one end of a main passage 151 of the supercooler 15. The eighth pipe P8 connects the other end of the main passage 151 of the supercooler 15 and one end of the liquid-side stop valve 19. The ninth pipe P9 connects a portion between both ends of the sixth pipe P6 and one end of the outdoor second electrically-operated valve 17. The tenth pipe P10 connects the other end of the outdoor second electrically-operated valve 17 and one end of a sub-passage 152 of the supercooler 15. The eleventh pipe P11 connects the other end of the sub-passage 152 of the supercooler 15 and a portion between both ends of the first pipe P1. These refrigerant pipes (P1 to P11) each may be actually made up of a single pipe or may be made up of a plurality of pipes connected via a joint, or the like.

The compressor 11 is a device that compresses low-pressure refrigerant into high pressure in the refrigeration cycle. In one or more embodiments, the compressor 11 has a hermetically sealed structure in which a positive-displacement, such as a rotary type or a scroll type, compression element is driven for rotation by a compressor motor (not shown). Here, the compressor motor is able to control operation frequency with an inverter. With this configuration, displacement control over the compressor 11 is enabled.

The accumulator 12 is a tank for regulating excessive suction of liquid refrigerant into the compressor 11. The accumulator 12 has a predetermined volume according to the amount of refrigerant filled in the refrigerant circuit RC.

The four-way valve 13 is a flow switch valve for switching the flow of refrigerant in the refrigerant circuit RC. The four-way valve 13 can be switched between a normal cycle mode and a reverse cycle mode. The four-way valve 13, when in the normal cycle mode, communicates the first port (first pipe P1) with the second port (second pipe P2) and communicates the third port (fourth pipe P4) with the fourth port (fifth pipe P5) (see the solid lines in the four-way valve 13 in FIG. 1). The four-way valve 13, when in the reverse cycle mode, communicates the first port (first pipe P1) with the third port (fourth pipe P4) and communicates the second port (second pipe P2) with the fourth port (fifth pipe P5) (see the dashed lines in the four-way valve 13 in FIG. 1).

The outdoor heat exchanger 14 is a heat exchanger that functions as a condenser (or radiator) or evaporator for refrigerant. The outdoor heat exchanger 14 functions as the condenser for refrigerant during normal cycle operation (operation when the four-way valve 13 is in the normal cycle mode). The outdoor heat exchanger 14 functions as the evaporator for refrigerant during reverse cycle operation (operation when the four-way valve 13 is in the reverse cycle mode). The outdoor heat exchanger 14 includes a plurality of heat transfer tubes and heat transfer fins (not shown). The outdoor heat exchanger 14 is configured such that heat is exchanged between refrigerant in the heat transfer tubes and air (outdoor-side air flow (described later)) passing around the heat transfer tubes or the heat transfer fins.

The supercooler 15 is a heat exchanger that converts inflow refrigerant into liquid refrigerant in a supercooled state. The supercooler 15 is, for example, a double-tube heat exchanger. The main passage 151 and the sub-passage 152 are formed in the supercooler 15. The supercooler 15 is configured such that refrigerant flowing through the main passage 151 and refrigerant flowing through the sub-passage 152 exchange heat with each other.

The outdoor first electrically-operated valve 16 is an electrically-operated valve of which the opening degree is controllable. The outdoor first electrically-operated valve 16 decompresses inflow refrigerant or adjusts the flow rate according to the opening degree. The outdoor first electrically-operated valve 16 can be switched between an open state and a closed state. The outdoor first electrically-operated valve 16 is disposed between the outdoor heat exchanger 14 and the supercooler 15 (main passage 151).

The outdoor second electrically-operated valve 17 is an electrically-operated valve of which the opening degree is controllable. The outdoor second electrically-operated valve 17 decompresses inflow refrigerant or adjusts the flow rate according to the opening degree. The outdoor second electrically-operated valve 17 can be switched between an open state and a closed state. The outdoor second electrically-operated valve 17 is disposed between the outdoor heat exchanger 14 and the supercooler 15 (sub-passage 152).

The liquid-side stop valve 19 is a manual valve disposed at a connection point between the eighth pipe P8 and the liquid-side connection pipe La. One end of the liquid-side stop valve 19 is connected to the eighth pipe P8, and the other end of the liquid-side stop valve 19 is connected to the liquid-side connection pipe La.

The gas-side stop valve 20 is a manual valve disposed at a connection point between the first pipe P1 and the gas-side connection pipe Ga. One end of the gas-side stop valve 20 is connected to the first pipe P1, and the other end of the gas-side stop valve 20 is connected to the gas-side connection pipe Ga.

The outdoor unit 10 includes an outdoor fan 25 that generates outdoor-side air flow that passes through the outdoor heat exchanger 14. The outdoor fan 25 is a fan that supplies the outdoor heat exchanger 14 with outdoor-side air flow as a cooling source or heating source for refrigerant flowing through the outdoor heat exchanger 14. The outdoor fan 25 includes an outdoor fan motor (not shown) that is a drive source, and the start, stop, and number of rotations of the outdoor fan 25 are controlled as needed.

A plurality of outdoor-side sensors 26 (see FIG. 4) for detecting the status (mainly, pressure or temperature) of refrigerant in the refrigerant circuit RC is disposed in the outdoor unit 10. The outdoor-side sensors 26 are a pressure sensor and a temperature sensor, such as a thermistor and a thermocouple. Examples of the outdoor-side sensors 26 include a suction pressure sensor that detects a suction pressure that is the pressure of refrigerant at a suction side of the compressor 11, a discharge pressure sensor that detects a discharge pressure that is the pressure of refrigerant at a discharge side of the compressor 11, and a temperature sensor that detects the temperature of refrigerant in the outdoor heat exchanger 14.

The outdoor unit 10 includes an outdoor unit control unit 30 that controls the operations and statuses of the devices included in the outdoor unit 10. The outdoor unit control unit 30 includes a microcomputer including a CPU, a memory, and the like. The outdoor unit control unit 30 is electrically connected to the devices (11, 13, 16, 17, 25, and the like), included in the outdoor unit 10, and the outdoor-side sensors 26, and inputs or outputs signals to or from each other. The outdoor unit control unit 30 individually sends or receives control signals, or the like, to or from an indoor unit control unit 48 (described later) or remote control unit 65 of each indoor unit 40 via a communication line cb.

a) Indoor Unit 40

The indoor units 40 are connected to the outdoor unit 10 via the liquid-side connection pipe La and the gas-side connection pipe Ga (including the branch pipe units 50). Each indoor unit 40 is disposed in parallel with the other indoor unit 40 with respect to the outdoor unit 10. Each indoor unit 40 is placed in an object space, and makes up part of the refrigerant circuit RC (indoor-side circuit RC2). Each indoor unit 40 mainly includes a plurality of refrigerant pipes (a seventeenth pipe P17 to an eighteenth pipe P18), an indoor expansion valve 41 (which corresponds to the "electrically-operated valve" in the claims), and an indoor heat exchanger 42, as devices that make up the indoor-side circuit RC2.

The seventeenth pipe P17 connects the liquid-side connection pipe La and a liquid-side refrigerant inlet/outlet port of the indoor heat exchanger 42. The eighteenth pipe P18 connects a gas-side refrigerant inlet/outlet port of the indoor heat exchanger 42 and the gas-side connection pipe Ga. These refrigerant pipes (P17 to P18) each may be actually made up of a single pipe or may be made up of a plurality of pipes connected via a joint, or the like.

The indoor expansion valve 41 is an electrically-operated valve of which the opening degree is controllable. The indoor expansion valve 41 decompresses inflow refrigerant or adjusts the flow rate according to the opening degree. The indoor expansion valve 41 can be switched between an open state and a closed state. The indoor expansion valve 41 is disposed in the seventeenth pipe P17 and is located between the liquid-side connection pipe La and the indoor heat exchanger 42.

The indoor heat exchanger 42 is a heat exchanger that functions as an evaporator or condenser (or radiator) for refrigerant. The indoor heat exchanger 42, during normal cycle operation, functions as the evaporator for refrigerant. The indoor heat exchanger 42, during reverse cycle operation, functions as the condenser for refrigerant. The indoor heat exchanger 42 includes a plurality of heat transfer tubes and heat transfer fins (not shown). The indoor heat exchanger 42 is configured such that heat is exchanged between refrigerant in the heat transfer tubes and air (indoor-side air flow (described later)) passing around the heat transfer tubes or the heat transfer fins.

The indoor unit 40 includes an indoor fan 45 for taking in air in the object space, allowing the air to pass through the indoor heat exchanger 42 to exchange heat with refrigerant, and then sending the air to the object space again. The indoor fan 45 is placed in the object space. The indoor fan 45 includes an indoor fan motor (not shown) that is a drive source. The indoor fan 45, while being driven, generates indoor-side air flow as a heating source or cooling source for refrigerant flowing through the indoor heat exchanger 42.

Indoor-side sensors 46 (see FIG. 4) for detecting the status (mainly, pressure or temperature) of refrigerant in the refrigerant circuit RC are disposed in the indoor unit 40. The indoor-side sensors 46 are a pressure sensor and a temperature sensor, such as a thermistor and a thermocouple. Examples of the indoor-side sensors 46 include a temperature sensor that detects the temperature of refrigerant in the indoor heat exchanger 42 and a pressure sensor that detects the pressure of refrigerant in the indoor-side circuit RC2.

The indoor unit 40 includes an indoor unit control unit 48 that controls the operations and statuses of the devices included in the indoor unit 40. The indoor unit control unit 48 includes a microcomputer including a CPU, a memory, and the like. The indoor unit control unit 48 is electrically connected to the devices (41, 45) included in the indoor unit 40 and the indoor-side sensors 46, and inputs or outputs signals to or from each other. The indoor unit control unit 48 is connected to the outdoor unit control unit 30 and the remote control unit 65 via the communication line cb. The indoor unit control unit 48 sends or receives control signals, or the like, to or from the outdoor unit control unit 30 or the remote control unit 65.

a) Liquid-Side Connection Pipe La, Gas-Side Connection Pipe Ga

The liquid-side connection pipe La and the gas-side connection pipe Ga are refrigerant connection pipes that connect the outdoor unit 10 and the indoor units 40, and are installed on site. The pipe length and pipe diameter of each of the liquid-side connection pipe La and the gas-side connection pipe Ga are selected as needed according to design specifications and an installation environment.

The liquid-side connection pipe La (including the branch pipe unit 50) is a pipe that makes up the liquid-side connection circuit RC3 (liquid-side connection circuit RC3*a*) between the outdoor unit 10 and the indoor units 40 and through which, during operation, high-pressure or intermediate-pressure refrigerant flows. The liquid-side connection pipe La is made up of a plurality of pipes, joints, and the like, connected. Specifically, the liquid-side connection pipe La includes a first liquid-side connection pipe L1, a second liquid-side connection pipe L2, a third liquid-side connection pipe L3, and a branch part BP (liquid-side branch part BPa; more specifically, first branch pipe unit 50*a*). The first liquid-side connection pipe L1, the second liquid-side connection pipe L2, and the third liquid-side connection pipe L3 each may be actually made up of a single pipe or may be made up of a plurality of pipes connected via a joint, or the like.

One end of the first liquid-side connection pipe L1 is connected to the liquid-side stop valve 19 of the outdoor unit 10, and the other end of the first liquid-side connection pipe L1 is connected to the liquid-side branch part BPa (first branch pipe unit 50*a*; more specifically, first connection pipe 81 (described later)) The first liquid-side connection pipe L1 is disposed on the outdoor unit 10 side of the second liquid-side connection pipe L2, the third liquid-side connection pipe L3, and the liquid-side branch part BPa (first branch pipe unit 50*a*). The first liquid-side connection pipe L1 communicates with the second liquid-side connection pipe L2 and the third liquid-side connection pipe L3 from the outdoor unit 10 side, and corresponds to the "outdoor-side connection pipe" in the claims.

The second liquid-side connection pipe L2 and the third liquid-side connection pipe L3 are located on the indoor unit 40 side of the liquid-side branch part BPa (first branch pipe unit 50*a*). One end of each of the second liquid-side connection pipe L2 and the third liquid-side connection pipe L3 is connected to an associated one of the indoor units 40, and the other end of each of the second liquid-side connection pipe L2 and the third liquid-side connection pipe L3 is connected to the liquid-side branch part BPa (first branch pipe unit 50*a*; more specifically, second connection pipe 82 (described later)). In one or more embodiments, the second liquid-side connection pipe L2 is associated with the indoor unit 40*a*, and the third liquid-side connection pipe L3 is associated with the indoor unit 40*b*. Each of the second liquid-side connection pipe L2 and the third liquid-side connection pipe L3 communicates with an associated one of the indoor units 40, and corresponds to the "indoor-side connection pipe" in the claims. The second liquid-side connection pipe L2 and the third liquid-side connection pipe L3 are disposed in parallel with each other. The first liquid-side connection pipe L1, the second liquid-side connection pipe L2, and the third liquid-side connection pipe L3 are connected at the liquid-side branch part BPa (first branch pipe unit 50*a*), and communicate with one another.

The gas-side connection pipe Ga is a pipe that makes up a gas-side connection circuit RC3 (gas-side connection circuit RC3*b*) between the outdoor unit 10 and the indoor units 40 and through which, during operation, low-pressure refrigerant flows. The gas-side connection pipe Ga is made up of a plurality of pipes, joints, and the like, connected. The gas-side connection pipe Ga includes a first gas-side connection pipe G1, a second gas-side connection pipe G2, a third gas-side connection pipe G3, and a branch part BP (gas-side branch part BPb; more specifically, second branch pipe unit 50*b*). The first gas-side connection pipe G1, the second gas-side connection pipe G2, and the third gas-side connection pipe G3 each may be actually made up of a single pipe or may be made up of a plurality of pipes connected via a joint, or the like.

The first gas-side connection pipe G1 is disposed on the outdoor unit 10 side of the second gas-side connection pipe G2, the third gas-side connection pipe G3, and the gas-side branch part BPb (second branch pipe unit 50*b*). One end of the first gas-side connection pipe G1 is connected to the gas-side stop valve 20 of the outdoor unit 10, and the other end of the first gas-side connection pipe G1 is connected to the gas-side branch part BPb (second branch pipe unit 50*b*; more specifically, first connection pipe 81). The first gas-side connection pipe G1 communicates with the second gas-side connection pipe G2 and the third gas-side connection pipe G3 from the outdoor unit 10 side, and corresponds to the "outdoor-side connection pipe" in the claims.

The second gas-side connection pipe G2 and the third gas-side connection pipe G3 are located on the indoor unit 40 side of the gas-side branch part BPb (second branch pipe unit 50*b*). One end of each of the second gas-side connection pipe G2 and the third gas-side connection pipe G3 is connected to an associated one of the indoor units 40, and the other end of each of the second gas-side connection pipe G2 and the third gas-side connection pipe G3 is connected to the gas-side branch part BPb (second branch pipe unit 50*b*; more specifically, second connection pipe 82). In one or more embodiments, the second gas-side connection pipe G2 is associated with the indoor unit 40*a*, and the third gas-side connection pipe G3 is associated with the indoor unit 40*b*. Each of the second gas-side connection pipe G2 and the third gas-side connection pipe G3 communicates with an associated one of the indoor units 40, and corresponds to the "indoor-side connection pipe" in the claims. The second gas-side connection pipe G2 and the third gas-side connection pipe G3 are disposed in parallel with each other. The first gas-side connection pipe G1, the second gas-side connection pipe G2, and the third gas-side connection pipe G3 are connected at the gas-side branch part BPb (second branch pipe unit 50*b*), and communicate with one another.

In the following description, one or both of the liquid-side connection pipe La and the gas-side connection pipe Ga are referred to as "refrigerant connection pipe". One or both of the first liquid-side connection pipe L1 and the first gas-side connection pipe G1 are referred to as "outdoor-side connection pipe". Any one or more or all of the second liquid-side connection pipe L2, the third liquid-side connection pipe L3, the second gas-side connection pipe G2, and the third gas-side connection pipe G3 are referred to as "indoor-side connection pipe".

The branch parts BP (the liquid-side branch part BPa and the gas-side branch part BPb) included in the refrigerant connection pipe each is a part that diverges refrigerant flowing from the outdoor unit 10 side (that is, the first liquid-side connection pipe L1 or first gas-side connection pipe G1 side) and a part that merges refrigerant flowing from the indoor unit 40 side (that is, the second liquid-side connection pipe L2 or the third liquid-side connection pipe L3, or the second gas-side connection pipe G2 or the third gas-side connection pipe G3 side).

Each branch part BP (that is, the branch pipe unit 50) includes the first connection pipe 81, the plurality of second connection pipes 82, a branch pipe 83, and a cutoff valve 84. In the branch part BP, the first connection pipe 81 and each second connection pipe 82 are connected and communicate with each other via the branch pipe 83.

The first connection pipe 81 (which corresponds to the "outdoor-side pipe" in the claims) is located on the outdoor unit 10 side of the branch pipe 83. One end of the first connection pipe 81 is connected to the outdoor-side connection pipe, and the other end of the first connection pipe 81 is connected to the branch pipe 83.

Each second connection pipe 82 (which corresponds to the "indoor-side pipe" in the claims) is located on the indoor unit 40 side of the branch pipe 83. Each second connection pipe 82 is associated in a one-to-one correspondence with any one of the indoor-side connection pipes and is connected to the associated indoor-side connection pipe.

One end side of the branch pipe 83 (which corresponds to the "branch portion" in the claims) is connected to the first connection pipe 81, and the other end side of the branch pipe 83 is branched into two and each branch is connected to any one of the second connection pipes 82.

The cutoff valve 84 (which corresponds to the "control valve" in the claims) is a valve that permits the flow of refrigerant in an open state and cuts off the flow of refrigerant in a closed state. The cutoff valve 84 is disposed in the first connection pipe 81. In one or more embodiments, the cutoff valve 84 is a valve that is switched between a closed state and an open state when supplied with a predetermined driving voltage, and is a generally widespread electromagnetic valve. The operation (open or close) of the cutoff valve 84 is directly controlled by an electric component unit 52 and is generally controlled by the controller 70.

In the air-conditioning system 100, each branch part BP is made up of the branch pipe unit 50. Specifically, the liquid-side branch part BPa is made up of the first branch pipe unit 50*a*, and the gas-side branch part BPb is made up of the second branch pipe unit 50*b*. The details of each branch pipe unit 50 will be described later.

a) Refrigerant Leak Sensor 60

Each refrigerant leak sensor 60 is a sensor for detecting refrigerant leakage in an object space in which the indoor unit 40 is placed (more specifically, inside the indoor unit 40). In one or more embodiments, a known general-purpose product is used as the refrigerant leak sensor 60 according to the type of refrigerant filled in the refrigerant circuit RC. The refrigerant leak sensor 60 is placed in the object space. More specifically, the refrigerant leak sensor 60 is associated in a one-to-one correspondence with the indoor unit 40 and is placed inside the associated indoor unit 40.

The refrigerant leak sensor 60 continuously or intermittently outputs an electric signal commensurate with a detected value (refrigerant leak sensor detection signal) to the controller 70. More specifically, the refrigerant leak sensor detection signal that is output from the refrigerant leak sensor 60 changes in voltage according to the concentration of refrigerant that is detected by the refrigerant leak sensor 60. In other words, the refrigerant leak sensor detection signal is output to the controller 70 in a mode in which the concentration of leaked refrigerant in the object space in which the refrigerant leak sensor 60 is placed (more specifically, the concentration of refrigerant, detected by the refrigerant leak sensor 60) can be determined in addition to whether there is refrigerant leakage in the refrigerant circuit RC. In other words, the refrigerant leak sensor 60 corresponds to the "refrigerant leak detecting unit" that detects refrigerant leakage in the indoor-side circuit RC2 by directly detecting refrigerant (more specifically, the concentration of refrigerant) flowing out from the indoor-side circuit RC2.

a) Remote Control Unit 65

Each remote control unit 65 is an input device for a user to input various commands for switching the operational status of the air-conditioning system 100. For example, a command to switch the start or stop, set temperature, or the like, of the indoor unit 40 is input to the remote control unit 65 by a user.

The remote control unit 65 also functions as a display device for displaying various pieces of information to a user. For example, the remote control unit 65 displays the operational status (set temperature, and the like) of the indoor unit 40. For example, the remote control unit 65, in the event of refrigerant leakage, displays information (refrigerant leakage notification information) to inform a person in charge of the fact that refrigerant leakage is occurring, measures to be taken against the leakage, and the like.

The remote control unit 65 is connected to the controller 70 (more specifically, the associated indoor unit control unit 48) via the communication line cb, and sends or receives signals to or from the controller 70. The remote control unit 65 sends a command input by a user to the controller 70 via the communication line cb. The remote control unit 65 displays information in response to an instruction that is received via the communication line cb.

a) Controller 70

The controller 70 is a computer that controls the operation of the air-conditioning system 100 by controlling the statuses of the devices. In one or more embodiments, the controller 70 is made up of the outdoor unit control unit 30 and the indoor unit control unit 48 in each indoor unit 40, connected via the communication line cb. The details of the controller 70 will be described later.

(2) Flow of Refrigerant in Refrigerant Circuit RC

Hereinafter, flow of refrigerant in the refrigerant circuit RC will be described. In the air-conditioning system 100, mainly, the normal cycle operation and the reverse cycle operation take place. Here, a low pressure in the refrigeration cycle is the pressure of refrigerant that is taken into the compressor 11 (suction pressure), and a high pressure in the refrigeration cycle is the pressure of refrigerant that is discharged from the compressor 11 (discharge pressure).

(2-1) Flow of Refrigerant During Normal Cycle Operation

During normal cycle operation (during cooling operation), the four-way valve 13 is controlled to the normal cycle mode, and refrigerant filled in the refrigerant circuit RC mainly circulates in order of the outdoor-side circuit RC1 (the compressor 11, the outdoor heat exchanger 14, the outdoor first electrically-operated valve 16, and the supercooler 15), the liquid-side connection circuit RC3*a* (the first liquid-side connection pipe L1, the liquid-side branch part BPa, the second liquid-side connection pipe L2 and/or the third liquid-side connection pipe L3), the indoor-side circuit RC2 (the indoor expansion valve 41 and the indoor heat exchanger 42) of the indoor unit 40 during operation, the gas-side connection circuit RC3*b* (the first gas-side connection pipe G1, the gas-side branch part BPb, the second gas-side connection pipe G2 and/or the third gas-side connection pipe G3), and the compressor 11. During normal cycle operation, in the outdoor-side circuit RC1, part of refrigerant flowing through the sixth pipe P6 branches into the ninth pipe P9, passes through the outdoor second electrically-operated valve 17 and the supercooler 15 (sub-passage 152), and is returned to the compressor 11.

Specifically, as the normal cycle operation is started, refrigerant is taken into the compressor 11, compressed, and then discharged in the outdoor-side circuit RC1. In the compressor 11, displacement control commensurate with a thermal load that is required of the indoor unit 40 in which operation is performed. Specifically, a target value of suction pressure is set according to a thermal load that is required of the indoor unit 40, and the operation frequency of the compressor 11 is controlled such that the suction pressure becomes the target value. Gas refrigerant discharged from the compressor 11 flows into the outdoor heat exchanger 14.

Gas refrigerant flowing into the outdoor heat exchanger 14 exchanges heat with outdoor-side air flow that is sent by the outdoor fan 25, radiates heat, and condenses in the outdoor heat exchanger 14. Refrigerant flowing out from the outdoor heat exchanger 14 branches in process of flowing through the sixth pipe P6.

One part of refrigerant having branched in process of flowing through the sixth pipe P6 flows into the outdoor first electrically-operated valve 16, undergoes decompression or adjustment of the flow rate according to the opening degree of the outdoor first electrically-operated valve 16, and then flows into the main passage 151 of the supercooler 15. Refrigerant flowing into the main passage 151 of the supercooler 15 exchanges heat with refrigerant flowing through the sub-passage 152 to be further cooled into liquid refrigerant in a supercooled state. Liquid refrigerant flowing out from the main passage 151 of the supercooler 15 flows out from the outdoor-side circuit RC1, passes through the liquid-side connection circuit RC3*a*, and flows into the indoor-side circuit RC2 of the indoor unit 40 in operation.

The other part of refrigerant having branched in process of flowing through the sixth pipe P6 flows into the outdoor second electrically-operated valve 17, undergoes decompression or adjustment of the flow rate according to the opening degree of the outdoor second electrically-operated valve 17, and flows into the sub-passage 152 of the supercooler 15. Refrigerant flowing into the sub-passage 152 of the supercooler 15 exchanges heat with refrigerant flowing through the main passage 151, passes through the eleventh pipe P11, and merges into refrigerant flowing through the first pipe P1.

Refrigerant flowing into the indoor-side circuit RC2 of the indoor unit 40 in operation flows into the indoor expansion valve 41, undergoes decompression to a low pressure in the refrigeration cycle according to the opening degree of the indoor expansion valve 41, and then flows into the indoor heat exchanger 42.

Refrigerant flowing into the indoor heat exchanger 42 exchanges heat with indoor-side air flow that is sent by the indoor fan 45 to evaporate into gas refrigerant and flows out from the indoor heat exchanger 42. Gas refrigerant flowing out from the indoor heat exchanger 42 flows out from the indoor-side circuit RC2.

Refrigerant flowing out from the indoor-side circuit RC2 passes through the gas-side connection circuit RC3*b* and flows into the outdoor unit 10. Refrigerant flowing into the outdoor unit 10 flows through the first pipe P1, passes through the four-way valve 13 and the second pipe P2, and flows into the accumulator 12. Refrigerant flowing into the accumulator 12 is temporarily accumulated and then taken into the compressor 11 again.

(2-2) Flow of Refrigerant During Reverse Cycle Operation

During reverse cycle operation (heating operation, or the like), the four-way valve 13 is controlled to the reverse cycle mode, and refrigerant filled in the refrigerant circuit RC mainly circulates in order of the compressor 11, the gas-side connection circuit RC3*b*, the indoor unit 40 (the indoor heat exchanger 42 and the indoor expansion valve 41) in operation, the liquid-side connection circuit RC3*a*, the supercooler 15, the outdoor first electrically-operated valve 16, the outdoor heat exchanger 14, and the compressor 11.

Specifically, as the reverse cycle operation is started, refrigerant is taken into the compressor 11, compressed, and then discharged in the outdoor-side circuit RC1. In the compressor 11, displacement control commensurate with a thermal load that is required from the indoor unit 40 in which operation is performed. Gas refrigerant discharged from the compressor 11 flows out from the outdoor-side circuit RC1 through the fourth pipe P4 and the first pipe P1, and flows into the indoor-side circuit RC2 of the indoor unit 40 in operation through the gas-side connection circuit RC3*b*.

Refrigerant flowing into the indoor-side circuit RC2 flows into the indoor heat exchanger 42, and exchanges heat with indoor-side air flow that is sent by the indoor fan 45 to condense. Refrigerant flowing out from the indoor heat exchanger 42 flows into the indoor expansion valve 41, undergoes decompression to a low pressure in the refrigeration cycle according to the opening degree of the indoor expansion valve 41, and then flows out from the indoor-side circuit RC2.

Refrigerant flowing out from the indoor-side circuit RC2 flows into the outdoor-side circuit RC1 through the liquid-side connection circuit RC3*a*. Refrigerant flowing into the outdoor-side circuit RC1 passes through the eighth pipe P8, the supercooler 15 (main passage 151), the seventh pipe P7, the outdoor first electrically-operated valve 16, and the sixth pipe P6 and flows into the liquid-side outlet/inlet port of the outdoor heat exchanger 14.

Refrigerant flowing into the outdoor heat exchanger 14 exchanges heat with outdoor-side air flow that is sent by the outdoor fan 25 to evaporate in the outdoor heat exchanger 14. Refrigerant flowing out from the gas-side outlet/inlet port of the outdoor heat exchanger 14 passes through the fifth pipe P5, the four-way valve 13, and the second pipe P2 and flows into the accumulator 12. Refrigerant flowing into the accumulator 12 is temporarily accumulated and then taken into the compressor 11 again.

(3) Details of Branch Pipe Unit 50

Each branch pipe unit 50 is a unit for making up the branch part BP (which corresponds to the "first part" in the claims) in the connection circuit RC3. The branch pipe unit 50 is also a unit for making up an interrupting unit that, when refrigerant leakage has occurred in the refrigerant circuit RC (particularly, the indoor-side circuit RC2), interrupts the flow of refrigerant between the outdoor-side circuit RC1 and the indoor-side circuit RC2 (mainly, the flow of refrigerant from the outdoor-side circuit RC1 side toward the indoor-side circuit RC2 side).

The first branch pipe unit 50*a* that is disposed in the liquid-side connection circuit RC3*a* and the second branch pipe unit 50*b* that is disposed in the gas-side connection circuit RC3*b* are disposed in the refrigerant circuit RC as the branch pipe units 50.

The first branch pipe unit 50*a* is included in the liquid-side connection pipe La. When the first branch pipe unit 50*a* is interpreted as an element independent of the liquid-side connection pipe La, the first branch pipe unit 50*a* can be interpreted as making up the liquid-side connection circuit RC3*a* together with the liquid-side connection pipe La. The first branch pipe unit 50*a* is disposed between the first liquid-side connection pipe L1 and each of the second liquid-side connection pipe L2 and the third liquid-side connection pipe L3, and connects both. In other words, the first branch pipe unit 50*a* connects the first liquid-side connection pipe L1 that is disposed on the outdoor unit 10 side and the second liquid-side connection pipe L2 and the third liquid-side connection pipe L3 that are disposed on the indoor units 40 side. The first branch pipe unit 50*a* makes up the branch part BP (liquid-side branch part BPa) in the liquid-side connection circuit RC3*a*. The first branch pipe unit 50*a* forms a refrigerant passage common to both refrigerant flowing from the outdoor unit 10 side to the indoor units 40 side through the first liquid-side connection pipe L1, the second liquid-side connection pipe L2, and the third liquid-side connection pipe L3 and refrigerant flowing from the indoor units 40 to the outdoor unit 10 through the second liquid-side connection pipe L2, the third liquid-side connection pipe L3, and the first liquid-side connection pipe L1.

The second branch pipe unit 50*b* is included in the gas-side connection pipe Ga. When the second branch pipe unit 50*b* is interpreted as an element independent of the gas-side connection pipe Ga, the second branch pipe unit 50*b* can be interpreted as making up the gas-side connection circuit RC3*b* together with the gas-side connection pipe Ga. The second branch pipe unit 50*b* is disposed between the first gas-side connection pipe G1 and each of the second gas-side connection pipe G2 and the third gas-side connection pipe G3, and connects both. In other words, the second branch pipe unit 50*b* connects the first gas-side connection pipe G1 that is disposed on the outdoor unit 10 side and the second gas-side connection pipe G2 and the third gas-side connection pipe G3 that are disposed on the indoor units 40 side. The second branch pipe unit 50*b* makes up the branch part BP (gas-side branch part BPb) in the gas-side connection circuit RC3*b*. The second branch pipe unit 50*b* forms a refrigerant passage common to both refrigerant flowing from the outdoor unit 10 side to the indoor units 40 side through the first gas-side connection pipe G1, the second gas-side connection pipe G2, and the third gas-side connection pipe G3 and refrigerant flowing from the indoor units 40 to the outdoor unit 10 through the second gas-side connection pipe G2, the third gas-side connection pipe G3, and the first gas-side connection pipe G1.

Hereinafter, the detailed configuration of each branch pipe unit 50 will be described. In the following description, it is assumed that a "joining method" appropriate for an installation environment and design specifications is selected as needed for "joining" of portions. The "joining method" is not limited, but, for example, brazing connection, flaring connection, flange connection, or the like, may be included. Unless otherwise specified, the following description is common to the first branch pipe unit 50*a* and the second branch pipe unit 50*b*.

Figure 2:
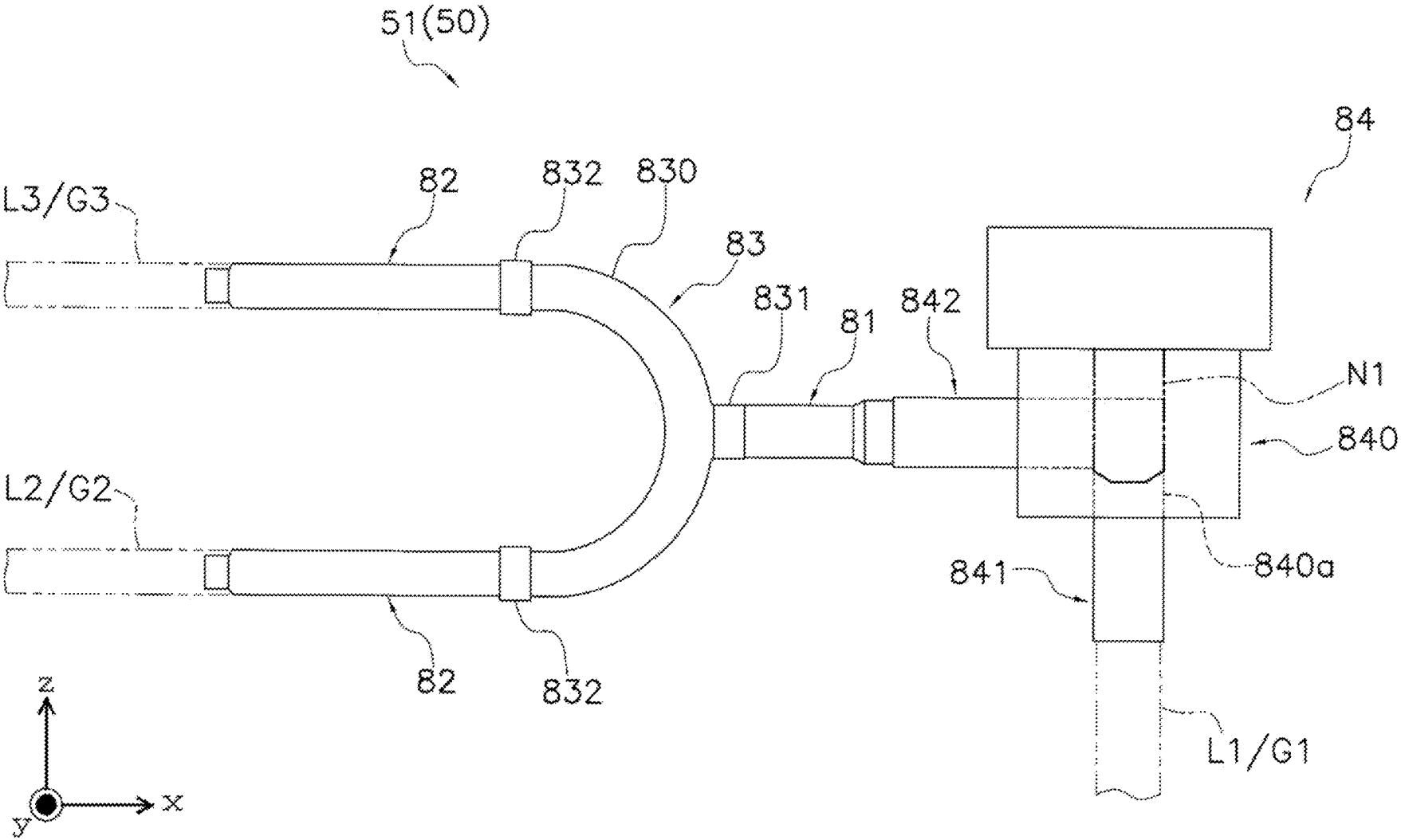
FIG. 2 is a schematic configuration diagram of a main unit in a branch pipe unit.
Figure 3:
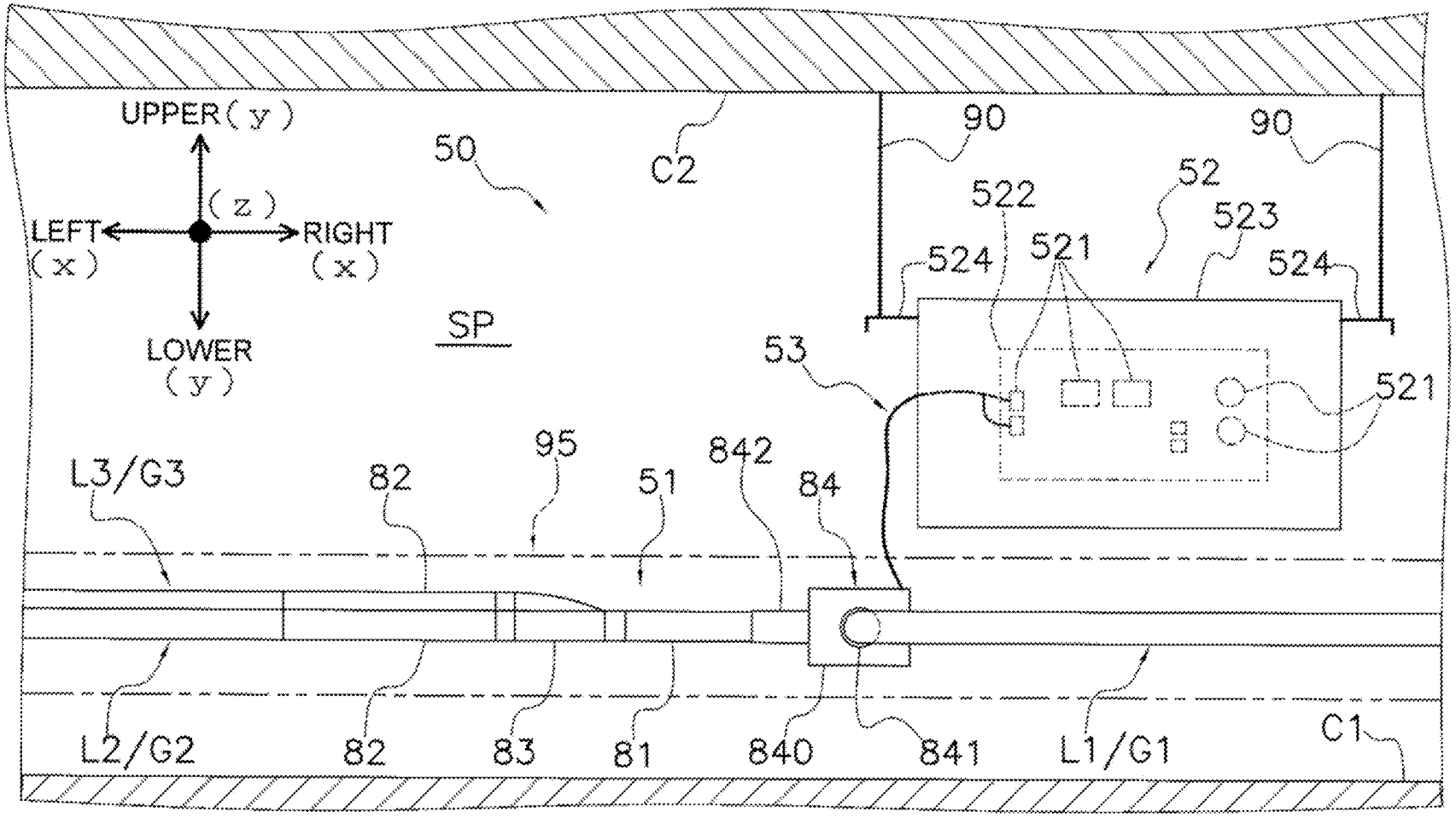
FIG. 3 is a schematic view that shows an example of an installation mode of the branch pipe unit.

FIG. 2 is a schematic configuration diagram of a main unit 51. FIG. 3 is a schematic view that shows an example of an installation mode of the branch pipe unit 50. The branch pipe unit 50 mainly includes the main unit 51, the electric component unit 52, and a wire 53.

(3-1) Main Unit 51

The main unit 51 (which corresponds to the "first component" in the claims) is a part that, of the branch pipe unit 50, makes up the connection circuit RC3 and forms a passage for refrigerant (branch part BP). The main unit 51 is carried into an installation site in a state of being preassembled at a factory, or the like, and is connected to other pipes. The main unit 51 includes the above-described first connection pipe 81, plurality of (here, two) second connection pipes 82, branch pipe 83, and cutoff valve 84. The first connection pipe 81, the second connection pipes 82, the branch pipe 83, and the cutoff valve 84 are combined together in the main unit 51.

(3-1-1) First Connection Pipe 81

The first connection pipe 81 is a tubular part extending along a predetermined extending direction (x direction in FIG. 3). The first connection pipe 81 communicates with the outdoor-side connection pipe and forms a passage for refrigerant. One end (outdoor-side connection pipe-side end portion) of the first connection pipe 81 is joined with the cutoff valve 84, and the other end (indoor-side connection pipe-side end portion) is joined with the branch pipe 83.

The first connection pipe 81 forms a refrigerant passage common to both refrigerant flowing from the outdoor unit 10 side to the indoor units 40 side through the second connection pipes 82 and refrigerant flowing from the indoor units 40 to the outdoor unit 10 through the second connection pipes 82 in the connection circuit RC3.

In one or more embodiments, the first connection pipe 81, as well as the outdoor-side connection pipe, is made of copper. The cross-sectional area and length of the first connection pipe 81 are selected as needed according to design specifications (for example, the diameter of the outdoor-side connection pipe to be connected, or the like) and an installation environment.

(3-1-2) Second Connection Pipe 82

Each second connection pipe 82 is a tubular part extending substantially parallel to the other second connection pipe 82. The "substantially parallel" here not only includes the case where the second connection pipes 82 are perfectly parallel to each other but also the case where the extending directions of the second connection pipes 82 are slightly different (for example, within 30 degrees in a horizontal direction or vertical direction). Similar interpretation applies to the other part in the specification.

Each second connection pipe 82 is associated in a one-to-one correspondence with any one of the indoor-side connection pipes, communicates with the associated indoor-side connection pipe, and forms a refrigerant passage. A longitudinal direction (extending direction) of each second connection pipe 82 extends along substantially the same direction as a longitudinal direction (extending direction) of the first connection pipe 81 away from the first connection pipe 81. The "substantially the same" here includes not only the case where the longitudinal direction of each second connection pipe 82 and the longitudinal direction of the first connection pipe 81 perfectly match each other but also the case where the directions are slightly different (for example, within 30 degrees in the horizontal direction or the vertical direction). Similar interpretation applies to the other part in the specification.

One end (outdoor-side connection pipe-side end portion) of each second connection pipe 82 is joined with the branch pipe 83 and the other end of each second connection pipe 82 is joined with the associated indoor-side connection pipe. In one or more embodiments, the second connection pipes 82, as well as the associated indoor-side connection pipes, are made of copper. The cross-sectional area and length of each second connection pipe 82 are selected individually according to design specifications (for example, the diameter of each indoor-side connection pipe to be connected, or the like) and an installation environment.

(3-1-3) Branch Pipe 83

The branch pipe 83 (which corresponds to the "branch portion" in the claims) is located between the first connection pipe 81 and each second connection pipe 82 and connects both. The branch pipe 83 individually communicates the first connection pipe 81 with the associated second connection pipes 82. The branch pipe 83 corresponds to a branch point at which refrigerant flowing from the first connection pipe 81 side is branched and sent to the second connection pipes 82 or a merging point at which refrigerant flowing from the each second connection pipe 82 side is merged and sent to the first connection pipe 81.

A branch pipe body portion 830, a first insert portion 831 with which the first connection pipe 81 is joined, and a plurality (number commensurate with the number of the second connection pipes 82) of second insert portions 832 with which the associated second connection pipes 82 are joined are provided in the branch pipe 83.

The branch pipe body portion 830 is a substantially U-shaped (bifurcated) tubular part. The first insert portion 831 extends from a part between both ends of the branch pipe body portion 830 along the extending direction of the first connection pipe 81 and has a communication port that communicates with the first connection pipe 81. The second insert portion 832 extends from one end or the other end of the branch pipe body portion 830 along the extending direction of an associated one of the second connection pipes 82 and has a communication port that communicates with the associated second connection pipe 82.

In one or more embodiments, the branch pipe 83, as well as the first connection pipe 81 and the second connection pipe 82 to be connected, is made of copper. The cross-sectional area and length of the branch pipe 83 (the main part, the first insert portion 831, and the second insert portions 832) are selected individually according to design specifications (for example, the diameter of each indoor-side connection pipe to be connected, or the like) and an installation environment.

(3-1-4) Cutoff Valve 84

The cutoff valve 84 (which corresponds to the "control valve" in the claims) is located between the first connection pipe 81 and the outdoor-side connection pipe, and switches the flow of refrigerant. The cutoff valve 84 is connected to the outdoor-side connection pipe-side end portion of the first connection pipe 81. From another viewpoint, the cutoff valve 84 is disposed in the first connection pipe 81.

The cutoff valve 84 mainly includes a valve body portion 840, a first pipe connection portion 841, and a second pipe connection portion 842.

The valve body portion 840 (which corresponds to the "valve body" in the claims) is the body portion of the cutoff valve 84, and includes a valve body, a coil, and the like. A refrigerant passage 840*a* that communicates the first pipe connection portion 841 with the second pipe connection portion 842 is formed inside the valve body portion 840. When the energization status is switched, the valve body closes the refrigerant passage 840*a*, with the result that the valve body portion 840 is placed in a closed state. FIG. 2 schematically shows the position of the valve body N1 in a closed state. As shown in FIG. 2, in the cutoff valve 84, the valve body N1 extends along a z direction (the same direction as the extending direction of the first pipe connection portion 841). In one or more embodiments, the cutoff valve 84 has a substantially L-shaped appearance, and the refrigerant passage 840*a* formed inside also has a substantially L-shape.

The first pipe connection portion 841 (which corresponds to the "first end portion" in the claims) is a tubular portion extending from a side portion of the valve body portion 840 along a predetermined extending direction (z direction in FIG. 2). The first pipe connection portion 841 communicates with one end of the refrigerant passage 840*a* in the valve body portion 840. One end of the first pipe connection portion 841 is joined with the side portion of the valve body portion 840. The other end of the first pipe connection portion 841 is joined with the outdoor-side connection pipe in an installation state.

The second pipe connection portion 842 (which corresponds to the "second end portion" in the claims) is a tubular portion extending from a bottom portion of the valve body portion 840 along a predetermined extending direction (x direction in FIG. 2). As described above, the cutoff valve 84 has a substantially L-shaped appearance, and the refrigerant passage 840*a* formed inside also has a substantially L-shape. In relation to this, the extending direction (longitudinal direction) of the second pipe connection portion 842 and the extending direction (longitudinal direction) of the first pipe connection portion 841 are different and are intersecting directions. More specifically, the extending direction of the second pipe connection portion 842 and the extending direction of the first pipe connection portion 841 are different by substantially 90 degrees. In this respect, during normal cycle operation, refrigerant flows from the first pipe connection portion 841 to the second pipe connection portion 842; however, the valve body N1 extends along the same direction as the first pipe connection portion 841, so reduction of noise in the case where the cutoff valve 84 has been controlled into a closed state is facilitated.

The "substantially 90 degrees" here not only includes the case where the extending direction of the second pipe connection portion 842 and the extending direction of the first pipe connection portion 841 are perfectly different by 90 degrees but also the case where the extending directions are different within plus or minus a predetermined range (for example, within 30 degrees) around 90 degrees.

The second pipe connection portion 842 communicates with the other end of the refrigerant passage 840*a* in the valve body portion 840. One end of the second pipe connection portion 842 is joined with the bottom portion of the valve body portion 840. The other end of the second pipe connection portion 842 is joined with the other end (outdoor-side connection pipe-side end portion) of the first connection pipe 81. More specifically, the second pipe connection portion 842 is connected to the other end of the first connection pipe 81 in an installation state in position that enables that the second connection pipes 82 are arranged along the horizontal direction and the longitudinal direction of each second connection pipe 82 extends along the horizontal direction.

(3-2) Electric Component Unit 52 (Which Corresponds to "Second Component" in Claims)

The electric component unit 52 (see FIG. 3) is provided independently of the main unit 51 to enhance workability with enabled free movement relative to the main unit 51 on an installation site. The electric component unit 52 is fixed to brackets 90 (see FIG. 3) on an installation site.

The electric component unit 52 includes electric components 521 for controlling the status (open or close) of the cutoff valve 84 (for example, switching portions that are able to switch the flow of current, such as an electromagnetic relay and a switching element, connection terminals to which power is supplied, an input portion to which a signal from the controller 70 is input, and the like). The electric component unit 52 includes a board 522 for implementing the electric components 521.

The electric component unit 52 also includes a unit casing 523 that accommodates the electric components 521, the board 522, and the like. The unit casing 523 (which corresponds to the "casing" in the claims) is, for example, a casing made of synthetic resin and has such a volumetric capacity that the electric components 521, the board 522, and the like, can be accommodated. The unit casing 523 is provided with fixing portions 524 for fixing the brackets 90. Since it is assumed that the unit casing 523 is installed in a narrow space, the height is set so as to be less than the height of an installation site (generally, a ceiling space).

(3-3) Wire 53

The wire 53 (see FIG. 3) is a conductor for supplying a driving voltage to the cutoff valve 84. The wire 53 electrically connects the cutoff valve 84 and the board 522 (electric components 521). The wire 53 is a general-purpose product and is covered with an electrical insulator.

The wire 53 is configured to have a dimension greater than or equal to 1 m to enhance flexibility in placement of the electric component unit 52 in an installation site. In one or more embodiments, the longitudinal dimension of the wire 53 is 1.2 m.

(3-4) Mode of Installation of Branch Pipe Unit 50

FIG. 3 shows a manner in which the branch pipe unit 50 is installed in a ceiling space SP (a space above a ceiling, that is, an object space). In FIG. 3, the upper, lower, right, and left directions are indicated, a right-left direction corresponds to the x direction in FIG. 2, and an up-down direction corresponds to a y direction in FIG. 2. The right-left direction is included in the horizontal direction, and the up-down direction is included in the vertical direction. In FIG. 3, a front-rear direction perpendicular to the right-left direction corresponds to the z direction in FIG. 2 and is included in the horizontal direction.

The branch pipe unit 50 is installed in the ceiling space SP together with the refrigerant connection pipe. The ceiling space SP is a narrow space formed between a top surface (ceiling space bottom surface C1) of the ceiling in the object space and a roof or floor upstairs (ceiling space top surface C2). Specifically, the ceiling space SP is a space of which the dimension in the horizontal direction is large and the dimension in the vertical direction is small In one or more embodiments, the main unit 51 is placed in such a position that the second connection pipes 82 are arranged in the horizontal direction (here, the z direction that intersects with the extending direction x) and the extending direction of each second connection pipe 82 and the extending direction of the first connection pipe 81 match each other (here, both extends away from each other but the extending directions of both are the horizontal direction). In relation to this, in the ceiling space SP, the major extending direction (here, the right-left direction, that is, the horizontal direction) of each indoor-side connection pipe and the major extending direction (here, the right-left direction, that is, the horizontal direction) of the outdoor-side connection pipe are substantially the same. In other words, in the ceiling space SP of which the distance in the vertical direction is short, the main unit 51 is placed in such a position that the major extending direction (here, the right-left direction, that is, the horizontal direction) of each indoor-side connection pipe and the major extending direction (here, the right-left direction, that is, the horizontal direction) of the outdoor-side connection pipe are substantially the same.

This is feasible by the mode of connection between the first pipe connection portion 841 and second pipe connection portion 842 of the cutoff valve 84 and the first connection pipe 81 and each second connection pipe 82 (in an installation state, the second pipe connection portion 842 is connected to the other end of the first connection pipe 81 in such a position that the second connection pipes 82 are arranged along the horizontal direction and the longitudinal directions of the first connection pipe 81 and second connection pipes 82 are allowed to extend along the horizontal direction, that is, a position that the first pipe connection portion 841 of the cutoff valve 84 extends in the front-rear direction and the second pipe connection portion 842 extends in the right-left direction).

The outdoor-side connection pipe extends along the major extending direction (x direction in FIG. 3) of each indoor-side connection pipe, then bends toward the direction of the first pipe connection portion 841 (z direction) of the cutoff valve 84 before the connection portion with the main unit 51 (the first pipe connection portion 841 of the cutoff valve 84), and is joined with the main unit 51.

The portions (the first connection pipe 81, the second connection pipes 82, the branch pipe 83, and the cutoff valve 84) of the main unit 51 are covered with a heat insulating material 95 for preventing condensation.

The electric component unit 52 is installed apart from the main unit 51. More specifically, the electric component unit 52 is installed away from the main unit 51 within the range of the length of the wire 53 that electrically connects the main unit 51 and the electric component unit 52. In one or more embodiments, the electric component unit 52 is hung from the top in the ceiling space SP by attaching the brackets 90, fixed to the ceiling space top surface C2, to the electric component unit 52.

The electric component unit 52 extends between the cutoff valve 84 of the main unit 51 and the board 522 (electric component 521) of the electric component unit 52 and electrically connects both. The wire 53 is connected to one of the cutoff valve 84 and the main unit 51 before installation, and is connected to the other on site.

(4) Details of Controller 70

Figure 4:
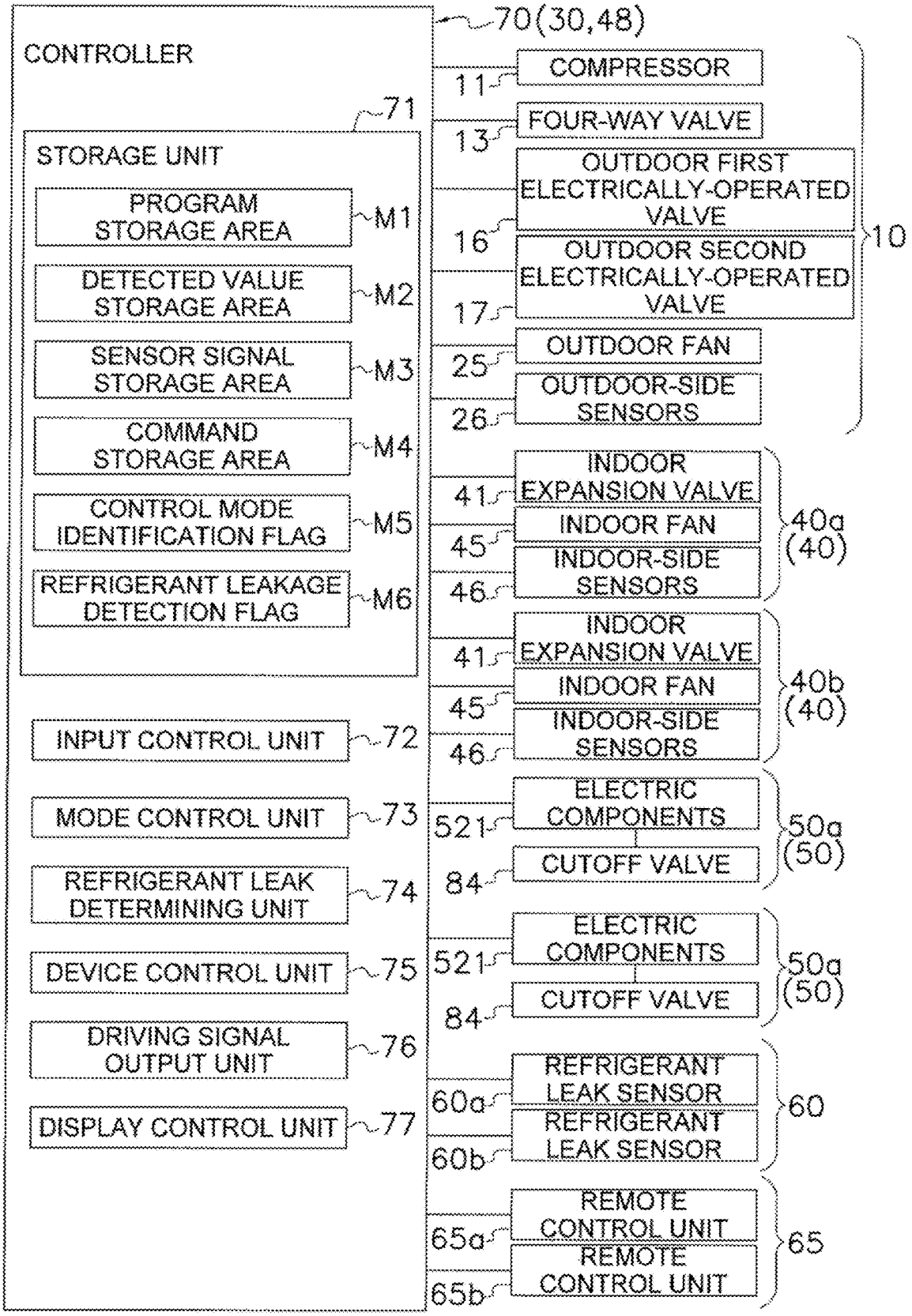
FIG. 4 is a block diagram that schematically shows a controller and components connected to the controller.

In the air-conditioning system 100, the outdoor unit control unit 30 and the indoor unit control units 48 are connected by the communication line cb to make up the controller 70. FIG. 4 is a block diagram that schematically shows the controller 70 and devices connected to the controller 70.

The controller 70 has a plurality of control modes, and controls the operations of devices according to a set control mode. In one or more embodiments, the controller 70 has a normal operation mode into which the controller 70 changes during operation (when there is no refrigerant leakage) and a refrigerant leakage mode when refrigerant leakage has occurred (more specifically, refrigerant leakage has been detected) as the control modes.

The controller 70 is electrically connected to the devices included in the air-conditioning system 100 (specifically, the compressor 11, the outdoor first electrically-operated valve 16, the outdoor second electrically-operated valve 17, the outdoor fan 25, and the outdoor-side sensors 26, included in the outdoor unit 10, the indoor expansion valve 41, the indoor fan 45, and the indoor-side sensors 46, included in each indoor unit 40, the electric components 521 (cutoff valves 84) of the branch pipe units 50, the refrigerant leak sensors 60, the remote control units 65, and the like).

The controller 70 mainly includes a storage unit 71, an input control unit 72, a mode control unit 73, a refrigerant leak determining unit 74, a device control unit 75, a driving signal output unit 76, and a display control unit 77. These functional units in the controller 70 are implemented by the CPU, memory, and various electric and electronic components, included in each of the outdoor unit control unit 30 and/or each indoor unit control unit 48, functioning together.

(4-1) Storage Unit 71

The storage unit 71 is made up of, for example, a ROM, a RAM, a flash memory, and the like, and has a volatile storage area and a nonvolatile storage area. A program storage area M1 in which a control program that defines processes in the units of the controller 70 is stored is included in the storage unit 71.

A detected value storage area M2 for storing detected values of various sensors is included in the storage unit 71. For example, detected values (such as suction pressure, discharge pressure, discharge temperature, refrigerant temperature in the outdoor heat exchanger 14, and refrigerant temperature in each indoor heat exchanger 42) of the outdoor-side sensors 26 and indoor-side sensors 46 are stored in the detected value storage area M2.

A sensor signal storage area M3 for storing a refrigerant leak sensor detection signal that is sent from each refrigerant leak sensor 60 (detected value of each refrigerant leak sensor 60) is included in the storage unit 71. The sensor signal storage area M3 has storage areas according to the number of the refrigerant leak sensors 60. A received refrigerant leak sensor detection signal is stored in an area associated with the source refrigerant leak sensor 60. A refrigerant leak signal that is stored in the sensor signal storage area M3 is updated each time a refrigerant leak signal output from the refrigerant leak sensor 60 is received.

A command storage area M4 for storing a command input to the remote control units 65 is included in the storage unit 71.

A plurality of flags each having a predetermined number of bits is provided in the storage unit 71. For example, a control mode identification flag M5 with which the controller 70 is able to identify a set control mode is provided in the storage unit 71. The control mode identification flag M5 has a number of bits commensurate with the number of control modes. A bit associated with a set control mode is set in the control mode identification flag M5.

A refrigerant leakage detection flag M6 for determining that refrigerant leakage has been detected in the object spaced is provided in the storage unit 71. More specifically, the refrigerant leakage detection flag M6 has a number of bits commensurate with the number of indoor units 40 installed, and a bit associated with the indoor unit 40 (refrigerant leak unit) in which it is assumed that refrigerant leakage has occurred is set. In other words, the refrigerant leakage detection flag M6 is configured such that, when refrigerant leakage has occurred in the indoor-side circuit RC2, which indoor unit 40 (indoor-side circuit RC2) in which refrigerant leakage has occurred can be determined. The refrigerant leakage detection flag M6 is switched by the refrigerant leak determining unit 74.

(4-2) Input Control Unit 72

The input control unit 72 is a functional unit that plays a role as an interface for receiving signals that are output from the devices connected to the controller 70. For example, the input control unit 72, upon receiving each of signals output from the sensors (26, 46, 60) and the remote control units 65, stores the signal in an associated storage region of the storage unit 71 or sets a predetermined flag.

(4-3) Mode Control Unit 73

The mode control unit 73 is a functional unit that switches the control mode. The mode control unit 73, during normal times (when the refrigerant leakage detection flag M6 is not set), switches the control mode into the normal operation mode. The mode control unit 73, when the refrigerant leakage detection flag M6 is set, switches the control mode into the refrigerant leakage mode. The mode control unit 73 sets the control mode identification flag M5 according to the set control mode.

(4-4) Refrigerant Leak Determining Unit 74

The refrigerant leak determining unit 74 is a functional unit that determines whether refrigerant leakage is occurring in the refrigerant circuit RC (indoor-side circuits RC2). Specifically, the refrigerant leak determining unit 74, when a predetermined refrigerant leakage detection condition is satisfied, determines that refrigerant leakage is occurring in the refrigerant circuit RC (indoor-side circuits RC2) and sets the refrigerant leakage detection flag M6.

In one or more embodiments, whether the refrigerant leakage detection condition is satisfied is determined based on the refrigerant leak sensor detection signal in the sensor signal storage area M3. Specifically, the refrigerant leakage detection condition is satisfied when the duration of the state where a voltage value of any one of the refrigerant leak sensor detection signals (detected value of any one of the refrigerant leak sensors 60) is higher than or equal to a predetermined first reference value is longer than or equal to a predetermined time t1. The first reference value is a value (a density of refrigerant) at which refrigerant leakage in any one of the indoor-side circuits RC2 is assumed. The predetermined time t1 is set to a time by which it can be determined that a refrigerant leak sensor detection signal is not instantaneous. The refrigerant leak determining unit 74 identifies a refrigerant leak unit (the indoor unit 40 in which it is assumed that refrigerant leakage has occurred) based on the source refrigerant leak sensor 60 of the refrigerant leak sensor detection signal that satisfies the refrigerant leakage detection condition, and sets a bit associated with the refrigerant leak unit in the refrigerant leakage detection flag M6. In other words, the refrigerant leak determining unit 74 in combination with each refrigerant leak sensor 60 corresponds to the "refrigerant leak detecting unit" that individually detects refrigerant leakage in each indoor-side circuit RC2.

The predetermined time t1 is set as needed according to the type of refrigerant enclosed in the refrigerant circuit RC, the specifications of the devices, an installation environment, or the like, and are defined in the control program. The refrigerant leak determining unit 74 is configured to be able to measure the predetermined time t1.

The first reference value is set as needed according to the type of refrigerant enclosed in the refrigerant circuit RC, design specifications, an installation environment, and the like, and are defined in the control program.

(4-5) Device Control Unit 75

The device control unit 75 controls the operations of the devices (for example, 11, 13, 16, 17, 25, 41, 45, 84, and the like) included in the air-conditioning system 100 depending on a situation in accordance with the control program. The device control unit 75 identifies the set control mode by referencing the control mode identification flag M5, and controls the operations of the devices based on the identified control mode.

For example, the device control unit 75, during normal operation mode, controls in real time the operating capacity of the compressor 11, the number of rotations of the outdoor fan 25 and indoor fans 45, the opening degree of the outdoor first electrically-operated valve 16, the opening degrees of the indoor expansion valves 41, and the like, such that normal cycle operation or reverse cycle operation takes place according to a set temperature, detected values of the sensors, and the like.

The device control unit 75, during normal cycle operation, controls the four-way valve 13 into the normal cycle mode to cause the outdoor heat exchanger 14 to function as a condenser (or radiator) for refrigerant and cause the indoor heat exchanger 42 of the indoor unit 40 in operation to function as an evaporator for refrigerant. The device control unit 75, during reverse cycle operation, controls the four-way valve 13 into the reverse cycle mode to cause the outdoor heat exchanger 14 to function as an evaporator for refrigerant and cause the indoor heat exchanger 42 of the indoor unit 40 in operation to function as a condenser (or radiator) for refrigerant.

The device control unit 75 executes the following various control depending on a situation. The device control unit 75 is configured to be able to measure time.

<Refrigerant Leakage First Control>

The device control unit 75 executes refrigerant leakage first control when it is assumed that refrigerant leakage has occurred in the object space (Specifically, when the refrigerant leakage detection flag M6 has been set). The device control unit 75, in the refrigerant leakage first control, controls the indoor expansion valve 41 of the refrigerant leak unit (the indoor unit 40 in which refrigerant leakage has occurred) into a closed state. With this configuration, the flow of refrigerant into the refrigerant leak unit is reduced, so further refrigerant leakage is reduced. In other words, the refrigerant leakage first control is control for reducing refrigerant leakage in the indoor-side circuit RC2 at the time when refrigerant leakage has occurred, and the indoor expansion valve 41, when refrigerant leakage has occurred, is placed in a closed state to block the flow of refrigerant into the indoor unit 40.

<Refrigerant Leakage Second Control>

The device control unit 75, when it is assumed that refrigerant leakage has occurred in the object space, executes refrigerant leakage second control. The device control unit 75, in the refrigerant leakage second control, causes the indoor fan 45 of each indoor unit 40 at the number of rotations (air volume) for refrigerant leakage second control. The refrigerant leakage second control is control to cause the indoor fan 45 to operate at a predetermined number of rotations to prevent local occurrence of a region where the concentration of leaked refrigerant is high in the object space.

Although the number of rotations of the indoor fan 45 in the refrigerant leakage second control is not limited, the number of rotations is set to the maximum number of rotations (that is, the maximum air volume) in one or more embodiments. Through the refrigerant leakage second control, even when refrigerant leakage has occurred in the object space, leaked refrigerant is agitated in the object space by use-side air flow that is generated by the indoor fan 45, so occurrence of a region where the concentration of leaked refrigerant is a hazardous value in the object space is reduced.

<Refrigerant Leakage Third Control>

The device control unit 75, when it is assumed that refrigerant leakage has occurred in the object space, executes refrigerant leakage third control. The device control unit 75, in the refrigerant leakage third control, controls the cutoff valve 84 of each branch part BP (branch pipe unit 50) into a closed state to isolate the outdoor-side circuit RC1 from each of the indoor-side circuit RC2. In other words, the refrigerant leakage third control is control to, when refrigerant leakage has occurred, interrupt refrigerant flowing from the outdoor-side circuit RC1 to the indoor-side circuit RC2 of the leak unit at the liquid-side connection circuit RC3*a* and the gas-side connection circuit RC3*b*.

Specifically, the device control unit 75, in the refrigerant leakage third control, controls the cutoff valve 84 of the liquid-side branch part BPa (first branch pipe unit 50*a*) into a closed state via the electric component 521 to close the liquid-side connection circuit RC3*a*. The device control unit 75, in the refrigerant leakage third control, controls the cutoff valve 84 of the gas-side branch part BPb (second branch pipe unit 50*b*) into a closed state via the electric components 521 to close the gas-side connection circuit RC3*b*. With this configuration, the flow of refrigerant from the outdoor-side circuit RC1 to the indoor-side circuit RC2 is interrupted at the connection circuit RC3, so the amount of leaked refrigerant in the indoor-side circuit RC2 is reliably reduced.

(4-6) Driving Signal Output Unit 76

The driving signal output unit 76 outputs associated driving signals (driving voltages) to the devices (11, 13, 16, 17, 25, 41, 45, 521 (84), and the like) according to control details of the device control unit 75. The driving signal output unit 76 includes a plurality of inverters (not shown), and, to a specific device (for example, the compressor 11, the outdoor fan 25, each indoor fan 45, or the like), outputs a driving signal from an associated one of the inverters.

(4-7) Display Control Unit 77

The display control unit 77 is a functional unit that controls the operation of each remote control unit 65 that serves as a display device. The display control unit 77 causes the remote control unit 65 to output predetermined information to display information about the operational status or situation for a user. For example, the display control unit 77, during operation in the normal mode, causes the remote control unit 65 to display various pieces of information, such as set temperature.

The display control unit 77, when the refrigerant leakage detection flag M6 has been set, causes the remote control unit 65 to display refrigerant leakage notification information. With this configuration, a person in charge is able to learn the fact that refrigerant leakage has occurred, and is able to take predetermined measures.

(5) Flow of Process of Controller 70

Figure 5:
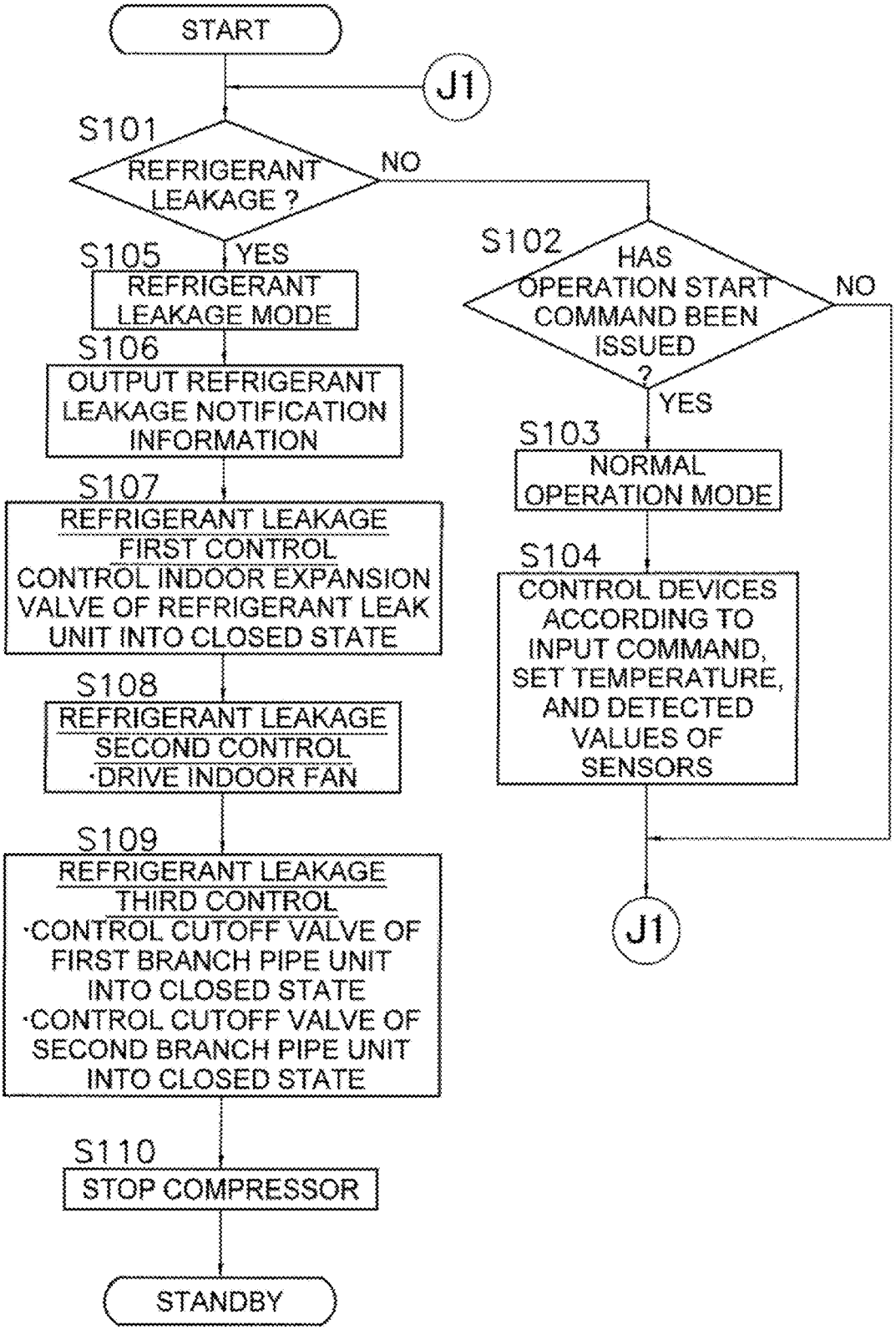
FIG. 5 is a flowchart that shows an example of the flow of a process of the controller.

Hereinafter, an example of the flow of a process of the controller 70 will be described with reference to FIG. 5. FIG. 5 is a flowchart that shows an example of the flow of the process of the controller 70. When the power is turned on, the controller 70 executes the process in accordance with the flow as shown from step S101 to step S110 in FIG. 5. The flow of the process shown in FIG. 5 is one example, and may be modified as needed. For example, the order of steps may be modified without any contradiction, part of steps may be executed in parallel with the other step, or another step may be newly added.

When the controller 70 assumes in step S101 that refrigerant leakage has occurred in the indoor-side circuits RC2 (that is, in the case of YES), the controller 70 proceeds to step S105. When the controller 70 assumes that no refrigerant leakage has occurred in the indoor-side circuits RC2 (that is, in the case of NO), the controller 70 proceeds to step S102.

When the controller 70 has not received an operation start command in step S102 (that is, in the case of NO), the controller 70 returns to step S101. On the other hand, when the controller 70 has received an operation start command (that is, in the case of YES), the controller 70 proceeds to step S103.

In step S103, the controller 70 sets the normal operation mode (or maintains the normal operation mode). After that, the controller 70 proceeds to step S104.

In step S104, the controller 70 performs normal cycle operation by controlling in real time the statuses of the devices according to the input command, set temperature, detected values of the sensors 26, 46, and the like. Although not shown in the drawing, the controller 70 causes the remote control unit 65 to display various pieces of information, such as set temperature. After that, the controller 70 returns to step S101.

In step S105, the controller 70 sets the refrigerant leakage mode. After that, the controller 70 proceeds to step S106.

In step S106, the controller 70 causes the remote control unit 65 to output refrigerant leakage notification information. With this configuration, a person in charge can learn that refrigerant leakage is occurring. After that, the controller 70 proceeds to step S107.

In step S107, the controller 70 executes the refrigerant leakage first control. Specifically, the controller 70 controls the indoor expansion valve 41 of the refrigerant leak unit into a closed state. With this configuration, the flow of refrigerant into the indoor-side circuit RC2 of the refrigerant leak unit is blocked, so further refrigerant leakage is reduced. After that, the controller 70 proceeds to step S108.

In step S108, the controller 70 executes the refrigerant leakage second control. Specifically, the controller 70 causes the indoor fan 45 to be driven at a predetermined number of rotations (for example, the maximum number of rotations). With this configuration, in the object space, leaked refrigerant is agitated, and locally hazardous concentration is reduced. After that, the controller 70 proceeds to step S109.

In step S109, the controller 70 executes the refrigerant leakage third control. Specifically, the controller 70 closes the liquid-side connection circuit RC3*a* by controlling the cutoff valve 84 of the liquid-side branch part BPa (first branch pipe unit 50*a*) into a closed state. The device control unit 75, in the refrigerant leakage third control, closes the gas-side connection circuit RC3*b* by controlling the cutoff valve 84 of the gas-side branch part BPb (second branch pipe unit 50*b*) into a closed state. With this configuration, the flow of refrigerant from the outdoor-side circuit RC1 to the indoor-side circuit RC2 of the leak unit is reduced, so the amount of leaked refrigerant is reduced. After that, the controller 70 proceeds to step S110.

In step S110, the controller 70 stops the compressor 11. After that, the controller 70 is on standby until the standby state is cancelled by a person in charge.

(6) Characteristics (6-1)

In the air-conditioning system 100 according to the above-described embodiments, the cutoff valves 84 that block the flow of refrigerant to the plurality of indoor units 40 are disposed in the first connection pipes 81 (outdoor-side pipe), so an increase in the number of the cutoff valves 84 with the number of the indoor units 40 is reduced. In other words, the cutoff valves 84 are respectively disposed on the outdoor unit 10 side of the second connection pipes 82 (indoor-side pipe group) in the branch parts BP, so, at the time of refrigerant leakage, flow of refrigerant from the first connection pipe 81 (outdoor unit 10 side) to the associated second connection pipe 82 (the plurality of indoor units 40) can be blocked. Therefore, the cutoff valves 84 are not required to be disposed for each indoor unit 40 to ensure safety against refrigerant leakage, and an increase in the number of the cutoff valves 84 with the number of the indoor units 40 is reduced.

Although the refrigerant connection pipe (La, Ga) between the outdoor unit 10 and the indoor units 40 is installed in a narrow ceiling space SP, an increase in the number of the cutoff valves 84 to be disposed in the refrigerant connection pipe is reduced, so an increase in working time and effort required for installation is also reduced.

Thus, in relation to improvement in safety against refrigerant leakage, cost reduction and workability improvement are facilitated.

(6-2)

In the air-conditioning system 100 according to the above-described embodiments, the refrigerant connection pipe (La, Ga) includes the gas-side connection pipe Ga through which low-pressure refrigerant flows and the liquid-side connection pipe La through which high-pressure or intermediate-pressure refrigerant flows, and the cutoff valve 84 is disposed in the first connection pipe 81 (outdoor-side pipe) included in the gas-side connection pipe Ga.

In the outdoor unit 10 or each indoor unit 40, the indoor expansion valve 41 (electronic expansion valve) that decompresses refrigerant is usually disposed in the refrigerant passage that communicates with the liquid-side connection pipe La. When refrigerant leakage has occurred, the indoor expansion valve 41 is controlled to a minimum opening degree. Thus, the flow of refrigerant from the outdoor unit 10 into each indoor unit 40 via the liquid-side connection pipe La can be blocked. On the other hand, a control valve such as the indoor expansion valve 41 is not disposed in the refrigerant passage communicating with the gas-side connection pipe Ga in many cases, so, in ensuring safety against refrigerant leakage, it is important to block the flow of refrigerant toward the indoor unit 40 via the gas-side connection pipe Ga.

In the air-conditioning system 100, the cutoff valve 84 is disposed in the first connection pipe 81 included in the gas-side connection pipe Ga, so ensuring safety against refrigerant leakage is facilitated while an increase in the number of the cutoff valves 84 is reduced.

(6-3)

In the air-conditioning system 100 according to the above-described embodiments, the cutoff valve 84 is also disposed in the first connection pipe 81 (outdoor-side pipe) included in the liquid-side connection pipe La. In this way, the cutoff valve 84 is also disposed in the first connection pipe 81 (outdoor-side pipe) included in the liquid-side connection pipe La, so ensuring safety against refrigerant leakage is further facilitated.

(6-4)

In the air-conditioning system 100 according to the above-described embodiments, each indoor unit 40 includes the indoor expansion valve 41, and, when refrigerant leakage has occurred, the indoor expansion valve 41 is placed in a closed state to block the flow of refrigerant into the indoor unit 40. In this way, the indoor expansion valve 41 that blocks the flow of refrigerant by being controlled into a closed state when refrigerant leakage has occurred is disposed in each indoor unit 40, so it is possible to further reliably interrupt the flow of refrigerant from the outdoor unit 10 to each indoor unit 40 in the event of refrigerant leakage.

(6-5)

In the air-conditioning system 100 according to the above-described embodiments, the first connection pipe 81 (outdoor-side pipe) is combined together with the branch pipe 83 (branch portion) and the cutoff valve 84. With this configuration, installation of the cutoff valve 84 becomes easy, so an increase in working time and effort required for installation is reduced. Thus, in relation to improvement in safety against refrigerant leakage, workability improvement is facilitated.

(6-6)

In the air-conditioning system 100 according to the above-described embodiments, the refrigerant connection pipe (La, Ga) includes the branch pipe unit 50, the branch pipe unit 50 is preassembled and connected to another pipe on an installation site. The branch pipe unit 50 includes the combined first connection pipe 81 (outdoor-side pipe), branch pipe 83 (branch portion), and cutoff valve 84.

With this configuration, installation of the cutoff valve 84 becomes particularly easy, so an increase in working time and effort required for installation is further reduced. Thus, in relation to improvement in safety against refrigerant leakage, workability improvement is facilitated.

(6-7)

In the above-described embodiments, each branch pipe unit 50 connects the outdoor-side connection pipe (L1, G1) and the plurality of indoor-side connection pipes (L2, L3, G2, G3), and includes the first connection pipe 81 communicating with the outdoor-side connection pipe, the plurality of second connection pipes 82 each communicating with an associated one of the indoor-side connection pipes, the branch pipe 83 communicating the first connection pipe 81 with the plurality of second connection pipes 82, and the cutoff valve 84 connected to the first connection pipe 81 and configured to block the flow of refrigerant when placed in a closed state. In other words, between the outdoor unit 10 and the indoor units 40, the refrigerant passage (connection circuit RC3) branches off according to the number of the indoor units 40 and the number of the other devices; however, each branch pipe unit 50 is configured such that the cutoff valve 84 can be disposed before branching of the refrigerant passage (on the outdoor unit 10 side of the branch part BP). With this configuration, in blocking the flow of refrigerant into the plurality of indoor units 40, the single cutoff valve 84 can be shared between the plurality of indoor units 40. As a result, even when the cutoff valve 84 is not disposed for each indoor unit 40, the flow of refrigerant from the outdoor unit 10 side to the plurality of indoor units 40 can be blocked in the event of refrigerant leakage. Therefore, the cutoff valve 84 is not required to be disposed for each indoor unit 40 in relation to measures against refrigerant leakage, so an increase in the number of the cutoff valves 84 to be installed in the refrigerant connection pipe (La, Ga) is reduced.

Each branch pipe unit 50 according to the above-described embodiments can be installed in the refrigerant connection pipe (La, Ga) in a state where the first connection pipe 81, the plurality of second connection pipes 82, the branch pipe 83, and the cutoff valve 84 are preassembled, so working time and effort required for installation are reduced as compared to the existing art.

When a unit of cutoff valves 84 in which the plurality of cutoff valves 84 is collected and combined together is formed, it is assumed that the size of the unit itself increases according to the number of the cutoff valves 84; however, downsizing of each branch pipe unit 50 is facilitated due to the fact that an increase in the number of the cutoff valves 84 hardly occurs in forming the unit, so a decrease in workability is reduced even in a narrow space.

Thus, in relation to improvement in safety against refrigerant leakage in the air-conditioning system 100, a decrease in workability can be reduced.

(6-8)

In each branch pipe unit 50 according to the above-described embodiments, the second pipe connection portion 842 of the cutoff valve 84 is connected to the first connection pipe 81 in an installation state such that the second connection pipes 82 are arranged along the horizontal direction and the longitudinal directions of the second connection pipes 82 extend along the horizontal direction. With this configuration, the extending direction of the second connection pipe 82 can be caused to match the major extending direction (horizontal direction) of each of the indoor-side connection pipes (L2, L3, G2, G3) regardless of the shape of the cutoff valve 84, so connection of both pipes is easy. In relation to this, installation is particularly easy even in a narrow space. Thus, workability is particularly good.

(6-9)

In the above-described embodiments, in each branch pipe unit 50, the first connection pipe 81, the plurality of second connection pipes 82, the branch pipe 83, and the cutoff valve 84 are included in the main unit 51 (first component), and the branch pipe unit 50 includes the electric component unit 52 (second component) including the board 522 on or in which the electric components 521 for controlling the status of the cutoff valve 84 are implemented, and the wire 53 connecting the cutoff valve 84 and the board 522, separately from the main unit 51. The electric component unit 52 is provided independently of the main unit 51 so as to be movable relative to the main unit 51 (first component).

With this configuration, at the time of installation, the electric component unit 52 can be installed so as to be movable relative to the main unit 51. Therefore, the flexibility of installation increases on site, so reduction in working time and effort required for installation is facilitated. Since the main unit 51 and the electric component unit 52 are provided independently of each other, downsizing of each of the main unit 51 and the electric component unit 52 is facilitated and, by extension, downsizing of the branch pipe unit 50 as a whole is facilitated. In relation to this, installation is easy even in a narrow space. Thus, workability is particularly good.

(6-10)

In each branch pipe unit 50 according to the above-described embodiments, the electric component unit 52 (second component) includes the unit casing 523 that accommodates the board 522. With this configuration, installation is particularly easy even in a narrow space.

(6-11)

In each branch pipe unit 50 according to the above-described embodiments, the wire 53 has a longitudinal dimension of 1 m or greater. With this configuration, the main unit 51 and the electric component unit 52 can be installed so as to be spaced apart 1 m or longer, so the flexibility of installation on site is further improved.

(7) Modifications

The above-described embodiments may be modified as needed as shown in the following modifications. Each of the modifications may be applied in combination with another modification without any contradiction.

(7-1) First Modification

In the above-described embodiments, the cutoff valve 84 is disposed in each of the liquid-side branch part BPa and the gas-side branch part BPb. In this respect, in obtaining such an advantageous effect that the amount of leaked refrigerant is reduced by further reliably interrupting refrigerant flowing from the outdoor-side circuit RC1 to the indoor-side circuits RC2 in the event of refrigerant leakage, the cutoff valve 84 may be disposed in both the liquid-side branch part BPa and the gas-side branch part BPb. However, the cutoff valve 84 is not necessarily required to be disposed in both the liquid-side branch part BPa and the gas-side branch part BPb and may be disposed in only one of the liquid-side branch part BPa and the gas-side branch part BPb.

Figure 6:
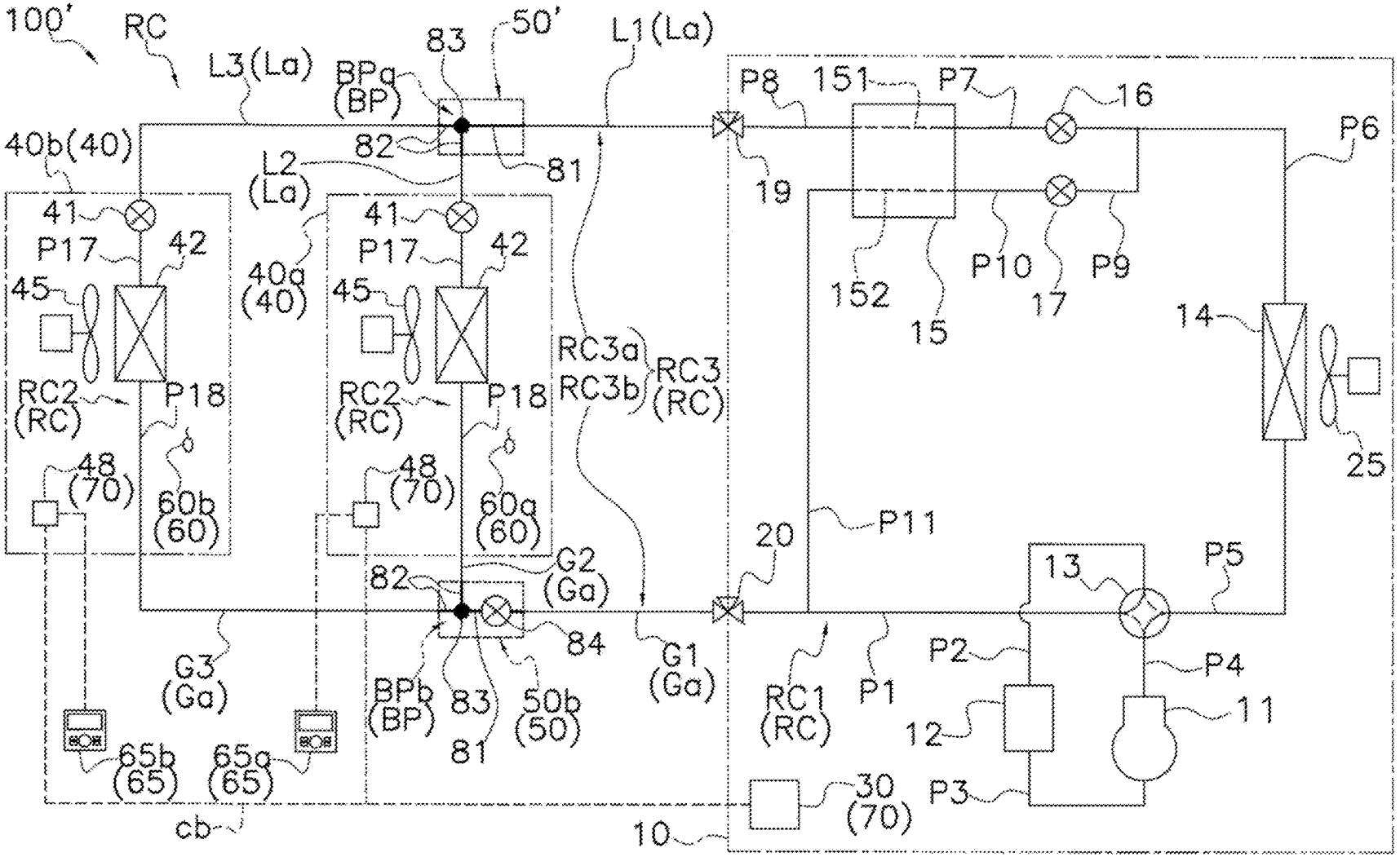
FIG. 6 is a schematic configuration diagram of an air-conditioning system according to a first modification.

For example, when the indoor expansion valve 41 is controlled into a closed state in the event of refrigerant leakage, refrigerant flowing from the outdoor-side circuit RC1 to the indoor-side circuits RC2 via the liquid-side connection circuit RC3*a* can be interrupted, so the cutoff valve 84 disposed in the liquid-side branch part BPa is not necessarily required and may be omitted as needed. In this case, as in the case of an air-conditioning system 100' shown in FIG. 6, the liquid-side branch part BPa may be made up of a branch pipe unit 50' that has no cutoff valve 84.

In addition, for example, when a valve that is able to interrupt the flow of refrigerant from the outdoor-side circuit RC1 to the indoor-side circuit RC2 of the leak unit via the gas-side connection circuit RC3*b* in the event of refrigerant leakage is additionally provided, refrigerant flowing from the outdoor-side circuit RC1 to the indoor-side circuit RC2 via the gas-side connection circuit RC3*b* can be interrupted by controlling the valve into a closed state. Therefore, when such control is performed, the cutoff valve 84 disposed in the gas-side branch part BPb is not necessarily required and may be omitted as needed.

(7-2) Second Modification

In the above-described embodiments, the case where each cutoff valve 84 is an electromagnetic valve that is able to switch between open and closed states is described. However, the cutoff valve 84 is not necessarily limited to the electromagnetic valve and may be another control valve. For example, the cutoff valve 84 may be an electrically-operated valve of which the opening degree is adjustable. In this case, the mode in which the cutoff valve 84 is disposed in the main unit 51 may be similar to that of the above-described embodiments or may be modified as needed.

(7-3) Third Modification

In the above-described embodiments, the case where the branch part BP is made up of the branch pipe unit 50 is described. However, the branch part BP is not necessarily made up of the branch pipe unit 50, and the branch pipe unit 50 may be omitted as needed. In other words, the branch part BP may be made by connecting on site the pipes and the valves (the first connection pipe 81, the second connection pipes 82, the branch pipe 83, and the cutoff valve 84) to be carried to an installation site independently. In this case as well, the operation, advantageous effects, and the like, described in the above (6-1) can be achieved.

(7-4) Fourth Modification

In the above-described embodiments, the case where the refrigerant passage is branched into two at the branch part BP is described. However, the number of branches at the branch part BP is not limited and may be modified as needed. For example, the refrigerant passage may be branched into three or more at the branch part BP. In this case, in the branch part BP, the second connection pipes 82 commensurate with the number of branches should be disposed, and ports commensurate with the number of the second connection pipes 82 should be formed in the branch pipe 83.

(7-5) Fifth Modification

The configurations of the refrigerant circuit RC in the above-described embodiments are not necessarily limited to the configuration shown in FIG. 1 and may be modified as needed according to design specifications or an installation environment. For example, the outdoor first electrically-operated valve 16 is not necessarily required and may be omitted as needed. For example, the supercooler 15 or the outdoor second electrically-operated valve 17 is not necessarily required and may be omitted as needed. A new device not shown in FIG. 1 may be added to the refrigerant circuit RC.

(7-6) Sixth Modification

In the above-described embodiments, the controller 70 that controls the operation of the air-conditioning system 100 is made up of the outdoor unit control unit 30 and the indoor unit control unit 48 of each indoor unit 40, connected via the communication line cb. However, the configuration of the controller 70 is not necessarily limited thereto and may be modified as needed according to design specifications or an installation environment. In other words, the configuration of the controller 70 is not specifically limited, part or all of the elements included in the controller 70 are not necessarily required to be disposed in any one of the outdoor unit 10 and the indoor units 40 and may be disposed in another apparatus or may be disposed independently.

For example, in addition to or instead of one or both of the outdoor unit control unit 30 and each indoor unit control unit 48, the controller 70 may be made up of another device, such as the remote control unit 65 and a centralized control device. In this case, another device may be disposed in a remote place connected to the outdoor unit 10 or the indoor units 40 via a communication network.

Alternatively, for example, the controller 70 may be made up of only the outdoor unit control unit 30.

(7-7) Seventh Modification

In the above-described embodiments, R32 is used as a refrigerant that circulates through the refrigerant circuit RC. Alternatively, refrigerant that is used in the refrigerant circuit RC is not limited and may be another refrigerant. For example, in the refrigerant circuit RC, HFC-series refrigerant, such as R407C and R410A, CO2, ammonia, or the like, may be used.

(7-8) Eighth Modification

In the above-described embodiments, ideas according to the present disclosure are applied to the air-conditioning system 100. However, not limited thereto, the ideas according to the present disclosure may also be applied to another refrigeration apparatus (for example, a water heater, a heat pump chiller, or the like) having a refrigerant circuit.

(7-9) Ninth Modification

In the above-described embodiments, the example in which the ideas according to the present disclosure are applied to the air-conditioning system 100 in which the two indoor units 40 are connected to the single outdoor unit 10 in parallel by the connection pipes (Ga, La) is described. However, the configuration of the air-conditioning system to which the ideas according to the present disclosure are applied is not necessarily limited to the above configuration. In other words, with regard to the air-conditioning system to which the ideas according to the present disclosure are applied, the number of the outdoor units 10 and/or the number of the indoor units 40 and the mode of connection of the outdoor units 10 and the indoor units 40 may be modified as needed according to an installation environment or design specifications.

For example, in the air-conditioning system to which the ideas according to the present disclosure are applied, a plurality of the outdoor units 10 may be disposed in series or in parallel. Alternatively, three or more of the indoor units 40 may be connected to the single outdoor unit 10.

Figure 7:
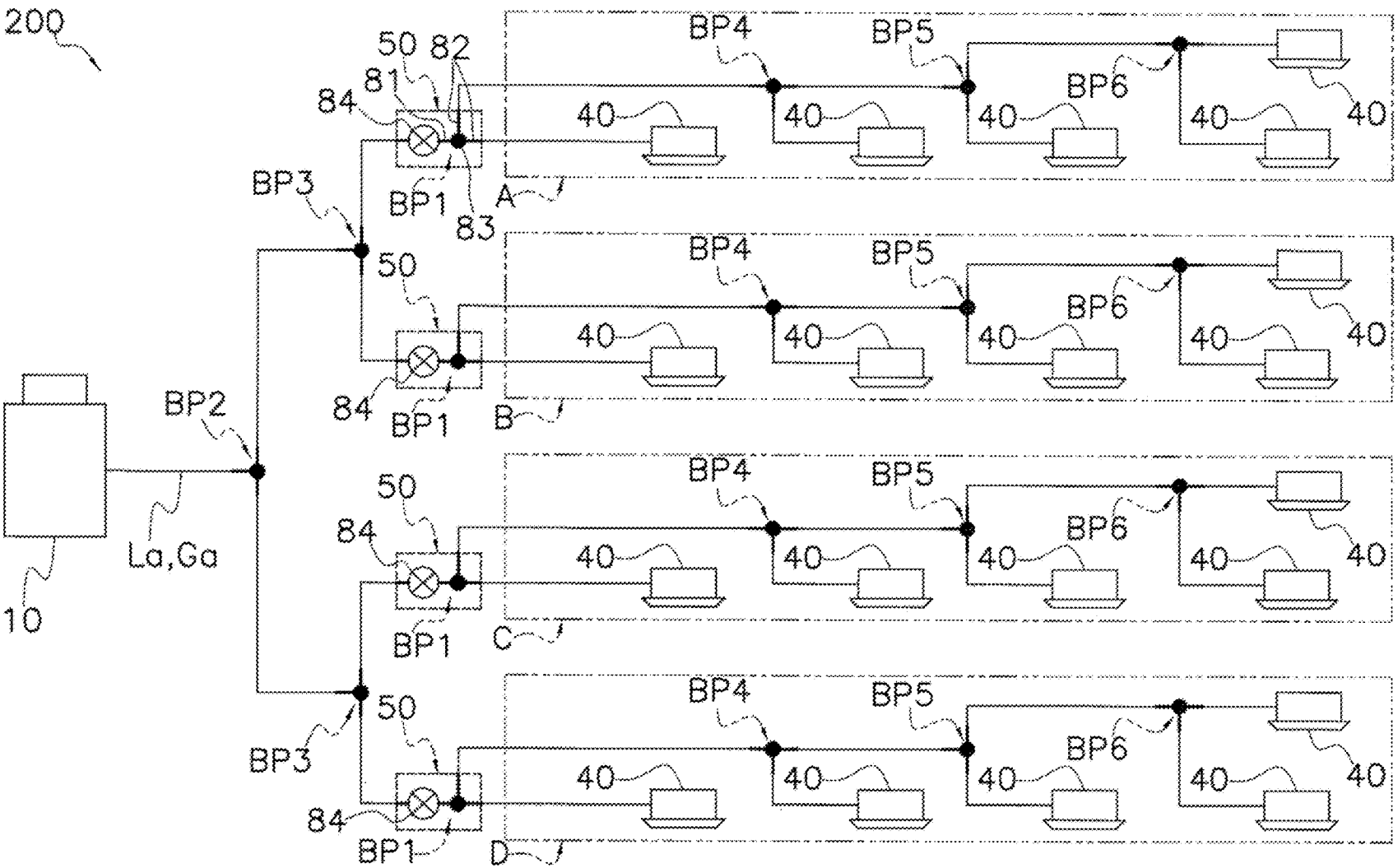
FIG. 7 is a schematic configuration diagram of an air-conditioning system according to a ninth modification.

For example, the ideas according to the present disclosure may be applied to an air-conditioning system in which, as in the case of an air-conditioning system 200 shown in FIG. 7, the three or more indoor units 40 are connected to the single outdoor unit 10 and each indoor unit 40 is disposed in series or in parallel with another indoor unit 40.

FIG. 7 is a schematic configuration diagram of the air-conditioning system 200. In FIG. 7, for the sake of simple illustration, the liquid-side connection pipe La and the gas-side connection pipe Ga are shown as one.

In the air-conditioning system 200, each connection pipe (La, Ga) that extends between the outdoor unit 10 and the indoor units 40 branches into multiple lines (here, roughly four), and therefore the indoor units 40 disposed in the branched lines form a plurality of (four) groups (A to D). In the air-conditioning system 200, each of the groups A to D includes some numbers of the indoor units 40.

In FIG. 7, the cutoff valve 84 is disposed at a branch part BP1 located at a leading end side (most outdoor unit 10 side) of each of the groups A to D. With this configuration, when refrigerant leakage has occurred in any one of the groups A to D, the cutoff valve 84 is controlled into a closed state at the branch part BP1 associated with the group in which refrigerant leakage has occurred to reduce the amount of leaked refrigerant. In other words, the refrigerant passage (connection circuit RC3) branches off according to the number of the indoor units 40 or the number of other devices between the outdoor unit 10 and the indoor units 40, and, in the air-conditioning system 200, the cutoff valve 84 can be disposed before branching of the refrigerant passage (on the outdoor unit 10 side of the branch part BP), and, in interrupting the flow of refrigerant to the plurality of indoor units 40, the single cutoff valve 84 can be shared among the plurality of indoor units 40. As a result, even when the cutoff valve 84 is not disposed for each indoor unit 40, the flow of refrigerant from the outdoor unit 10 side to the plurality of indoor units 40 can be interrupted in the event of refrigerant leakage. Therefore, the cutoff valve 84 is not required to be disposed for each indoor unit 40 in relation to measures against refrigerant leakage, so an increase in the number of the cutoff valves 84 is reduced. The advantageous effect can be particularly expected when the number of the indoor units 40 is large as in the case of the air-conditioning system 200. Thus, in relation to improvement in safety against refrigerant leakage in the air-conditioning system 200, a decrease in workability can be particularly reduced.

In the air-conditioning system 200, since the number of the indoor units 40 is large, manhour remarkably increases when the cutoff valves 84 and the branch pipes are joined with each other on site at the time of installation; however, the branch pipe unit 50 including the cutoff valve 84 is installed on site, so working time and effort required for installation are particularly reduced.

In the air-conditioning system 200, since the cutoff valve 84 is disposed for each group, when refrigerant leakage has occurred, only the group in which refrigerant leakage has occurred can be interrupted, and the operations of the groups in which refrigerant leakage has not occurred can be continued.

In the air-conditioning system 200, no cutoff valve 84 is disposed at any of a branch part BP2 closest to the outdoor unit 10, a branch part BP3 between the branch part BP2 and the branch part BP1, and branch parts BP4 to BP6 in each group. In other words, in the air-conditioning system 200, the branch part BP2 and the branch parts BP3 each are made up of a branch pipe unit having no cutoff valve 84.

In the refrigerant circuit RC, the position (branch part BP) at which the cutoff valve 84 is disposed may be changed as needed. Specifically, the cutoff valve 84 should be disposed at a portion (for example, any one of the branch parts BP1 to BP6 shown in FIG. 7) at which refrigerant needs to be interrupted in ensuring safety based on the amount of refrigerant that is assumed to leak at the time when refrigerant leakage has occurred. For example, the position (branch part BP) at which the cutoff valve 84 is disposed may be determined based on the total number of the indoor units 40 that need to be interrupted by the cutoff valve 84, the total volumetric capacity of the indoor units 40, or the total volumetric capacity of the indoor-side connection pipes in ensuring safety in the event of refrigerant leakage. Alternatively, the cutoff valve 84 may be disposed for each device in which the amount of refrigerant filled corresponds to these.

In other words, the cutoff valve 84 may be connected to any one or two or all of the following first connection pipes 81 (outdoor-side pipes) (a), (b), and (c).

(a): The first connection pipe 81 disposed between the outdoor unit 10 and the plurality of indoor units 40 of which the total volumetric capacity is less than or equal to a first threshold ΔTh1

(b): The first connection pipe 81 disposed between the outdoor unit 10 and the plurality of indoor units 40 of which the total number is less than or equal to a second threshold ΔTh2

(c): The first connection pipe 81 communicating with the indoor-side connection pipes of which the total volumetric capacity is less than or equal to a third threshold ΔTh3

In this case, the first threshold ΔTh1, the second threshold ΔTh2, and/or the third threshold ΔTh3 should be set based on the size of any one of object spaces in each of which the indoor unit 40 is installed and of which air is conditioned (for example, the narrowest object space) in consideration of the possibility that the concentration of leaked refrigerant becomes a hazardous value (lower flammability limit concentration or oxygen deficient limit concentration) in the object space when refrigerant leakage has occurred.

For example, the first threshold ΔTh1, the second threshold ΔTh2, and/or the third threshold ΔTh3 may be set such that the cutoff valve 84 is disposed within the range in which the following condition 1 is satisfied for the amount of refrigerant m (kg), the lower flammability limit concentration of refrigerant G (kg/m3), the floor area of the object space A (m2), and leakage level hr (m). Here, the amount of refrigerant m is the amount of refrigerant that can be filled in a device to be isolated from the outdoor unit 10 by the cutoff valve 84 to ensure safety in the object space in the event of refrigerant leakage. The leakage level hr is the level of a part from which leaked refrigerant is assumed to flow out in the object space.

$$(1) m \leq G/4 \cdot A \cdot hr \quad \text{(Condition 1)}$$

When the disposed position of the cutoff valve 84 is determined in this mode, the cutoff valve 84 can be adequately disposed at a part at which refrigerant is required to be interrupted from the viewpoint of safety (for example, lower flammability limit concentration, oxygen deficient limit concentration, or the like) at the time when refrigerant leakage has occurred according to the scale of a facility or environment in which the air-conditioning system is installed. Thus, an increase in the number of the cutoff valves 84 is reduced, and ensuring safety against refrigerant leakage is further facilitated.

(7-10) Tenth Modification

In the above-described embodiments, the main unit 51 of the branch pipe unit 50 is configured in the mode as shown in FIG. 2; however, the main unit 51 is not necessarily limited to the mode and may be modified as needed. In other words, as for the portions included in the main unit 51, as long as there is no contradiction in achieving the operation and advantageous effects of the ideas according to the present disclosure, the mode of configuration, such as shape, dimension, and position, may be modified according to an installation environment or design specifications, or the portions may be omitted as needed.

Figure 8:
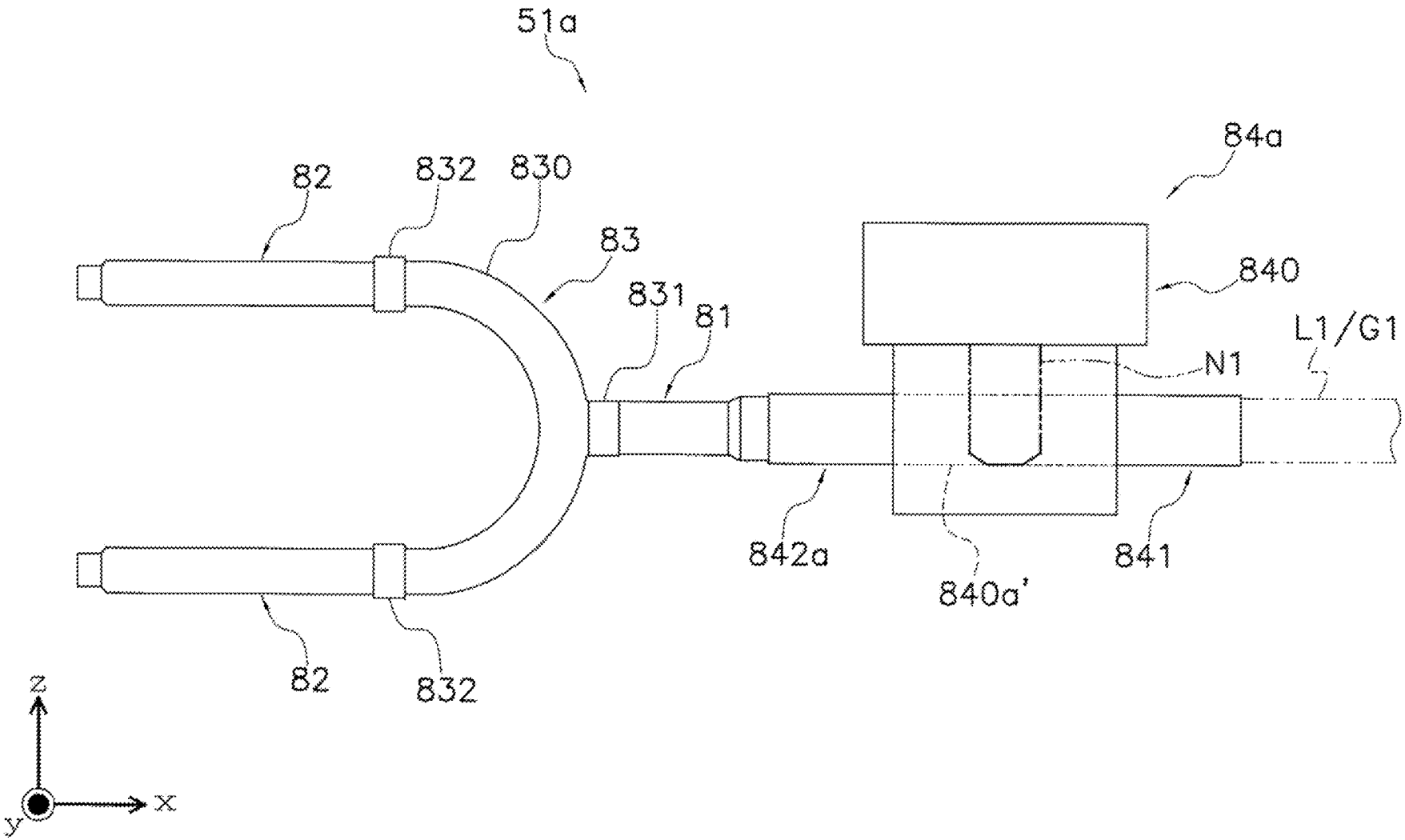
FIG. 8 is a schematic configuration diagram of a main unit according to a tenth modification.

For example, the main unit 51 may be configured as in the case of a main unit 51*a* shown in FIG. 8. Hereinafter, portions of the main unit 51*a*, different from the main unit 51, will be described.

FIG. 8 is a schematic configuration diagram of the main unit 51*a*. The main unit 51*a* includes a cutoff valve 84*a* instead of the cutoff valve 84. The cutoff valve 84*a* differs from the cutoff valve 84*a* in the following points.

The cutoff valve 84*a* includes a second pipe connection portion 842*a* instead of the second pipe connection portion 842. The second pipe connection portion 842*a* (which corresponds to the "second end portion" in the claims) is a tubular portion extending from the side portion of the valve body portion 840 along a predetermined extending direction (the x direction in FIG. 6). In the present embodiments, the cutoff valve 84*a* has a substantially T-shape and forms a substantially I-shaped refrigerant passage 840*a*' inside. In relation to this, in the cutoff valve 84*a*, the second pipe connection portion 842*a* extends away from the first pipe connection portion 841. In other words, the extending direction (longitudinal direction) of the second pipe connection portion 842*a* and the extending direction (longitudinal direction) of the first pipe connection portion 841 are the same direction (x direction), but both extend away from each other. The extending direction of the first pipe connection portion 841 is a direction that intersects with the extending direction of the valve body N1.

The second pipe connection portion 842*a* communicates with an end portion of the refrigerant passage 840*a*' in the valve body portion 840. One end of the second pipe connection portion 842*a* is joined with the side portion of the valve body portion 840. The other end of the second pipe connection portion 842*a* is joined with an end portion of the first connection pipe 81 (outdoor-side connection pipe-side end portion). More specifically, the second pipe connection portion 842*a* is connected to the first connection pipe 81 in such a position that, in an installation state, the second connection pipes 82 can be arranged along the horizontal direction and the longitudinal direction of each second connection pipe 82 can extend along the horizontal direction.

Figure 9:
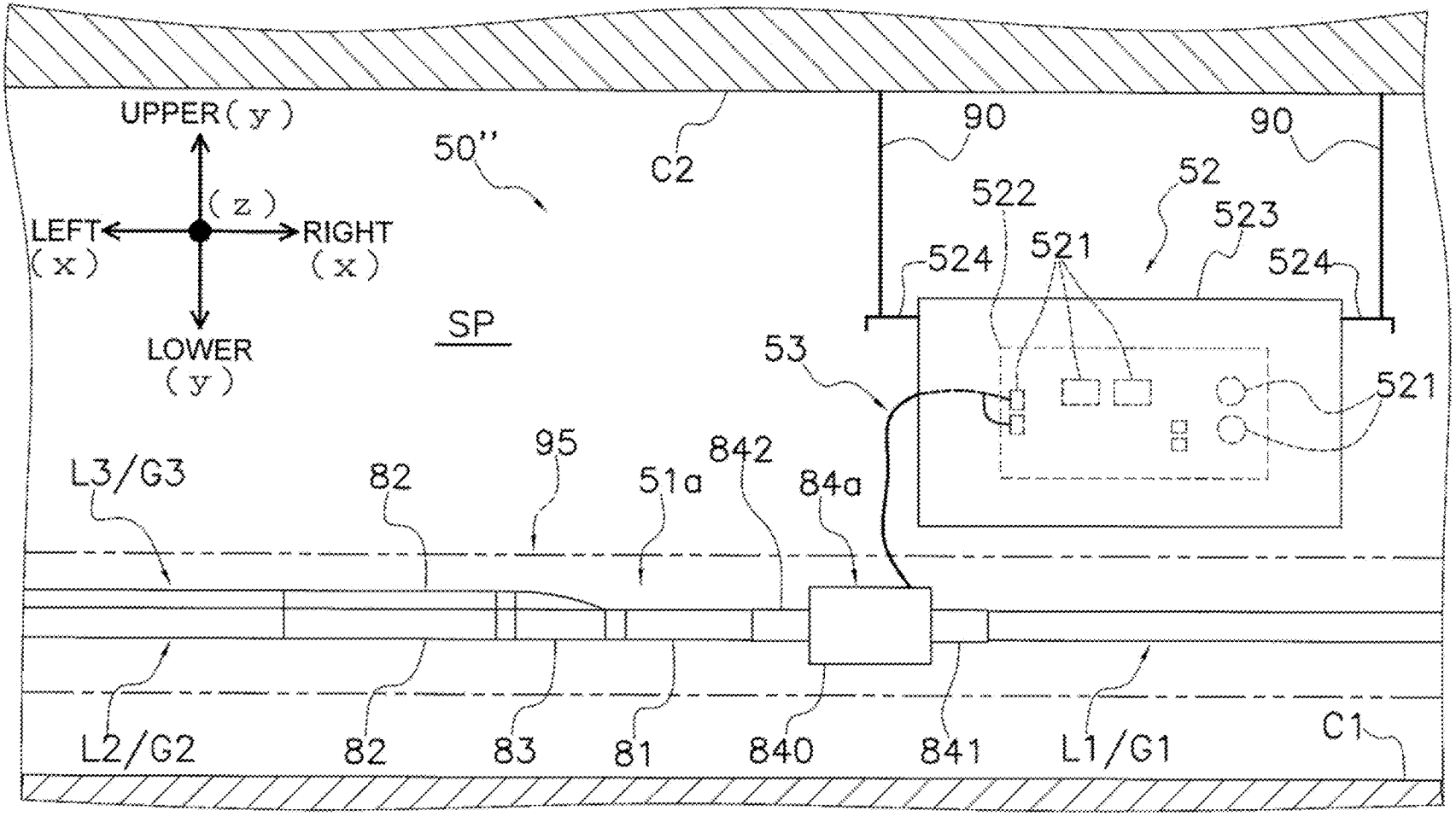
FIG. 9 is a schematic diagram that shows an example of an installation mode of a branch pipe unit including the main unit according to the tenth modification.

The thus configured main unit 51*a* may be disposed in, for example, the mode as shown in FIG. 9. FIG. 9 is a schematic diagram that shows an example of an installation mode of a branch pipe unit 50" including the main unit 51*a*. Hereinafter, in FIG. 9, different from the installation mode of FIG. 3, the first pipe connection portion 841 of the cutoff valve 84*a* is installed so as to extend not in the front-rear direction (z direction) but in the right-left direction (x direction). In relation to this, in the ceiling space SP, the major extending direction (here, the right-left direction, that is, the horizontal direction) of each indoor-side connection pipe and the major extending direction (here, the right-left direction, that is, the horizontal direction) of the outdoor-side connection pipe are substantially the same. In other words, in the ceiling space SP of which the distance in the vertical direction is short, the main unit 51*a* is placed in such a position that the major extending direction (here, the right-left direction, that is, the horizontal direction) of each indoor-side connection pipe and the major extending direction (here, the right-left direction, that is, the horizontal direction) of the outdoor-side connection pipe are substantially the same.

The branch pipe unit 50" including the thus configured main unit 51*a* can also achieve the operation and advantageous effects similar to those of the above-described embodiments.

(7-11) Eleventh Modification

Figure 10:
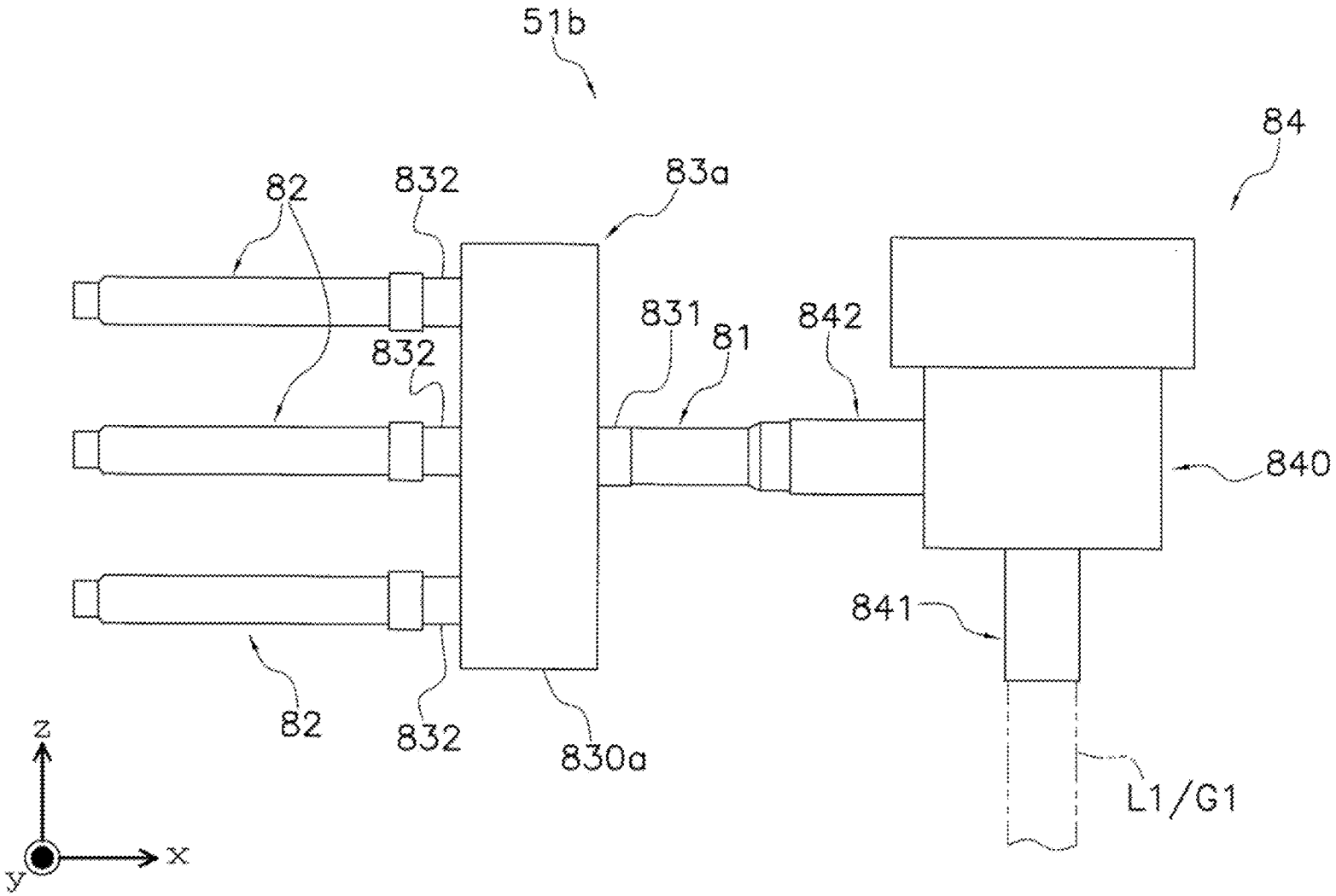
FIG. 10 is a schematic configuration diagram of a main unit according to an eleventh modification.

For example, the main unit 51 may be configured as in the case of a main unit 51*b* shown in FIG. 10. Hereinafter, portions of the main unit 51*b*, different from the main unit 51, will be described.

FIG. 10 is a schematic configuration diagram of the main unit 51*b*. The main unit 51*b* includes a branch pipe 83*a* instead of the branch pipe 83. The main unit 51*b* includes three second connection pipes 82.

The branch pipe 83*a* differs from the branch pipe 83 in the following points. The branch pipe 83*a* includes a branch pipe body portion 830*a* instead of the branch pipe body portion 830. The branch pipe body portion 830*a* is a substantially I-shaped header pipe. The first insert portion 831 extends from a part between both ends of the branch pipe body portion 830*a* along the extending direction (the x direction in FIG. 9) of the first connection pipe 81. Each of the second insert portion 832 is disposed at a part between both ends of the branch pipe body portion 830*a* and across from the disposed position of the first connection pipe 81 so as to be arranged along the z direction at spaces from the other second insert portions 832. Each second insert portion 832 extends along the extending direction of the first insert portion 831 away from the first insert portion 831 and is disposed substantially parallel to the other second insert portions 832.

Even when the branch pipe unit 50 includes the thus configured main unit 51*b*, the branch pipe unit 50 is able to achieve the operation and advantageous effects similar to the above-described embodiments. In the main unit 51*b*, the distance between the second insert portions 832 can be reduced as compared to the main unit 51, so, even when the number of the second insert portions 832 increases, the main unit 51*b* can be downsized, and, in relation to this, improvement in workability can be expected.

(7-12) Twelfth Modification

In the main unit 51, the first connection pipe 81 may be omitted as needed. In this case, the main unit 51 may has a configuration such as a main unit 51*c* shown in FIG. 11. Hereinafter, portions of the main unit 51*c*, different from the main unit 51, will be described.

Figure 11:
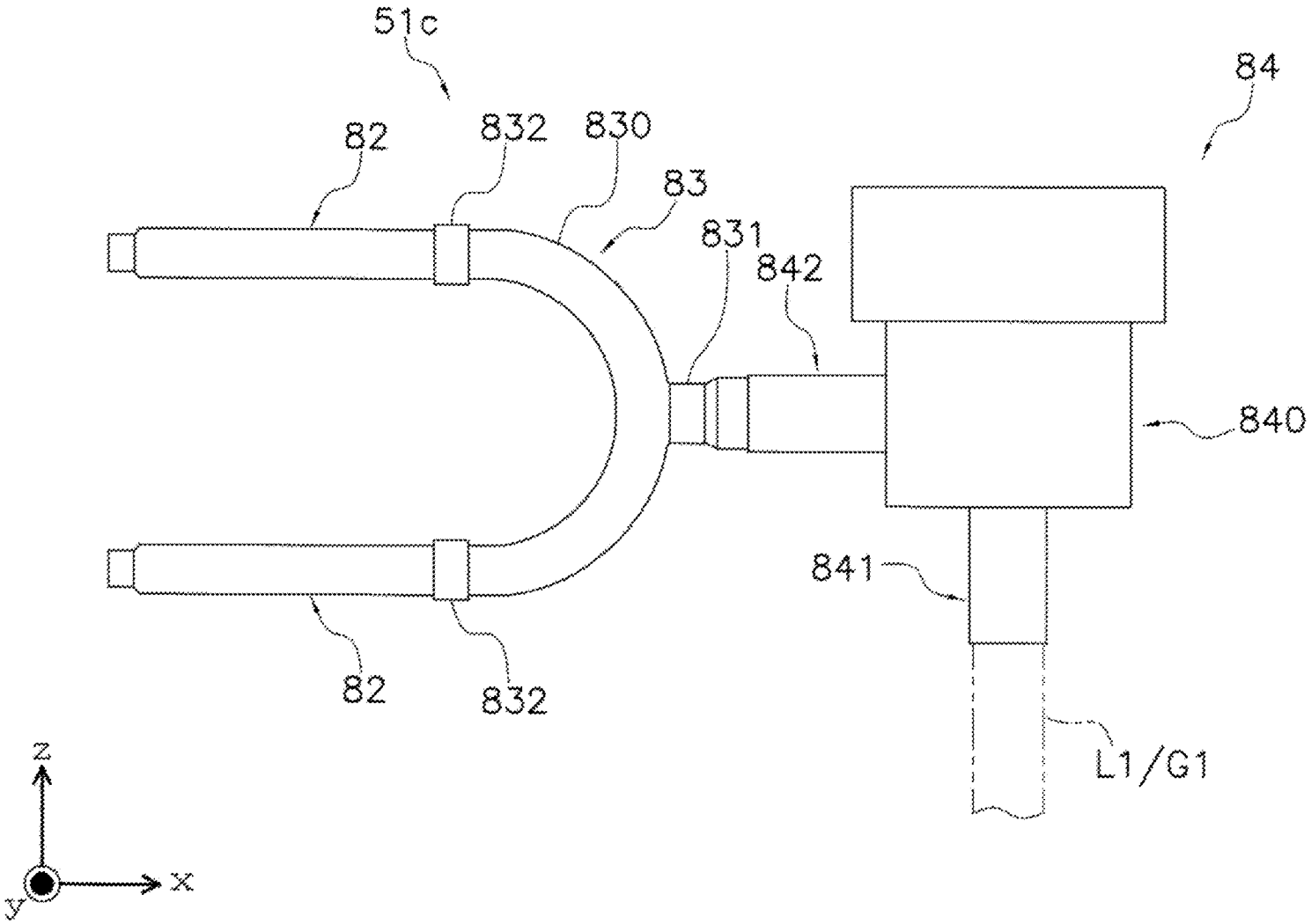
FIG. 11 is a schematic configuration diagram of a main unit according to a twelfth modification.

FIG. 11 is a schematic configuration diagram of the main unit 51*c*. In the main unit 51*c*, the first connection pipe 81 is omitted. Therefore, the second pipe connection portion 842 of the cutoff valve 84 is joined with (connected to) the first insert portion 831 of the branch pipe 83.

Even when the branch pipe unit 50 includes the thus configured main unit 51*c*, the branch pipe unit 50 is able to achieve the operation and advantageous effects similar to the above-described embodiments. As in the case of the main unit 51*c*, when the first connection pipe 81 is omitted and the second pipe connection portion 842 of the cutoff valve 84 is joined with the first insert portion 831 of the branch pipe 83, the first insert portion 831 of the branch pipe 83 may be interpreted as the "first connection pipe" in the claims. In addition, the second pipe connection portion 842 of the cutoff valve 84 is interpreted as an independent element and may be interpreted as the "first connection pipe" in the claims.

(7-13) Thirteenth Modification

In the main unit 51, any one or all of the plurality of second connection pipes 82 may be omitted as needed. In this case, the main unit 51 may have a configuration such as a main unit 51*d* shown in FIG. 12. Hereinafter, portions of the main unit 51*d*, different from the main unit 51, will be described.

Figure 12:
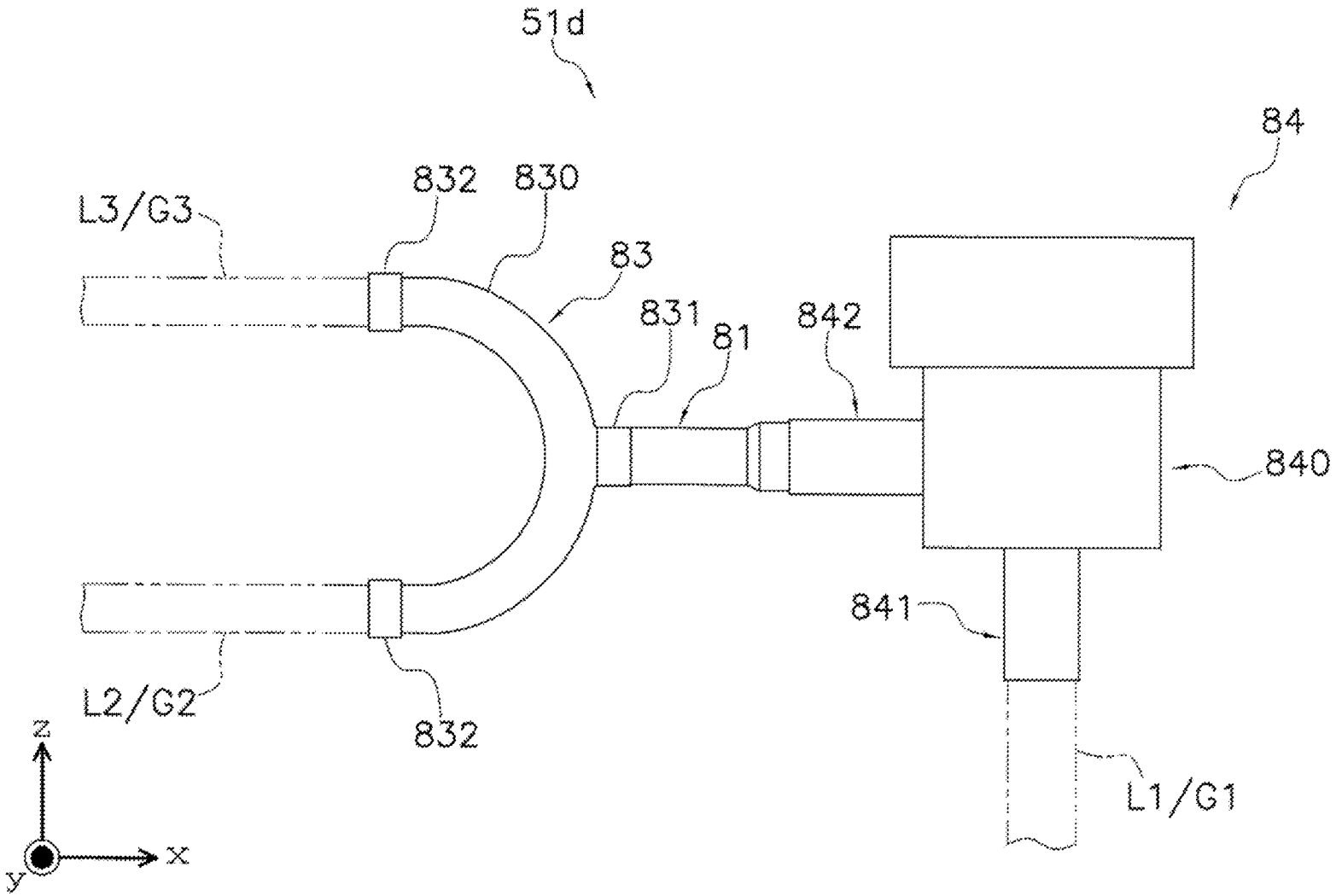
FIG. 12 is a schematic configuration diagram of a main unit according to a thirteenth modification.

FIG. 12 is a schematic configuration diagram of the main unit 51*d*. In the main unit 51*d*, the second connection pipes 82 are omitted. Therefore, in the main unit 51*d*, the indoor-side connection pipes (L2, L3, G2, G3) are joined with the second insert portions 832 of the branch pipe 83.

Even when the branch pipe unit 50 includes the thus configured main unit 51*d*, the branch pipe unit 50 is able to achieve the operation and advantageous effects similar to the above-described embodiments. As in the case of the main unit 51*d*, when any one of the second connection pipes 82 is omitted and the indoor-side connection pipe is joined with the second insert portion 832 of the branch pipe 83, the second insert portion 832 of the branch pipe 83 is interpreted as an independent element and may be interpreted as the "second connection pipe" in the claims.

(7-14) Fourteenth Modification

In the main unit 51, the first connection pipe 81 may be joined with the first pipe connection portion 841 of the cutoff valve 84. In this case, the main unit 51 may have a configuration such as a main unit 51*e* shown in FIG. 13. Hereinafter, portions of the main unit 51*e*, different from the main unit 51, will be described.

Figure 13:
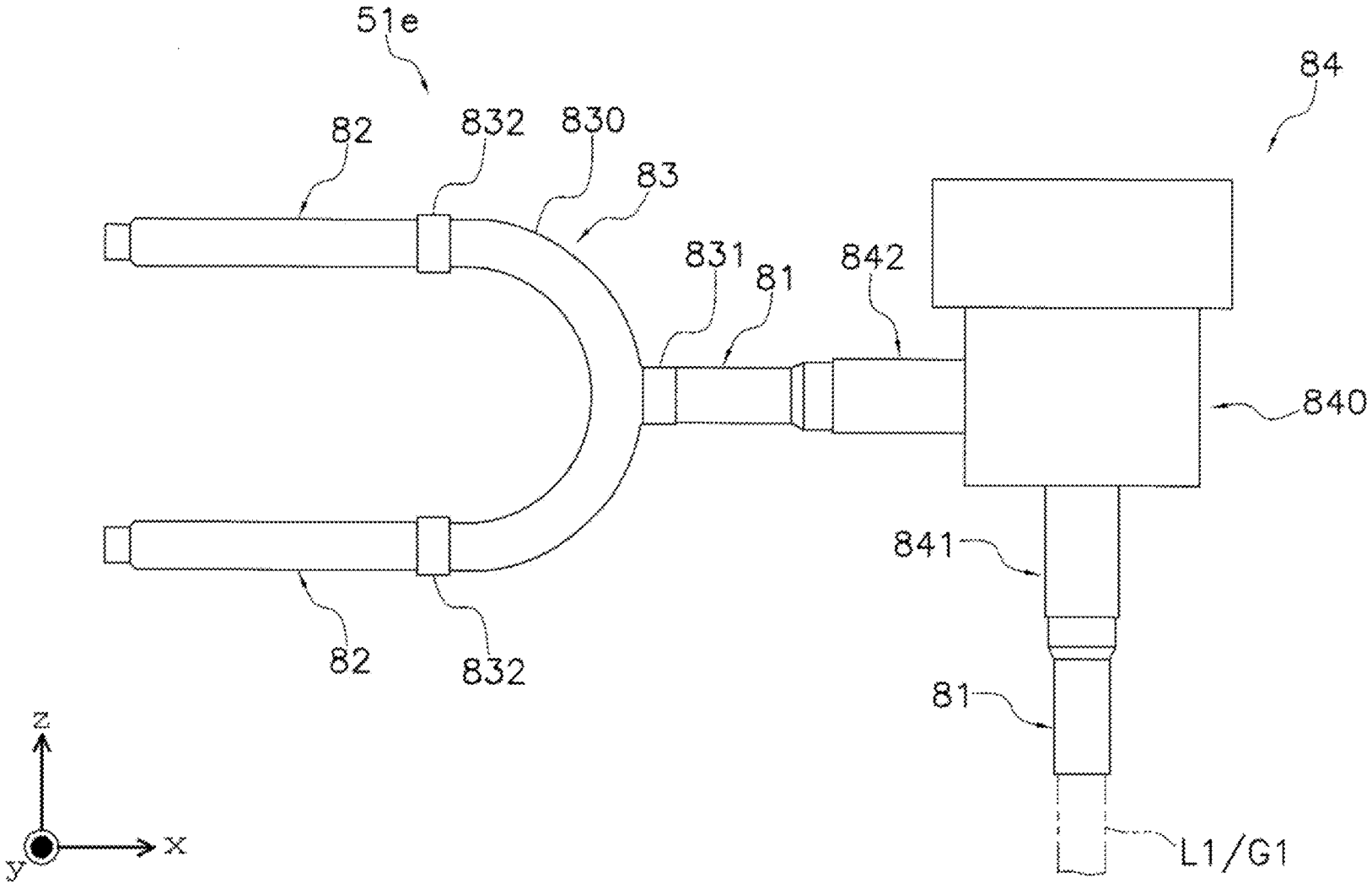
FIG. 13 is a schematic configuration diagram of a main unit according to a fourteenth modification.

FIG. 13 is a schematic configuration diagram of the main unit 51*e*. The main unit 51*e* further includes another first connection pipe 81, and the added first connection pipe 81 is joined with (connected to) one end of the first pipe connection portion 841 of the cutoff valve 84. The outdoor-side connection pipe (L1/G1) is joined with the other end of the first connection pipe 81.

Even when the branch pipe unit 50 includes the thus configured main unit 51*e*, the branch pipe unit 50 is able to achieve the operation and advantageous effects similar to the above-described embodiments. As in the case of the main unit 51*e*, when the first connection pipe 81 is joined with the first pipe connection portion 841 of the cutoff valve 84, one of the first connection pipes 81 may be omitted and the second pipe connection portion 842 of the cutoff valve 84 may be joined with (connected to) the first insert portion 831 of the branch pipe 83 as in the case of the main unit 51*c* according to the "third modification".

(7-15) Fifteenth Modification

In the main unit 51, the valve body portion 840 is configured such that the extending direction of the valve body N1 is the z direction; however, the extending direction of the valve body N1 is not necessarily limited to the z direction. For example, the main unit 51 may have a configuration such as a main unit 51*f* shown in FIG. 14. Hereinafter, portions of the main unit 51*f*, different from the main unit 51, will be described.

Figure 14:
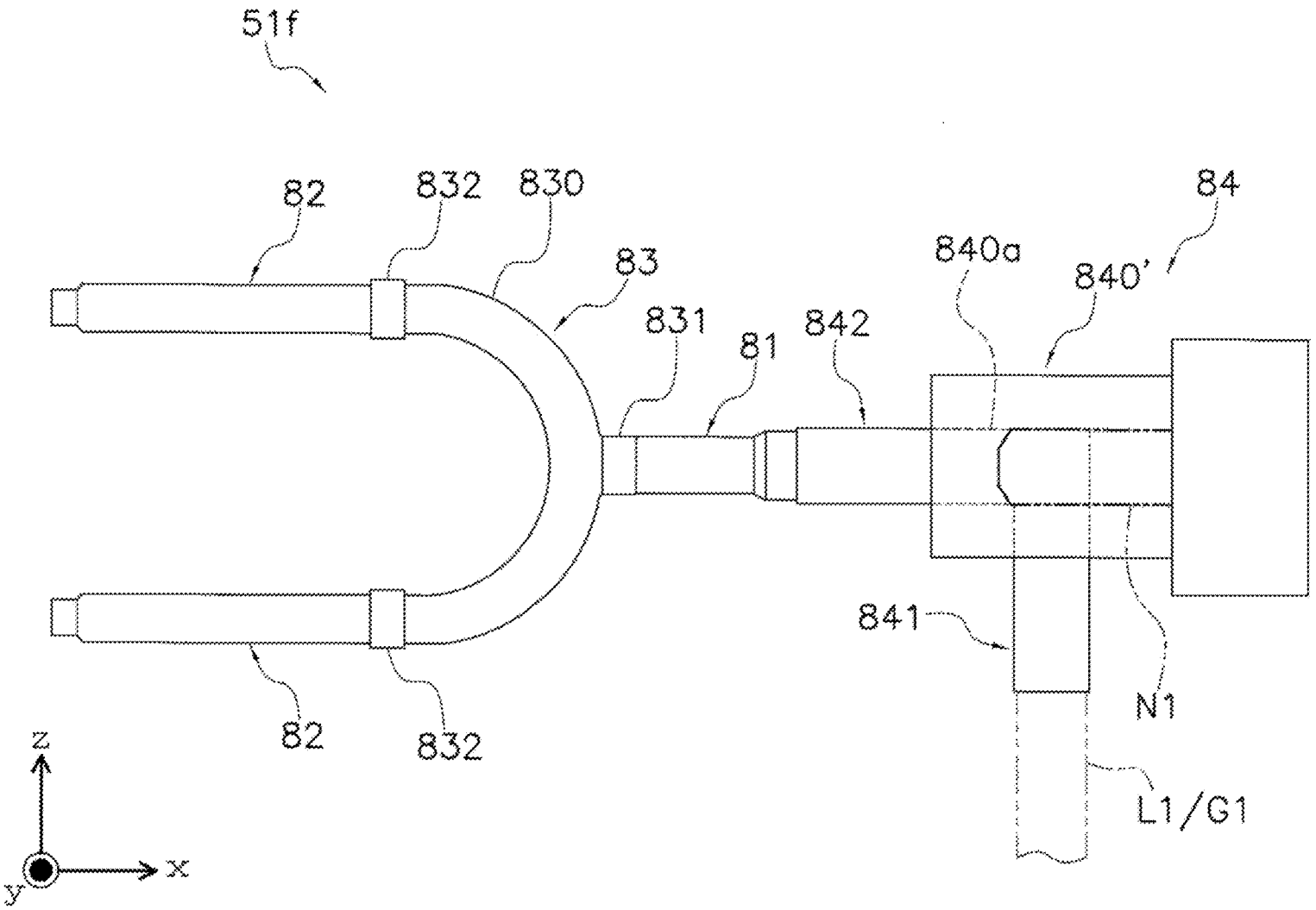
FIG. 14 is a schematic configuration diagram of a main unit according to a fifteenth modification.

FIG. 14 is a schematic configuration diagram of the main unit 51*f*. In the main unit 51*f*, a valve body portion 840' is configured such that the extending direction of the valve body N1 is the x direction. Even when the branch pipe unit 50 includes the thus configured main unit 51*f*, the branch pipe unit 50 is able to achieve the operation and advantageous effects similar to the above-described embodiments.

(7-16) Sixteenth Modification

In the main unit 51, the cutoff valve 84 is located between the first connection pipe 81 and the outdoor-side connection pipe and is connected to the first connection pipe 81. However, the mode of disposition of the cutoff valve 84 is not necessarily limited thereto. The cutoff valve 84 may be connected to each second connection pipe 82 as long as there is no contradiction in achieving the operation and advantageous effects of the ideas according to the present disclosure.

Figure 15:
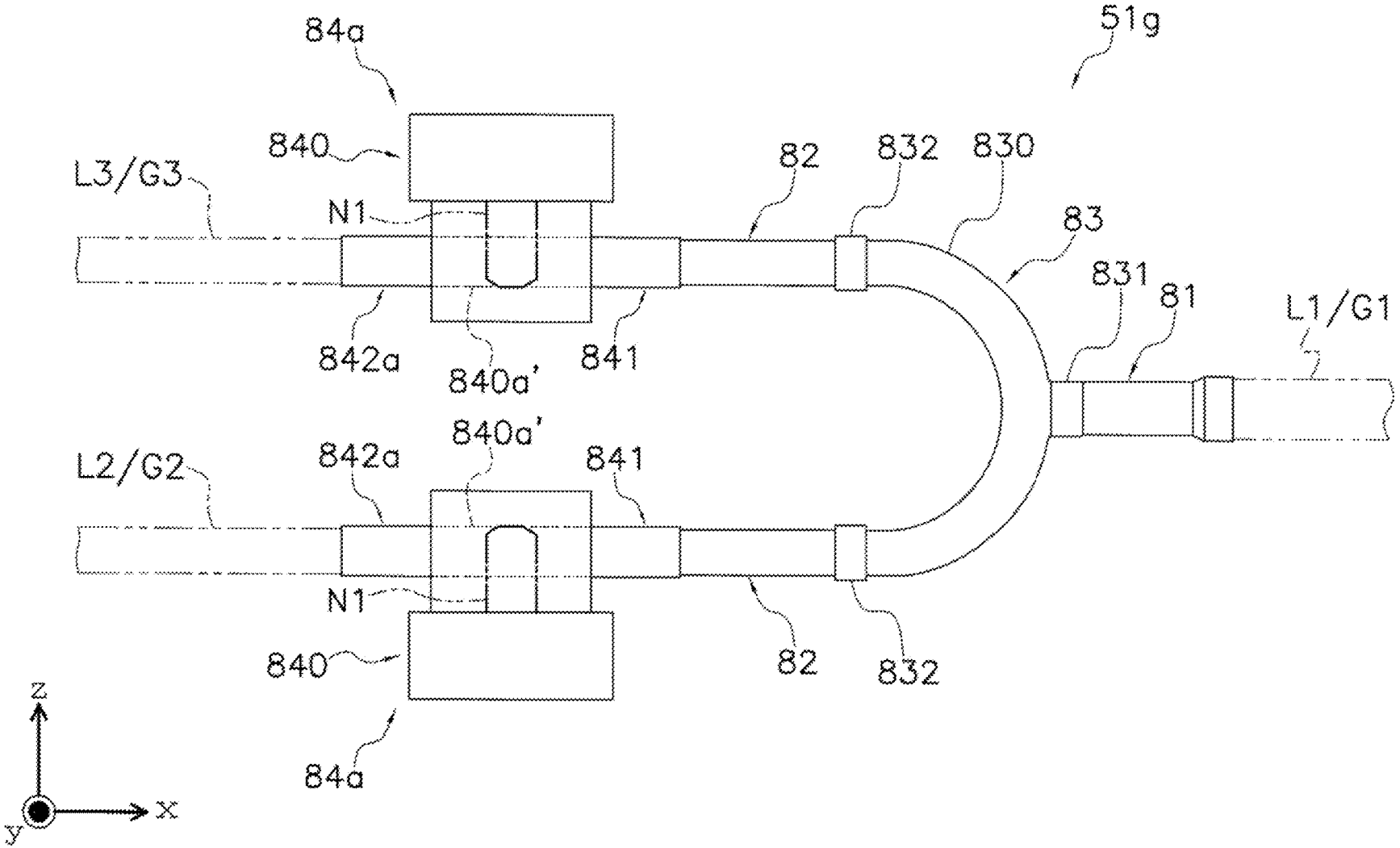
FIG. 15 is a schematic configuration diagram of a main unit according to a sixteenth modification.

For example, the main unit 51 may have a configuration such as a main unit 51*g* shown in FIG. 15. Hereinafter, portions of the main unit 51*g*, different from the main unit 51, will be described.

FIG. 15 is a schematic configuration diagram of the main unit 51*g*. The main unit 51*g* includes a plurality of (same number as the second connection pipes 82) cutoff valves 84*a* similar to those of the main unit 51*a* instead of the cutoff valves 84. As described later, the cutoff valve 84*a* disposed in the main unit 51*g* has a smaller dimension than that disposed in the main unit 51*a*.

In the main unit 51*g*, each cutoff valve 84*a* is associated in a one-to-one correspondence with any one of the second connection pipes 82. In relation to this, in the main unit 51*g*, each cutoff valve 84*a* is associated in a one-to-one or one-to-multiple correspondence with any one or some of the indoor-side connection pipes (indoor units 40).

In the main unit 51*g*, one end of the first pipe connection portion 841 (which corresponds to the "third end portion" in the claims) of the cutoff valve 84*a* is joined with the side portion of the valve body portion 840, and the other end of the first pipe connection portion 841 is joined with the end portion (indoor-side connection pipe-side end portion) of the associated second connection pipe 82.

In the main unit 51*g*, one end of the second pipe connection portion 842*a* (which corresponds to the "fourth end portion" in the claims) of the cutoff valve 84*a* is joined with the side portion of the valve body portion 840, and the other end of the second pipe connection portion 842*a* is joined with the associated indoor-side connection pipe. More specifically, the second pipe connection portion 842*a* is connected to the indoor-side connection pipe in such a position that, in an installation state, the second connection pipes 82 can be arranged along the horizontal direction and the longitudinal direction of each second connection pipe 82 can extend along the horizontal direction.

The thus configured main unit 51*g* may be disposed in the same mode as shown in, for example, FIG. 9. In other words, the main unit 51*g* may be installed such that the first pipe connection portion 841 of the cutoff valve 84*a* is installed to extend not in the front-rear direction (z direction) but in the right-left direction (x direction). In relation to this, in the ceiling space SP, the main unit 51*g* may be placed such that the major extending direction (here, the right-left direction, that is, the horizontal direction) of each indoor-side connection pipe and the major extending direction (here, the right-left direction, that is, the horizontal direction) of the outdoor-side connection pipe are substantially the same. In other words, in the ceiling space SP of which the distance in the vertical direction is short, the main unit 51*g* may be placed in such a position that the major extending direction (here, the right-left direction, that is, the horizontal direction) of each indoor-side connection pipe and the major extending direction (here, the right-left direction, that is, the horizontal direction) of the outdoor-side connection pipe are substantially the same.

In the cutoff valve 84*a* disposed in the main unit 51*g*, the first pipe connection portion 841 is connected to the second connection pipe 82 that has a less inside diameter than the first connection pipe 81, and the second pipe connection portion 842 is connected to the indoor-side connection pipe that has less inside diameter than the outdoor-side connection pipe. In relation to this, the cutoff valve 84*a* disposed in the main unit 51*g* has a smaller dimension than that disposed in the main unit 51*a*.

Even when the branch pipe unit 50 (50') includes the thus configured main unit 51*g*, the branch pipe unit 50 (50') is able to achieve the operation and advantageous effects similar to the above-described embodiments.

In other words, the main unit 51*g* connects the outdoor-side connection pipe and the plurality of indoor-side connection pipes, and includes the first connection pipe 81 communicating with the outdoor-side connection pipe, the plurality of second connection pipes 82 each communicating with an associated one of the indoor-side connection pipes, the branch pipe 83 communicating the first connection pipe 81 with the plurality of second connection pipes 82, and the plurality of cutoff valves 84*a* connected to the associated second connection pipes 82 and configured to block the flow of refrigerant by being placed in a closed state. In other words, the refrigerant passage branches off according to the number of the indoor units 40 and the number of the other devices between the outdoor unit 10 and the indoor units 40; however, even when the branch pipe unit 50 includes the main unit 51*g*, the cutoff valve 84*a* can be disposed before branching of the refrigerant passage (more specifically, on the outdoor unit 10 side of the branch pipe 83 located on the indoor unit 40 side of the branch pipe 83). With this configuration, in interrupting the flow of refrigerant into the plurality of indoor units 40, the single cutoff valve 84*a* can be shared among the plurality of indoor units 40. As a result, even when the cutoff valve 84*a* is not disposed for each indoor unit 40, the flow of refrigerant from the outdoor unit 10 side to the plurality of indoor units 40 can be interrupted in the event of refrigerant leakage. Therefore, the cutoff valve 84*a* is not required to be disposed for each indoor unit 40 in relation to measures against refrigerant leakage, so an increase in the number of the cutoff valves 84*a* to be installed in the refrigerant connection pipe is reduced.

The main unit 51*g* can be installed in the refrigerant connection pipe in a state where the first connection pipe 81, the plurality of second connection pipes 82, the branch pipe 83, and the plurality of cutoff valves 84*a* are preassembled. In this respect, although manhour increases if a number of cutoff valves 84*a* and branch pipes are joined on site at the time of installation, working time and effort required for installation are reduced when the branch pipe unit 50 includes the main unit 51*g*.

In the main unit 51*g*, the plurality of cutoff valves 84*a* is disposed; however, when the cutoff valve 84*a* is connected to the second connection pipe 82, the cutoff valve 84*a* having a smaller dimension may be used as compared to when the cutoff valve 84*a* is connected to the first connection pipe 81. In relation to this, in the main unit 51*g*, although the plurality of cutoff valves 84*a* is disposed, downsizing is facilitated, and a decrease in workability is reduced even in a narrow space.

Thus, in relation to improvement in safety against refrigerant leakage in the air-conditioning system, a decrease in workability is reduced.

In the main unit 51*g*, the first connection pipe 81 is not necessarily required and may be omitted as needed. In the main unit 51*g*, one of the cutoff valves 84*a* (more specifically, the cutoff valve 84*a* associated in a one-to-one correspondence with the indoor-side connection pipe (indoor unit 40)) is not necessarily required and may be omitted as needed.

Figure 16:
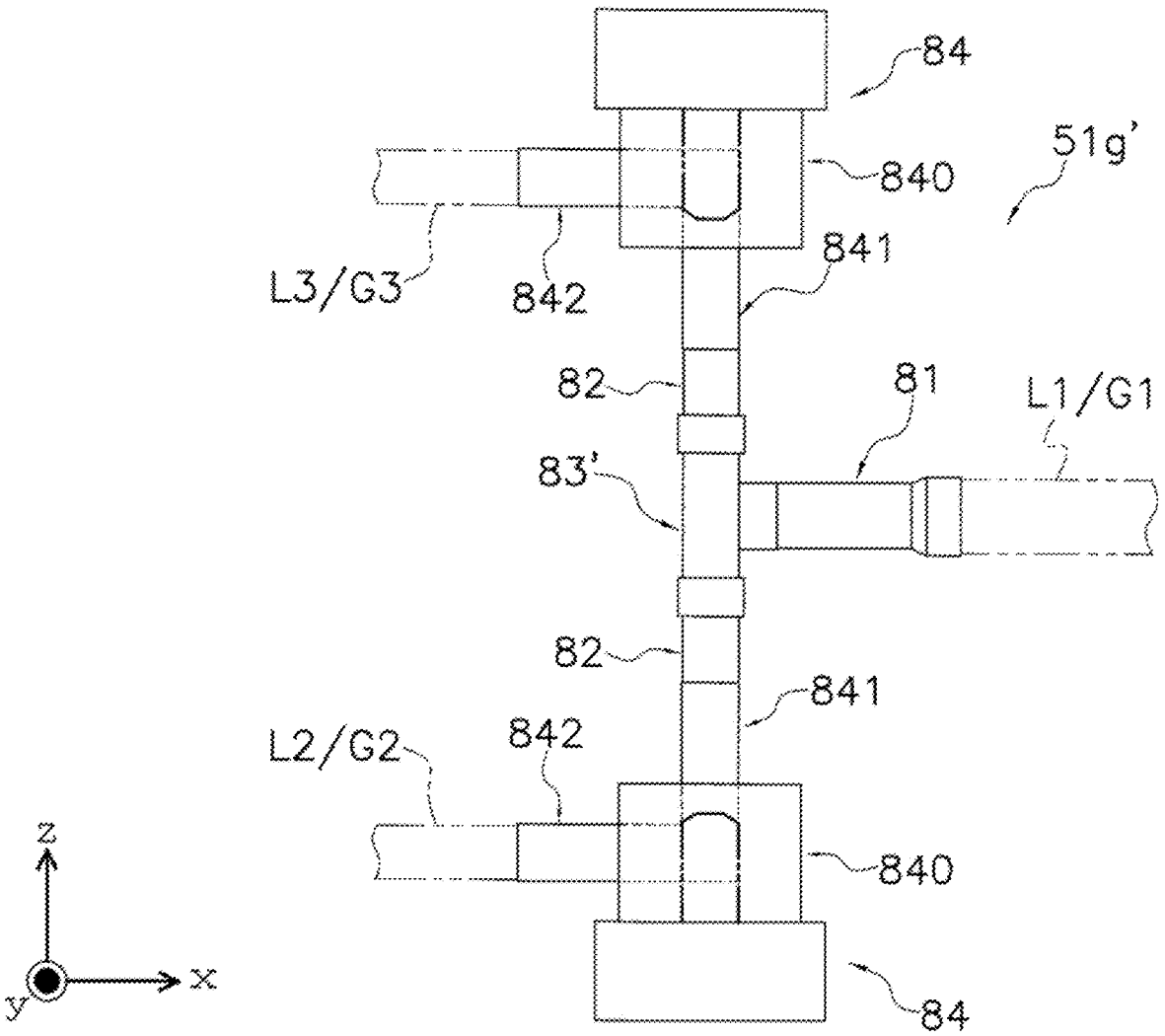
FIG. 16 is a schematic configuration diagram of another main unit according to the sixteenth modification.

Of course, the main unit 51*g* may include the cutoff valve 84 instead of the cutoff valve 84*a*. In this case, the main unit 51*g* may be configured as in the case of a main unit 51*g'* shown in FIG. 16. The main unit 51*g'* includes a branch pipe 83' instead of the branch pipe 83. The branch pipe 83' is formed not in a substantially U-shape unlike the branch pipe 83 but in a substantially T-shape. In relation to this, in the branch pipe 83', the second connection pipe 82 extends along the z direction (horizontal direction). In each cutoff valve 84, the first pipe connection portion 841 extending along the z direction is connected to the associated second connection pipe 82, and the second pipe connection portion 842 extending along the x direction is connected to the associated indoor-side connection pipe.

In this case as well, similar operation and advantageous effects to those of the above-described embodiments can be achieved. In the main unit 51*g'*, the longitudinal direction of the first pipe connection portion 841 and the longitudinal direction of the second pipe connection portion 842*a* intersect with each other; however, the main unit 51*g'* is placed in such a position that the second connection pipes 82 are arranged in the horizontal direction (here, the z direction that intersects with the extending direction x) and the extending direction of each second connection pipe 82 and the extending direction of the first connection pipe 81 match each other (here, the orientations of both are different but the extending directions of both are the horizontal direction), so, in the ceiling space SP, the major extending direction (here, the right-left direction, that is, the horizontal direction) of the indoor-side connection pipe and the major extending direction (here, the right-left direction, that is, the horizontal direction) of the outdoor-side connection pipe are substantially the same. In other words, in this case as well, in the ceiling space SP in which the distance in the vertical direction is short, the main unit 51*g'* can be placed in such a position that the major extending direction (here, the right-left direction, that is, the horizontal direction) of the indoor-side connection pipe and the major extending direction (here, the right-left direction, that is, the horizontal direction) of the outdoor-side connection pipe are substantially the same.

The substantially T-shaped branch pipe 83' is used in the main unit 51*g'*, downsizing can be achieved in relation to the length in the x direction of the main unit 51g' as compared to when the substantially U-shaped branch pipe 83 is used like the main unit 51g.

(7-17) Seventeenth Modification

Figure 17:
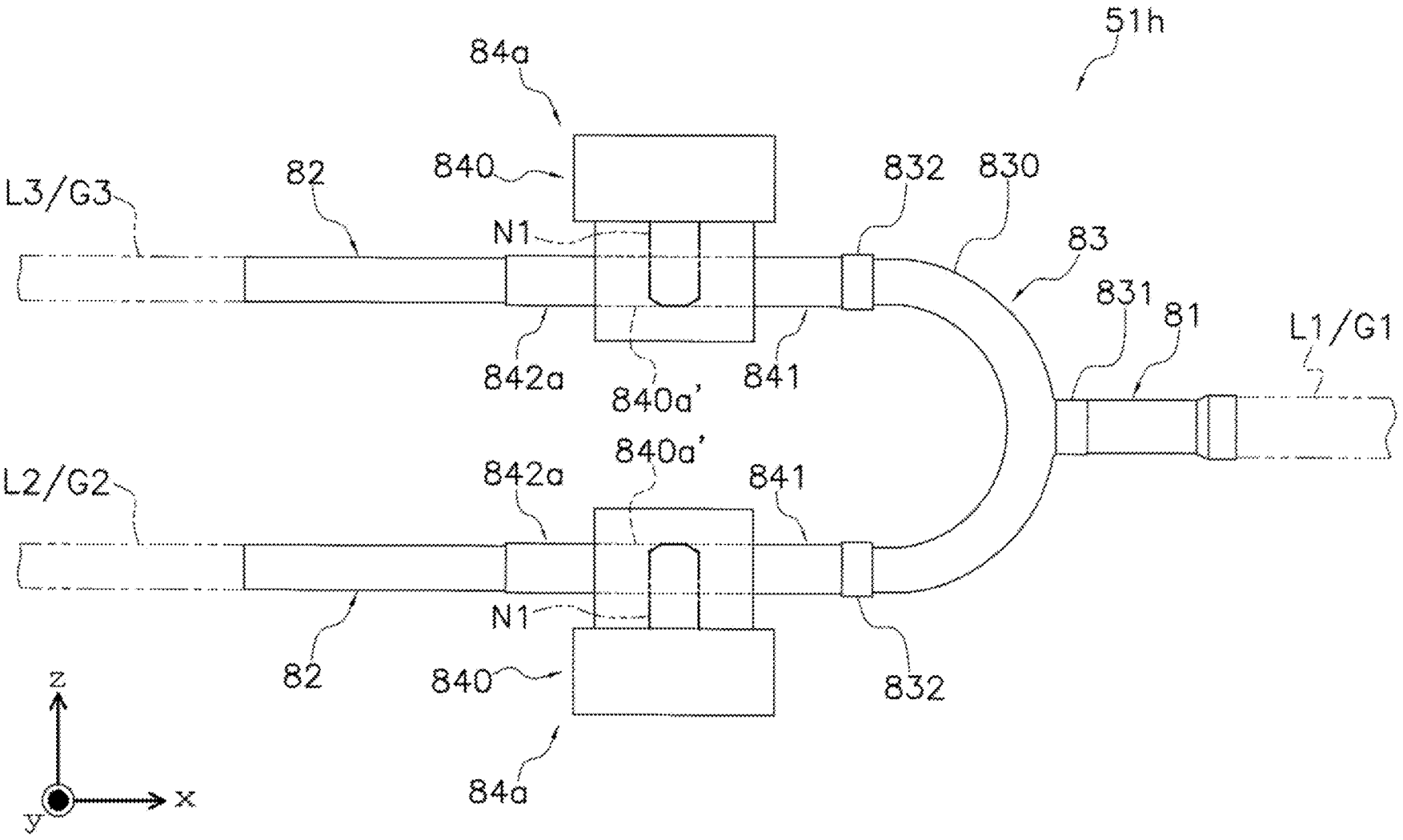
FIG. 17 is a schematic configuration diagram of a main unit according to a seventeenth modification.

The main unit 51 may have a configuration such as a main unit 51h shown in FIG. 17. Hereinafter, portions of the main unit 51h, different from the main unit 51g, will be described.

FIG. 17 is a schematic configuration diagram of the main unit 51h. In the main unit 51h, one end of the first pipe connection portion 841 (which corresponds to the "third end portion" in the claims) of the cutoff valve 84a is joined with the side portion of the valve body portion 840, and the other end of the first pipe connection portion 841 is joined with the branch pipe 83. In the main unit 51g, one end of the second pipe connection portion 842a (which corresponds to the "fourth end portion" in the claims) of the cutoff valve 84a is joined with the side portion of the valve body portion 840, and the other end of the second pipe connection portion 842a is joined with the end portion (outdoor-side connection pipe-side end portion) of the second connection pipe 82.

Even when the branch pipe unit 50 (50') includes the thus configured main unit 51h, the branch pipe unit 50 (50') is able to achieve the operation and advantageous effects similar to those when the branch pipe unit 50 includes the main unit 51g.

(7-18) Eighteenth Modification

Figure 18:
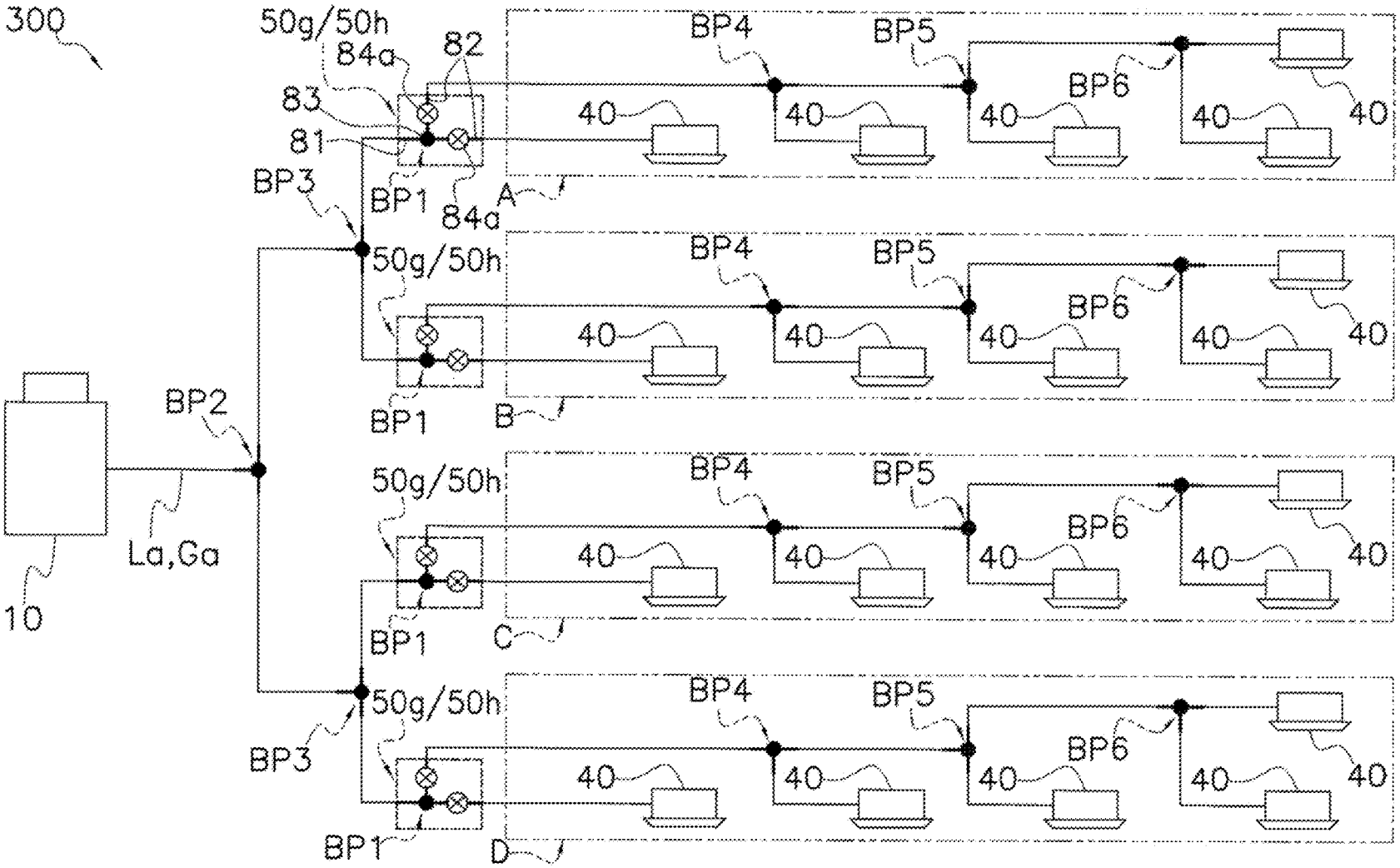
FIG. 18 is a schematic configuration diagram of an air-conditioning system according to an eighteenth modification.

When the branch pipe unit 50 (50') includes the main unit 51g (51g') or the main unit 51h, the branch pipe unit 50 (50') may be applied to an air-conditioning system in which, as in the case of, for example, an air-conditioning system 300 shown in FIG. 18, the three or more indoor units 40 are connected to the single outdoor unit 10 and each indoor unit 40 is disposed in series or parallel with the other indoor units 40. FIG. 18 is a schematic configuration diagram of the air-conditioning system 300 to which the branch pipe unit 50 including the main unit 51g (51g') or the main unit 51h is applied. In FIG. 18, for the sake of simple illustration, the liquid-side connection pipe La and the gas-side connection pipe Ga are shown as one.

In the air-conditioning system 300, as well as the air-conditioning system 200, each connection pipe (La, Ga) that extends between the outdoor unit 10 and the indoor units 40 branches into multiple lines (here, roughly four), and therefore the indoor units 40 disposed in the branched lines form a plurality of (four) groups (A to D). In the air-conditioning system 300, each of the groups A to D includes some numbers of the indoor units 40.

In FIG. 18, the branch part BP1 located on the leading end (most outdoor unit 10 side) of each of the groups A to D is made up of the branch pipe unit 50 including the main unit 51g or the main unit 51h. In FIG. 18, one of the cutoff valves 84a is associated in a one-to-one correspondence with the indoor unit 40 located on the most outdoor unit 10 side in the group, and is configured to block the flow of refrigerant to the associated indoor unit 40 by being controlled into a closed state. The other one of the cutoff valves 84a is associated in a one-to-multiple correspondence with the other indoor units 40 included in the group, and is configured to block the flow of refrigerant to the associated indoor units 40 by being controlled into a closed state. In other words, in the air-conditioning system 300 as well, in interrupting the flow of refrigerant to the plurality of indoor units 40, the single cutoff valve 84a is shared among the plurality of indoor units 40.

In the case where the branch pipe unit 50 is configured and disposed in the mode shown in FIG. 18, when refrigerant leakage has occurred in any one of the groups A to D, the amount of leaked refrigerant is reduced by controlling the cutoff valves 84a into a closed state in the branch part BP1 associated with the group in which refrigerant leakage has occurred. As a result, even when the cutoff valve 84a is not disposed for each indoor unit 40, the flow of refrigerant from the outdoor unit 10 side to the plurality of indoor units 40 can be interrupted in the event of refrigerant leakage. Therefore, the cutoff valve 84a is not required to be disposed for each indoor unit 40 in relation to measures against refrigerant leakage, so an increase in the number of the cutoff valves 84a is reduced. The advantageous effect can be particularly expected when the number of the indoor units 40 is large as in the case of the air-conditioning system 300. Thus, in relation to improvement in safety against refrigerant leakage in the air-conditioning system 300, a decrease in workability can be particularly reduced.

In the air-conditioning system 300, since the number of the indoor units 40 is large, manhour remarkably increases when the control valves and the branch pipes are joined with each other on site at the time of installation; however, working time and effort required for installation are particularly reduced with the branch pipe unit 50.

In the air-conditioning system 300, since the branch pipe unit 50 is disposed for each group, when refrigerant leakage has occurred, only the group in which refrigerant leakage has occurred can be interrupted, and the operations of the groups in which refrigerant leakage has not occurred can be continued.

In the air-conditioning system 300, no cutoff valve 84a is disposed at any of the branch part BP2 closest to the outdoor unit 10, the branch part BP3 between the branch part BP2 and the branch part BP1, and the branch parts BP4 to BP6 in each group. In other words, in the air-conditioning system 300, the branch part BP2 and the branch parts BP3 each are made up of a branch pipe unit 50 having no cutoff valve 84a.

In the refrigerant circuit RC, the position (branch part BP) at which the cutoff valve 84a is disposed may be changed as needed. Specifically, the cutoff valve 84a should be disposed at a portion (for example, any one of the branch parts BP1 to BP6 shown in FIG. 18) at which refrigerant needs to be interrupted in ensuring safety based on the amount of refrigerant that is assumed to leak at the time when refrigerant leakage has occurred. For example, the position (branch part BP) at which the cutoff valve 84a is disposed may be determined based on the total number of the indoor units 40 that need to be interrupted by the cutoff valve 84a, the total volumetric capacity of the indoor units 40, or the total volumetric capacity of the indoor-side connection pipes in ensuring safety in the event of refrigerant leakage. Alternatively, the cutoff valve 84a may be disposed for each device in which the amount of refrigerant filled corresponds to these.

In other words, the cutoff valve 84a may be connected to any one or all of the following second connection pipes 82 (indoor-side pipes) (d), (e), and (f).

(d): The second connection pipe 82 disposed between the outdoor unit 10 and the plurality of indoor units 40 of which the total volumetric capacity is less than or equal to a fourth threshold ΔTh4

(e): The second connection pipe 82 disposed between the outdoor unit 10 and the plurality of indoor units 40 of which the total number is less than or equal to a fifth threshold ΔTh5

(f): The second connection pipe 82 communicating with the indoor-side connection pipes of which the total volumetric capacity is less than or equal to a sixth threshold ΔTh6

In this case, the fourth threshold ΔTh4, the fifth threshold ΔTh5, and/or the sixth threshold ΔTh6 should be set based on the size of any one of object spaces in each of which the indoor unit 40 is installed and of which air is conditioned (for example, the narrowest object space) in consideration of the possibility that the concentration of leaked refrigerant becomes a hazardous value (lower flammability limit concentration or oxygen deficient limit concentration) in the object space when refrigerant leakage has occurred.

For example, the fourth threshold ΔTh4, the fifth threshold ΔTh5, and/or the sixth threshold ΔTh6 may be set such that the cutoff valve 84*a* is disposed within the range in which the above-described condition 1 (see the ninth modification) is satisfied.

When the disposed position of the cutoff valve 84*a* is determined in this mode, the cutoff valve 84*a* can be adequately disposed at a part at which refrigerant is required to be interrupted from the viewpoint of safety (for example, lower flammability limit concentration, oxygen deficient limit concentration, or the like) at the time when refrigerant leakage has occurred according to the scale of a facility or environment in which the air-conditioning system is installed. Thus, an increase in the number of the cutoff valves 84*a* is reduced, and ensuring safety against refrigerant leakage is further facilitated.

In FIG. 18, one of the cutoff valves 84*a* is associated in a one-to-one correspondence with the indoor unit 40 located on the most outdoor unit 10 side in the group; however, this cutoff valve 84*a* may also be associated in a one-to-multiple correspondence with the indoor units 40 as in the case of the other one of the cutoff valves 84*a*. Alternatively, this cutoff valve 84*a* is not necessarily required and may be omitted as needed.

(7-19) Nineteenth Modification

Although not particularly described in the above-described embodiments, the main unit 51 and part of the outdoor-side connection pipe and/or the indoor-side connection pipe may be carried to a site in a combined state and installed. In other words, the main unit 51 and part of the outdoor-side connection pipe and/or the indoor-side connection pipe may be connected (joined) in advance at a factory, or the like.

Particularly, in FIG. 3, the outdoor-side connection pipe is curved near the connection portion with the main unit 51. In the case where the refrigerant connection pipe has a curved part in this way, when installation is performed in a state where the curved part is combined with the main unit 51 in advance, effort required for installation is particularly reduced. In other words, workability improves.

In this case, from another viewpoint, part of the refrigerant connection pipe combined with the main unit 51 may be interpreted as the component (for example, the first connection pipe 81 and/or the second connection pipe 82) of the main unit 51.

(7-20) Twentieth Modification

Although not particularly described in the above-described embodiments, the main unit 51 and the heat insulating material 95 may be carried to a site in a combined state and installed. In other words, the main unit 51 may be covered with the heat insulating material 95 in advance at a factory, or the like. With this configuration, effort required for installation is reduced, and workability improves. In this case, from another viewpoint, the heat insulating material 95 combined with the main unit 51 may be interpreted as the component of the main unit 51.

Portions that are connected to other pipes on an installation site may be connected to the other pipes and then covered with the heat insulating material 95.

(7-21) Twenty-First Modification

In the above-described embodiments, in the electric component unit 52, the electric components 521 are implemented on or in the board 522. However, the electric components 521 are not necessarily required to be implemented on or in the board 522. For example, the electric components 521 may be disposed independently in the unit casing 523.

(7-22) Twenty-Second Modification

In the above-described embodiments, the wire 53 has a longitudinal dimension of 1.2 m. However, the wire 53 is not necessarily required to be configured in this mode, and the longitudinal dimension of the wire 53 may be changed as needed. For example, the wire 53 may have a longitudinal dimension of 1 m or may have a longitudinal dimension of 2 m.

The main unit 51 and the electric component unit 52 can be installed so as to be spaced apart 1 m or longer on an installation site, and, from the viewpoint of improvement in the flexibility of installation, the wire 53 may be formed to have a longitudinal dimension of 1.0 m or longer. However, the mode of configuration of the wire 53 is not necessarily limited thereto, and the longitudinal dimension may be shorter than 1 m.

(7-23) Twenty-Third Modification

In the above-described embodiments, the electric component unit 52 is provided independently of the main unit 51 so as to be movable relative to the main unit 51. In this respect, from the viewpoint of enhancing the flexibility of installation and achieving downsizing of the units by configuring the electric component unit 52 independently of the main unit 51 to make the electric component unit 52 movable on site, the above electric component unit 52 may be configured in the above mode. However, the electric component unit 52 is not necessarily limited thereto and may be configured so as to be combined with the main unit 51.

(7-24) Twenty-Fourth Modification

In the above-described embodiments, in the main unit 51, the case where the first connection pipe 81 and the branch pipe 83 are joined with each other and each second connection pipe 82 and the branch pipe 83 are joined with each other is described. In this respect, any one or all of the first connection pipe 81 and the second connection pipes 82 may be integrally formed with the branch pipe 83.

(7-25) Twenty-Fifth Modification

In the above-described embodiments, in the main unit 51, the case where the first connection pipe 81, the second connection pipes 82, and the branch pipe 83, as well as the outdoor-side connection pipe, are made of copper is described. However, the material of each of the first connection pipe 81, the second connection pipes 82, the branch pipe 83, and the other portions of the main unit 51 is not limited and should be individually selected as needed according to design specifications or an installation environment.

(7-26) Twenty-Sixth Modification

In the above-described embodiments, the case where the main unit 51 includes the single first connection pipe 81 and the two second connection pipes 82 is described. However, the number of the first connection pipes 81 and the number of the second connection pipes 82 in the main unit 51 are not necessarily limited thereto and may be changed as needed. For example, the main unit 51 may include two or more first connection pipes 81. Alternatively, the main unit 51 may include three or more second connection pipes 82. In other words, the number of branches in the main unit 51 (branch part BP) is not limited to two and may be three or more.

(7-27) Twenty-Seventh Modification

In the above-described embodiments, the case where the main unit 51 is installed without being particularly accommodated in a casing, or the like, is described. In this respect, from the viewpoint of facilitating downsizing, the main unit 51 may be installed in the above mode. However, the mode of installation of the main unit 51 is not necessarily limited thereto and may be selected as needed according to design specifications or an installation environment. For example, the main unit 51 may be installed in a state of being accommodated in a casing.

(7-28) Twenty-Eighth Modification

In the above-described embodiments, the case where the electric component unit 52 is hung from the top in the ceiling space SP by attaching the brackets 90 fixed to the ceiling space top surface C2 to the electric component unit 52 is described. However, the mode of installation of the electric component unit 52 is not necessarily limited thereto and may be changed as needed according to design specifications or an installation environment. For example, the electric component unit 52 may be installed by being placed on the ceiling space bottom surface C1, a beam, or the like, or may be installed by being fixed to a pillar, a wall, or the like.

(7-29) Twenty-Ninth Modification

In the above-described embodiments, in the branch pipe unit 50, the first connection pipe 81 (outdoor-side pipe), the plurality of second connection pipes 82 (indoor-side pipe group), the branch pipe 83 (branch portion), and the cutoff valve 84 are combined together. However, the branch pipe unit 50 is not necessarily required to be configured in the above mode, and any one or some of elements may be configured separately and may be configured to be connected to other elements on site.

For example, the plurality of second connection pipes 82 (indoor-side pipe group) may be not included in the branch pipe unit 50 and may be configured so as to be carried to an installation site independently and connected to other pipes.

In addition, for example, the cutoff valve 84 is not necessarily required to be combined together with other elements included in the branch pipe unit 50. In other words, the cutoff valve 84 may be configured so as to be carried to an installation site independently and connected to another pipe. In this case as well, the operation, advantageous effects, and the like, described in the above (6-1) can be achieved.

(7-30) Thirtieth Modification

Any one of valves disposed in the refrigerant circuit RC according to the above-described embodiments may have a liquid seal control structure that suppresses formation of a liquid seal circuit in the refrigerant circuit RC when the cutoff valve 84 is placed in a closed state. For example, any one or all of the indoor expansion valve 41, the cutoff valve 84 (or 84*a*), and the outdoor first electrically-operated valve 16 may have a liquid seal control structure. The liquid seal control structure is not limited as long as the liquid seal control structure is a structure configured to suppress formation of a liquid seal circuit. For example, as a liquid seal control structure, a small passage that allows passage of refrigerant in small amount in the case of a closed state may be formed in the valve. In this case, a small passage may be formed by, for example, forming a cutout in a valve seat, a valve body, or the like. Alternatively, for example, as a liquid seal control structure, a valve may be configured to allow passage of refrigerant in small amount at the time when pressure higher than or equal to a predetermined value is applied even in the case of a closed state.

Instead of or in addition to disposing the valve having a liquid seal control structure, a liquid seal control mechanism may be disposed in the refrigerant circuit RC. The liquid seal control mechanism is a mechanism configured to suppress formation of a liquid seal circuit in the refrigerant circuit when the control valve is placed in a closed state. The liquid seal control mechanism is not limited as long as the mechanism is configured to suppress formation of a liquid seal circuit. For example, a refrigerant pipe that forms a bypass circuit configured to bypass refrigerant from a passage on one end side of the cutoff valve 84 to a passage on the other end side of the cutoff valve 84 may be disposed in the refrigerant circuit RC as the liquid seal control mechanism. In this case, the liquid seal control mechanism may include a check valve disposed in the bypass circuit and configured to allow the flow of refrigerant in only one direction, an on-off valve disposed in the bypass circuit and configured to switch between communication and interruption of the bypass circuit, or the like. A valve having a liquid seal control structure and/or a liquid seal control mechanism may be disposed in the branch pipe unit 50.

With this configuration, when refrigerant leakage has occurred and the cutoff valve 84 is placed in a closed state, formation of a liquid seal circuit in the refrigerant circuit RC is suppressed. In other words, in the above-described embodiments, the indoor expansion valve 41 is controlled into a closed state in the refrigerant leakage first control, and the cutoff valve 84 is controlled into a closed state in the refrigerant leakage third control. Therefore, a liquid seal circuit can be formed in the refrigerant circuit RC. For example, a liquid seal circuit can be formed between the cutoff valve 84 of the branch pipe unit 50 (50*a* or 50*b*) and the indoor expansion valve 41. In addition, for example, a liquid seal circuit can be formed between the cutoff valve 84 of the branch pipe unit 50 (50*a*) and the outdoor first electrically-operated valve 16.

However, for example, when any one or all of the indoor expansion valve 41, the cutoff valve 84, and the outdoor first electrically-operated valve 16 have a liquid seal control structure, formation of the liquid seal circuit is suppressed. In addition, for example, in the refrigerant circuit RC, a refrigerant pipe that forms a bypass circuit to bypass refrigerant from a passage between the cutoff valve 84 and the indoor expansion valve 41 to a passage on the outdoor unit 10 side of the cutoff valve 84 is disposed as a liquid seal control mechanism, so formation of the liquid seal circuit is suppressed. Thus, in the event of refrigerant leakage, occurrence of damage to devices due to formation of a liquid seal circuit is reduced. In other words, a decrease in reliability is reduced.

(8)

The embodiments are described above; however, it is understood that various modifications of modes and details are applicable without departing from the spirit or scope of the claims.

The present disclosure is usable in an air-conditioning system.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

10 outdoor unit
16 outdoor first electrically-operated valve
40, 40*a*, 40*b* indoor unit
41 indoor expansion valve (electrically-operated valve)
50, 50',50" branch pipe unit (refrigerant branch unit)
50*a* first branch pipe unit (refrigerant branch unit)
50*b* second branch pipe unit (refrigerant branch unit)
51, 51*a* to 51*h* main unit (first component)
52 electric component unit (second component)
53 wire
60 refrigerant leak sensor
65 remote control unit
70 controller
81 first connection pipe (outdoor-side pipe)
82 second connection pipe (indoor-side pipe)
83, 83',83*a* branch pipe (branch portion)
84, 84*a* cutoff valve (control valve)
90 bracket
95 heat insulating material
100, 100',200, 300 air-conditioning system
521 electric component
522 board
523 unit casing (casing)
524 fixing portion
830 branch pipe body portion
830*a* branch pipe body portion
831 first insert portion
832 second insert portion
840, 840' valve body portion (valve body)
841 first pipe connection portion (first end portion, third end portion)
842, 842*a* second pipe connection portion (second end portion, fourth end portion)
A to D group
BP, BP1 to BP6 branch part (first part)
BPa liquid-side branch part (first part)
BPb gas-side branch part (first part)
C1 ceiling space bottom surface
C2 ceiling space top surface
G1 first gas-side connection pipe (outdoor-side connection pipe)
G2 second gas-side connection pipe (indoor-side connection pipe)
G3 third gas-side connection pipe (indoor-side connection pipe)
Ga gas-side connection pipe (refrigerant connection pipe)
L1 first liquid-side connection pipe (outdoor-side connection pipe)
L2 second liquid-side connection pipe (indoor-side connection pipe)
L3 third liquid-side connection pipe (indoor-side connection pipe)
La liquid-side connection pipe (refrigerant connection pipe)
P1 to P11 first pipe P1 to eleventh pipe
P17 to P18 seventeenth pipe P17 to eighteenth pipe
RC refrigerant circuit
RC1 outdoor-side circuit
RC2 indoor-side circuit
RC3 connection circuit
RC3*a* liquid-side connection circuit
RC3*b* gas-side connection circuit
SP ceiling space

PATENT LITERATURE

PATENT LITERATURE 1: Japanese Unexamined Patent Application Publication No.

The invention claimed is:

1. An air-conditioning system that performs a refrigeration cycle in a refrigerant circuit, the air-conditioning system comprising:
- an outdoor unit;
- indoor units that each comprises:
  - a heat exchanger that evaporates or radiates refrigerant; and
  - an expansion valve that switches between an open state and a closed state;
- a refrigerant connection pipe that connects the outdoor unit and the indoor units;
- a refrigerant branch unit that:
  - forms a branch,
  - connects an outdoor-side connection pipe and indoor-side connection pipes, and
  - comprises:
    - a first connection pipe that communicates with the outdoor-side connection pipe;
    - second connection pipes that each communicate with an associated one of the indoor-side connection pipes;
    - a branch portion that communicates the first connection pipe with the second connection pipes; and
    - a control valve that is connected to the first connection pipe and that blocks a flow of refrigerant by being placed in a closed state; and
- a controller that controls the control valve and the expansion valve of each of the indoor units to the closed state in response to occurrence of refrigerant leakage, wherein
- the refrigerant connection pipe comprises:
  - a gas-side connection pipe; and
  - a liquid-side connection pipe;
- the gas-side connection pipe comprises:
  - indoor-side pipes that each communicate with at least one of the indoor units;
  - an outdoor-side pipe that communicates with two or more of the indoor-side pipes from an outdoor unit side; and
  - a branch that connects the outdoor-side pipe and a group of two or more of the indoor-side pipes,
- the outdoor-side pipe forms a refrigerant passage that is common to both refrigerant flowing from the outdoor unit to the indoor units via the indoor-side pipes and refrigerant flowing from the indoor units to the outdoor unit via the indoor-side pipes,
- the expansion valve of each of the indoor units is disposed between the liquid-side connection pipe and each of the heat exchanger,
- the refrigerant branch unit is disposed only in the gas-side connection pipe,
- the control valve is connected only to the first connection pipe in the refrigerant branch unit.

2. The air-conditioning system according to claim 1, wherein
- the refrigerant circuit comprises valves, one of which comprises a liquid seal control structure that suppresses formation of a liquid seal circuit in the refrigerant circuit when the control valve is in a closed state, and/or the refrigerant circuit comprises a pipe forming a bypass circuit that bypasses refrigerant from a passage on a first end side of the control valve to a passage on a second end side of the control valve and suppresses formation of a liquid seal circuit in the refrigerant circuit when the control valve is in the closed state.

3. The air-conditioning system according to claim 1, wherein the refrigerant branch unit is disposed in a position that satisfies at least one of following A, B, and C, where A: the outdoor-side pipe disposed between the outdoor unit and some of the indoor units of which a total capacity is less than or equal to a first threshold, B: the outdoor-side pipe disposed between the outdoor unit and some of the indoor units of which a total number is less than or equal to a second threshold, and C: the outdoor-side pipe to which the refrigerant connection pipe extending to one of the indoor units and having a total capacity being less than or equal to a third threshold is connected via the branch.

4. The air-conditioning system according to claim 3, wherein the first threshold, the second threshold, and the third threshold are set based on a size of any one of object spaces in each of which one of the indoor units is installed and air is conditioned.

5. An air-conditioning system that performs a refrigeration cycle in a refrigerant circuit, the air-conditioning system comprising:

an outdoor unit;

indoor units;

a refrigerant connection pipe that connects the outdoor unit and the indoor units;

a refrigerant branch unit that:

forms a branch, connects an outdoor-side connection pipe and indoor-side connection pipes, and comprises:

a first connection pipe that communicates with the outdoor-side connection pipe;

second connection pipes that each communicate with an associated one of the indoor-side connection pipes;

a branch portion that communicates the first connection pipe with the second connection pipes; and control valves that are each connected to each of the second connection pipes and that each block a flow of refrigerant by being placed in a closed state; and a controller that controls the control valves to the closed state in response to occurrence of refrigerant leakage, wherein the refrigerant connection pipe comprises:

indoor-side pipes that each communicate with at least one of the indoor units;

an outdoor-side pipe that communicates with two or more of the indoor-side pipes from an outdoor unit side; and a branch that connects the outdoor-side pipe and a group of two or more of the indoor-side pipes, the outdoor-side pipe forms a refrigerant passage that is common to both refrigerant flowing from the outdoor unit to the indoor units via the indoor-side pipes and refrigerant flowing from the indoor units to the outdoor unit via the indoor-side pipes, one or more of the second connection pipes comprise a pipe that communicates with two or more of the indoor units via corresponding ones of the indoor-side pipes, and a location where the refrigerant branch unit is disposed is determined based on at least one of:

a number of the indoor units that are connected, via the indoor-side pipes, to the second connection pipes, a total volumetric capacity of the indoor units that are connected, via the indoor-side pipes, to the second connection pipes, and a total volumetric capacity of the indoor-side pipes communicating with the second connection pipes, such that a concentration of the refrigerant in an object space in which air is conditioned by one of the indoor units does not exceed a limit for safety when the refrigerant has leaked.

6. The air-conditioning system according to claim 5, wherein each one of the indoor units comprises an electrically-operated valve that decompresses refrigerant according to an opening degree during operation and, when refrigerant leakage has occurred, blocks refrigerant flowing into the one of the indoor units by being placed in a closed state.

7. The air-conditioning system according to claim 5, wherein the refrigerant circuit comprises valves, one of which comprises a liquid seal control structure that suppresses formation of a liquid seal circuit in the refrigerant circuit when one of the control valves is in the closed state, and/or the refrigerant circuit comprises a pipe forming a bypass circuit that bypasses refrigerant from a passage on a first end side of the one of the control valves to a passage on a second end side of the one of the control valves and suppresses formation of a liquid seal circuit in the refrigerant circuit when the one of the control valves is in the closed state.

8. The air-conditioning system according to claim 5, wherein the refrigerant connection pipe further comprises:

a gas-side connection pipe through which low-pressure refrigerant flows; and a liquid-side connection pipe through which high-pressure or intermediate-pressure refrigerant flows, and the refrigerant branch unit is disposed in the gas-side connection pipe.

9. The air-conditioning system according to claim 8, further comprising another one of the refrigerant branch unit disposed in the liquid-side connection pipe.

10. A refrigerant branch unit that connects an outdoor-side connection pipe with a plurality of indoor-side connection pipes in an air-conditioning system that comprises an outdoor unit and a plurality of indoor units that are connected via a refrigerant connection pipe, the refrigerant connection pipe comprising: the indoor-side connection pipes that each communicate with one of the indoor units; and the outdoor-side connection pipe that communicates with two or more of the indoor-side connection pipes from an outdoor unit side, the refrigerant branch unit comprising:

a first connection pipe that communicates with the outdoor-side connection pipe;

a plurality of second connection pipes that each communicate with one of the indoor-side connection pipes;

a branch that communicates the first connection pipe with the second connection pipes; and a control valve that is connected to the first connection pipe and that blocks a flow of refrigerant by being placed in a closed state, wherein the first connection pipe, the plurality of second connection pipes, the branch, and the control valve are included in a first component, the refrigerant branch unit further comprising:

a second component that comprises a board on or in which an electric component for controlling a status of the control valve is implemented; and a wire that connects the control valve and the board, wherein the second component is disposed independently of the first component and moves freely relative to the first component.

11. The refrigerant branch unit according to claim 10, wherein the control valve comprises:

a valve body;

a first end portion connected to a first end of the first connection pipe or the outdoor-side connection pipe; and a second end portion connected to the branch or a second end of the first connection pipe, and a longitudinal direction of the second end portion intersects with a longitudinal direction of the first end portion, and the second end portion is connected to the branch or the second end of the first connection pipe such that, in an installation state, the plurality of second connection pipes are disposed along a horizontal direction and a longitudinal direction of each of the plurality of second connection pipes extends along the horizontal direction.

12. The refrigerant branch unit according to claim 10, wherein the second component further comprises a casing that accommodates the board.

13. The refrigerant branch unit according to claim 10, wherein the wire has a longitudinal dimension of 1 m or longer.

14. The refrigerant branch unit according to claim 10, wherein a pipe forming a bypass circuit that bypasses refrigerant from a passage on a first end side of the control valve to a passage on a second end side of the control valve and suppresses formation of a liquid seal circuit when the control valve is in a closed state is disposed, and/or the control valve comprises a liquid seal control structure that suppresses formation of a liquid seal circuit when the control valve is in a closed state.

15. A refrigerant branch unit that connects an outdoor-side connection pipe with a plurality of indoor-side connection pipes in an air-conditioning system that comprises an outdoor unit and a plurality of indoor units that are connected via a refrigerant connection pipe, the refrigerant connection pipe comprising: the indoor-side connection pipes that each communicate with one of the indoor units; and the outdoor-side connection pipe that communicates with two or more of the indoor-side connection pipes from an outdoor unit side, the refrigerant branch unit comprising:

a first connection pipe that communicates with the outdoor-side connection pipe;

a plurality of second connection pipes that each communicate with one of the indoor-side connection pipes;

a branch that communicates the first connection pipe with the second connection pipes; and a control valve that blocks a flow of refrigerant in a closed state, wherein the control valve is connected to an associated one of the second connection pipes, the first connection pipe, the plurality of second connection pipes, the branch, and the control valve are included in a first component, the refrigerant branch unit further comprising:

a second component that comprises a board on or in which an electric component for controlling a status of the control valve is implemented; and a wire that connects the control valve and the board, wherein the second component is disposed independently of the first component and moves freely relative to the first component.

16. The refrigerant branch unit according to claim 15, wherein the control valve comprises:

a valve body;

a first end portion connected to a first end of one of the second connection pipes or the branch; and a second end portion connected to one of the plurality of indoor-side connection pipes or a second end of one of the plurality of second connection pipes, and a longitudinal direction of the second end portion intersects with a longitudinal direction of the first end portion, and the second end portion is connected to one of the indoor-side connection pipes or the second end of the one of the second connection pipes such that, in an installation state, the plurality of second connection pipes are disposed along a horizontal direction and a longitudinal direction of each of the plurality of second connection pipes extends along the horizontal direction.

17. The refrigerant branch unit according to claim 15, wherein the second component further comprises a casing that accommodates the board.

18. The refrigerant branch unit according to claim 15, wherein the wire has a longitudinal dimension of 1 m or longer.

19. The refrigerant branch unit according to claim 15, wherein a pipe forming a bypass circuit that bypasses refrigerant from a passage on a first end side of the control valve to a passage on a second end side of the control valve and suppresses formation of a liquid seal circuit when the control valve is in a closed state is disposed, and/or the control valve comprises a liquid seal control structure that suppresses formation of a liquid seal circuit when the control valve is in a closed state.

20. An air-conditioning system that performs a refrigeration cycle in a refrigerant circuit, the air-conditioning system comprising:

an outdoor unit;

indoor units;

a refrigerant connection pipe that connects the outdoor unit and the indoor units;

a refrigerant branch unit that:

forms a branch, connects an outdoor-side connection pipe and indoor-side connection pipes, and comprises:

a first connection pipe that communicates with the outdoor-side connection pipe;

second connection pipes that each communicate with an associated one of the indoor-side connection pipes;

a branch portion that communicates the first connection pipe with the second connection pipes; and control valves that are each connected to each of the second connection pipes and that each block a flow of refrigerant by being place in a closed state; and a controller that controls the control valves to the closed state in response to occurrence of refrigerant leakage, wherein the refrigerant connection pipe comprises:

indoor-side pipes that each communicate with at least one of the indoor units;

an outdoor-side pipe that communicates with two or more of the indoor-side pipes from an outdoor unit side; and a branch that connects the outdoor-side pipe and a group of two or more of the indoor-side pipes, the outdoor-side pipe forms a refrigerant passage that is common to both refrigerant flowing from the outdoor unit to the indoor units via the indoor-side pipes and refrigerant flowing from the indoor units to the outdoor unit via the indoor-side pipes, a refrigerant passage extending from the outdoor unit to the indoor units comprises multiple branches, a first branch is closest to the outdoor unit among the multiple branches, second branches are disposed next to the first branch in the refrigerant passage, the refrigerant branch unit is not disposed in the refrigerant passage at the first branch and is disposed at a branch that is closer to one of the indoor units than the first branch is, each of the indoor-side connection pipes extending toward the indoor units from the first branch includes one of the second branches, the control valves are not disposed at the refrigerant passage between the first branch and any one of the second branches, one or more of the second connection pipes comprise a pipe that is connected to two or more of the indoor units via pipes.

* * * * *